US009803361B2

(12) United States Patent
Von Hoyningen Huene et al.

(10) Patent No.: US 9,803,361 B2
(45) Date of Patent: Oct. 31, 2017

(54) MODULAR WALL SYSTEM WITH VARIABLE TRIM

(71) Applicant: Allsteel Inc., Muscatine, IA (US)

(72) Inventors: Eberhard Von Hoyningen Huene, Hudson (CA); Scott Shovar, Davenport, IA (US); Matthew C. Brown, Wilton, IA (US)

(73) Assignee: ALLSTEEL Inc., Muscatine, IA (US)

( * ) Notice: Subject to any disclaimer, the term of this patent is extended or adjusted under 35 U.S.C. 154(b) by 0 days.

(21) Appl. No.: 14/730,893

(22) Filed: Jun. 4, 2015

(65) Prior Publication Data

US 2015/0354212 A1 Dec. 10, 2015

Related U.S. Application Data

(60) Provisional application No. 62/008,867, filed on Jun. 6, 2014.

(51) Int. Cl.
*E04B 2/74* (2006.01)

(52) U.S. Cl.
CPC ..... *E04B 2/7401* (2013.01); *E04B 2/7457* (2013.01); *E04B 2002/749* (2013.01); *E04B 2002/7488* (2013.01); *E04B 2002/7492* (2013.01)

(58) Field of Classification Search
CPC ..... E04B 2002/7494; E04B 2002/7492; E04B 2002/7488; E04B 2002/749; E04B 2/7401; E04B 2/7457
See application file for complete search history.

(56) References Cited

U.S. PATENT DOCUMENTS 1,990,259 A * 2/1935 Walters ..... E04B 2/821 296/29
4,080,766 A * 3/1978 Jastrabek ..... E04B 2/82 52/242
4,086,734 A * 5/1978 Hayashi ..... E04B 2/82 52/126.4
4,407,101 A * 10/1983 Propst ..... E04B 2/82 52/126.3
4,555,880 A * 12/1985 Gzym ..... E04B 2/825 52/126.4

(Continued)

FOREIGN PATENT DOCUMENTS

DE 2346475 A1 3/1975
DE 2545794 A1 4/1977

(Continued)

OTHER PUBLICATIONS

International Search Report and Written Opinion issued in PCT/US2015/034201, dated Sep. 7, 2015, 14 pages.

*Primary Examiner* — Babajide Demuren
(74) *Attorney, Agent, or Firm* — Faegre Baker Daniels LLP

(57) ABSTRACT

A moveable and demountable wall panel system that is secured between a floor of a room and a ceiling rail secured to a ceiling of the room. The wall panel includes a lower trim assembly that is both removably connected to a wall panel of the wall panel system and pivotably connected to a floor channel of the wall panel system. The lower trim panel is further configured to adjust in conjunction with wall panel height adjustments made by one or more height adjustment assemblies.

20 Claims, 62 Drawing Sheets

(56) References Cited

U.S. PATENT DOCUMENTS

| | | | | | |
|---|---|---|---|---|---|
| 4,899,018 | A * | 2/1990 | Sireci | H02G 3/288 | 174/497 |
| 5,065,556 | A * | 11/1991 | DeLong | H02G 3/288 | 160/135 |
| 6,023,896 | A | 2/2000 | Rothschild | | |
| 6,235,988 | B1 * | 5/2001 | Karst | H02G 3/288 | 174/495 |
| 6,688,056 | B2 | 2/2004 | Von Hoyningen Huene et al. | | |
| 2002/0157335 | A1 * | 10/2002 | Vos | E04B 2/821 | 52/238.1 |
| 2006/0179788 | A1 | 8/2006 | Nicoletti | | |
| 2013/0192141 | A1 | 8/2013 | Kopish et al. | | |

FOREIGN PATENT DOCUMENTS

| | | | | |
|---|---|---|---|---|
| FR | 1191915 | A * | 10/1959 | E04B 2/821 |
| FR | 1281006 | A * | 1/1962 | E04B 2/7409 |
| FR | 2616823 | A1 * | 12/1988 | E04B 2/821 |
| IT | EP 0730066 | A1 * | 9/1996 | E04B 2/821 |
| WO | 2015187952 | A1 | 12/2015 | |

* cited by examiner 301
331
315
333
337
325a
305
511
325b 329
327
325

335
477

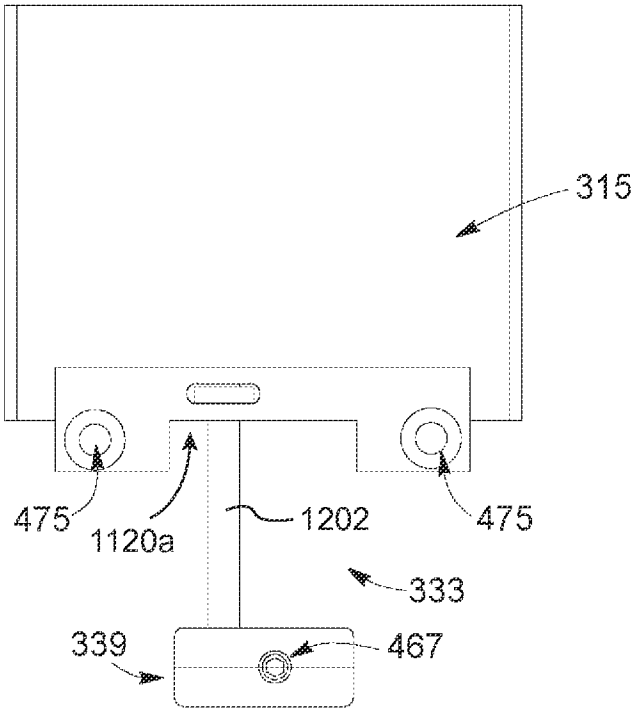
FIG. 36
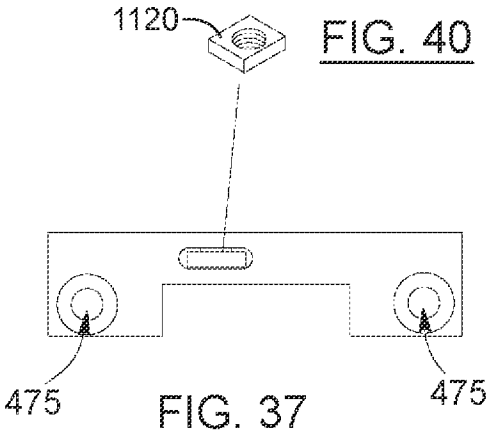
FIG. 40
FIG. 37
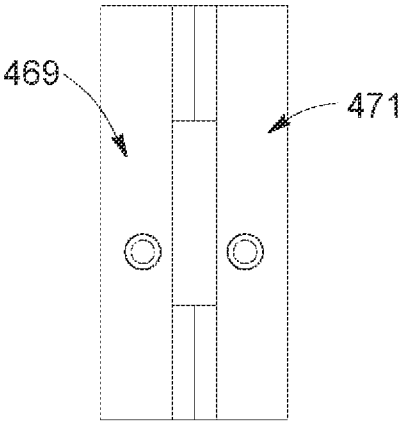
FIG. 39
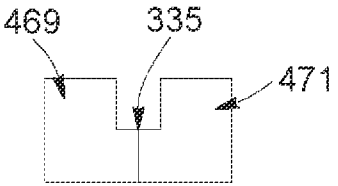
FIG. 38

515

515

515
529
523
517
529

515
529
523
521
517
519
523
529

531
527
535
533
535

531
535
535
533

531
535
535
533

305
527
527

527
315

305
507
315
527
509

315
515
527
531

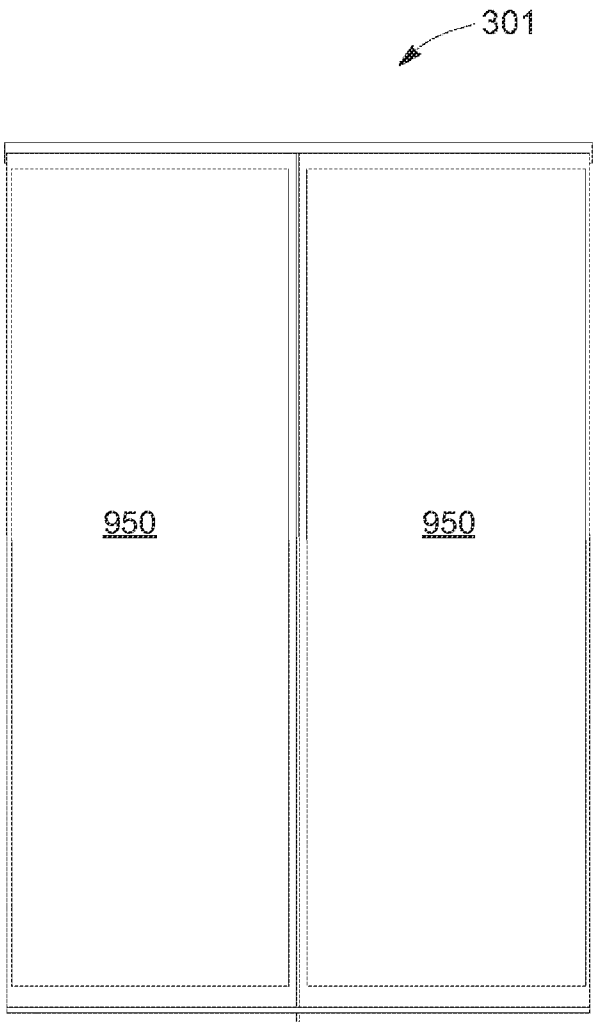
FIG. 102
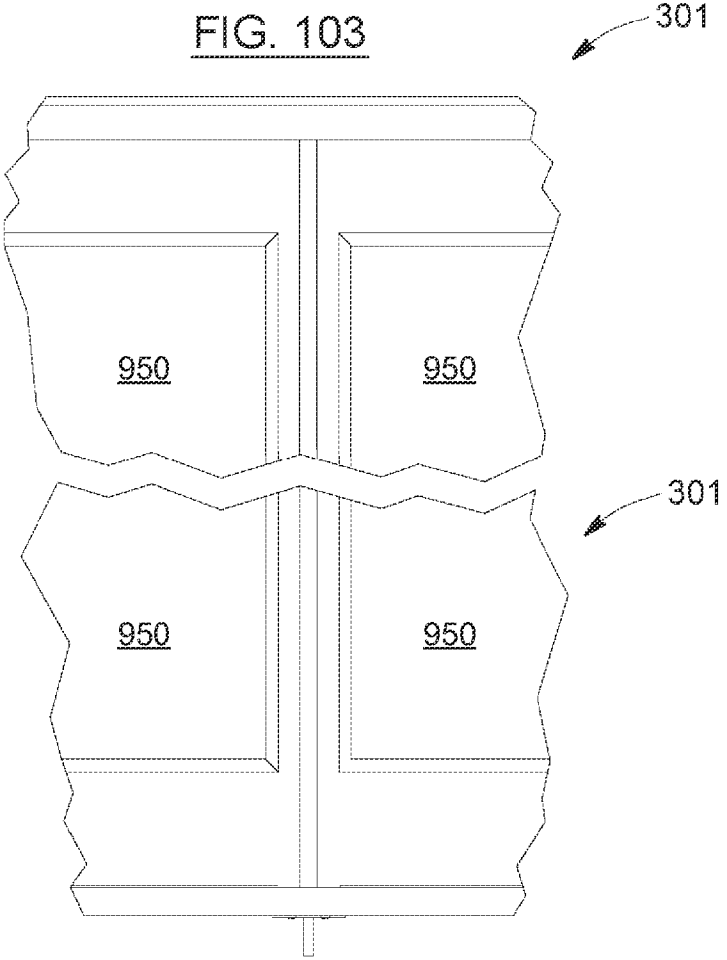
FIG. 103
FIG. 104

MODULAR WALL SYSTEM WITH VARIABLE TRIM

CROSS-REFERENCE TO RELATED APPLICATION

This application claims priority to U.S. Provisional Application No. 62/008,867, filed on Jun. 6, 2014, entitled MODULAR WALL SYSTEM WITH VARIABLE TRIM, which is herein incorporated by reference in its entirety.

TECHNICAL FIELD

The described embodiments herein relate generally to wall panel systems. More particularly, the described embodiments relate to moveable non-progressive mountable and demountable wall panel systems.

BACKGROUND

Fixed wall systems, moveable wall systems, and non-progressive wall systems provide means for separating spaces in office, retail, and other settings.

Examples of movable and demountable wall panel systems for framed wall panels, are described in U.S. Pat. No. 6,688,056 B2 granted on Feb. 10, 2004, to VON HOYNINGEN HUENE et al.

SUMMARY

Some embodiments relate to a wall panel of a moveable and demountable wall panel system that is secured between a floor of a room and a ceiling rail secured to a ceiling of the room. In one embodiment the wall panel includes a solid wall panel. In another embodiment the wall panel includes a framed panel. In yet another embodiment, the wall panel includes a frameless panel that does not include a full frame structure around a central panel, such as a glass panel. In various embodiments, the wall panel includes a ceiling track configured to be removably inserted into the ceiling rail, a height adjustment mechanism secured to the wall panel, and a bottom floor channel.

Some embodiments relate to moveable and demountable wall panel systems for defining an office space with a plurality of wall panels disposable in a substantially upright manner between a floor and a ceiling each having respectively a series of uppermost and lowermost deviations, each wall panel having a vertical axis and a horizontal axis.

In various embodiments, the wall panel includes a lower trim assembly that is both removably connected to a wall panel of the wall panel system and pivotably connected to a floor channel of the wall panel system. In one embodiment, the lower trim panel is further configured to adjust in conjunction with wall panel height adjustments made by one or more height adjustment assemblies. For example, the lower trim panel is comprised of a plurality of components configured to interact with each other, such that certain components can change position relative to certain other components. Additionally, the lower trim assembly is configured to pivot from a closed state to an open state. When positioned in the closed state, the lower trim assembly conceals (or otherwise renders inaccessible and not visible) one or more portions or components of the wall panel system. On the other hand, when position in the open state, the lower trim assembly reveals (or otherwise renders accessible and visible) one or more portions or components of the wall panel system.

In one embodiment, a wall panel system comprises: a wall panel having a top, a bottom, a left side, a right side, a front and a back, the wall panel having a variable vertical position relative to the floor of the room; a floor channel extending in a lengthwise direction between the right side and the left side of the wall panel; a height adjustment mechanism operatively coupled to the wall panel and configured to transition between a collapsed state and an expanded state to modify the variable vertical position of the wall panel relative to the floor of the room; and a bottom cover including a first portion and a second portion, the first portion retaining the second portion, the first portion being removably connected to the wall panel and having a variable vertical position relative to the floor of the room, the second portion being pivotably connected to the floor channel and having a fixed vertical position relative to the floor of the room.

Some embodiments provide for a prefabricated, modular wall panel construction system that can be moveable and demountable, from one location to another, without a "stick-built" approach, and without leaving any adverse or destructive effects behind.

Some other embodiments provide for a method of using the above-mentioned wall panel system and/or components thereof.

Other embodiments provide for a method of installing the above-mentioned wall panel system and/or components thereof.

According to yet other embodiments, there is provided an office space having been defined with the above-mentioned wall panel system and/or components thereof. Some such embodiments provide for a kit with corresponding components for assembling the above-mentioned office space.

According to yet other embodiments, there is also provided a method of assembling components of the above-mentioned kit. Some such embodiments provide for a method of doing business with the above-mentioned wall panel system, kit and/or corresponding method(s).

The objects, advantages and other features of the present subject matter will become more apparent upon reading of the following non-restrictive description of the various embodiments thereof, given for the purpose of exemplification only, with reference to the accompanying drawings.

BRIEF DESCRIPTION OF THE DRAWINGS

FIG. 36 is another side elevational view of what is shown in FIG. 34.

FIG. 37 is a side elevational view of some of the components shown in FIG. 36.

FIG. 38 is a front elevational view of one of the components shown in FIG. 37.

FIG. 39 is a top plan view of what is shown in FIG. 38.

FIG. 40 is a perspective view of one of the components shown in FIG. 37.

FIG. 102 is a side elevational view of a pair of glass post panels being assembled onto one another according to one embodiment.

FIG. 103 is an enlarged view of a top portion of what is shown in FIG. 102.

FIG. 104 is an enlarged view of a bottom portion of what is shown in FIG. 102.

FIG. 121 is an enlarged view of a bottom portion of what is shown in FIG. 120, an outer shell of one of the solid panels having been removed so as to better illustrate inner components of the assembly.

FIG. 122 is a perspective view of a post connection clip according to one embodiment.

FIG. 123 is a side elevational view of what is shown in FIG. 122.

FIG. 124 is a top plan view of what is shown in FIG. 122.

FIG. 125 is a side elevational view of a solid panel metallic frame according to one embodiment, the solid panel metallic frame being shown with an adjustable bottom cover.

FIG. 126 is a side view of what is shown in FIG. 125.

FIG. 127 is a perspective view of an intermediate distance channel shown in an exploded relationship with a vertical post of a solid panel metallic frame according to one embodiment.

FIG. 128 is a cross-sectional view of an assembled configuration of what is shown in FIG. 127.

FIG. 129 is a side elevational view of a solid panel according to one embodiment.

FIG. 130 is a partial enlarged view of some of the components of a solid wall panel according to one embodiment, some of the components being shown in an exploded relationship.

FIG. 131 is a cross-sectional view of a portion of a solid wall panel according to one embodiment.

FIG. 132 is a perspective view of what is shown in FIG. 131.

Figure 133:
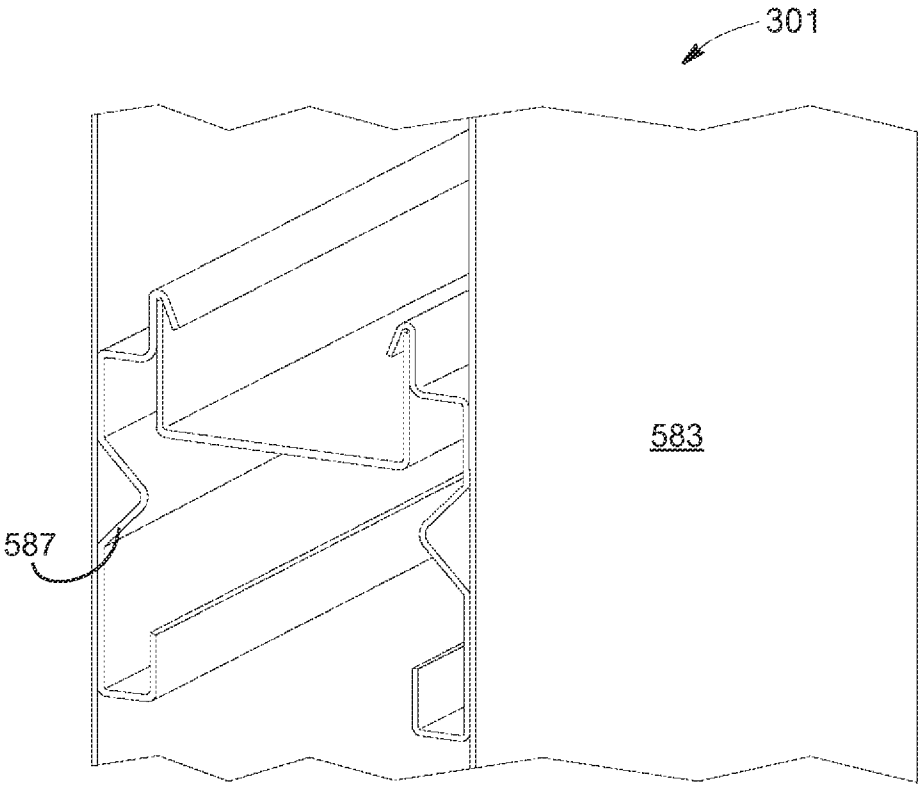

FIG. 133 is a perspective view of a solid panel metallic shell hooking assembly according to one embodiment.

Figure 134:
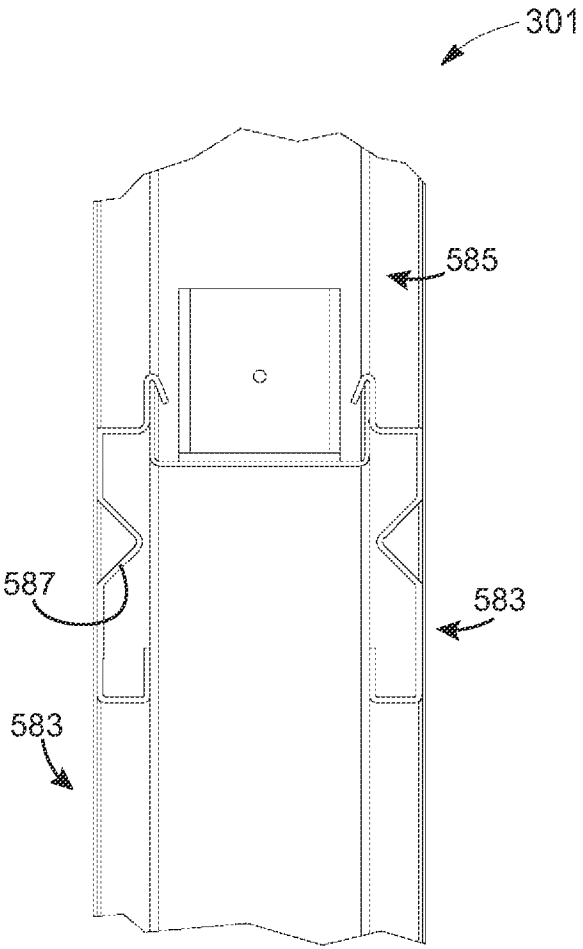

FIG. 134 is a cross-sectional view of what is shown in FIG. 133.

Figure 135:
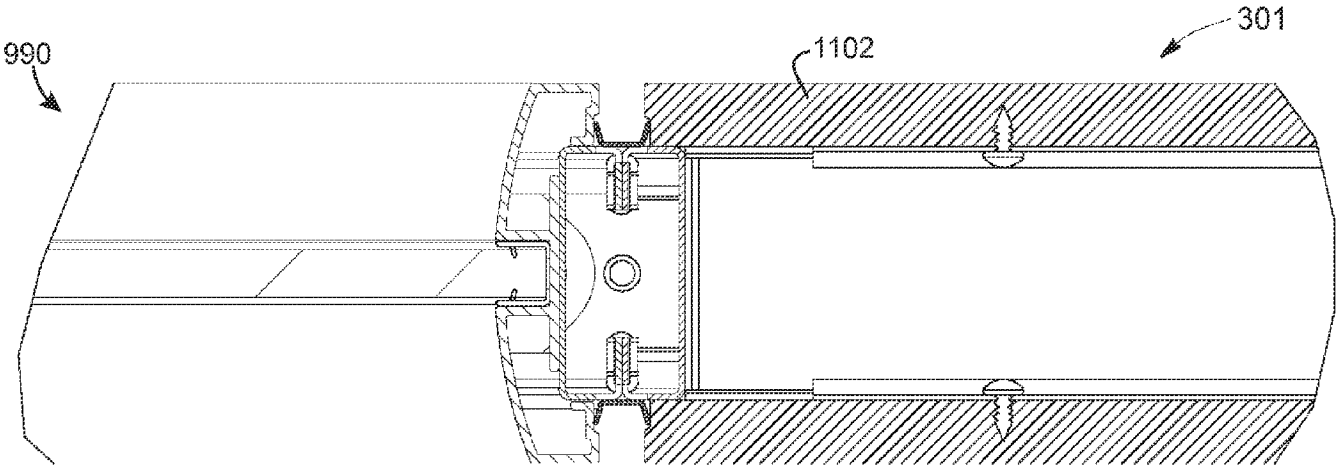

FIG. 135 is a cross-sectional view of a solid panel MDF/stackable and glass pole panel assembly according to one embodiment.

Figure 136:
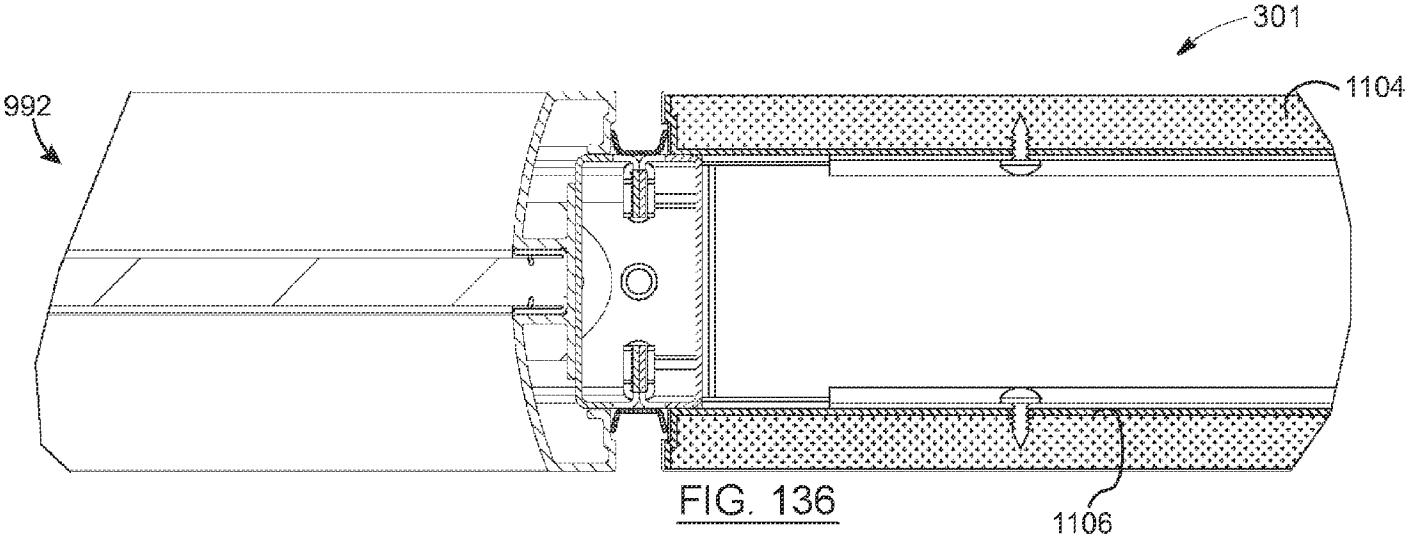

FIG. 136 is a cross-sectional view of a solid panel MDF/stackable and glass pole panel assembly according to another embodiment.

Figure 137:
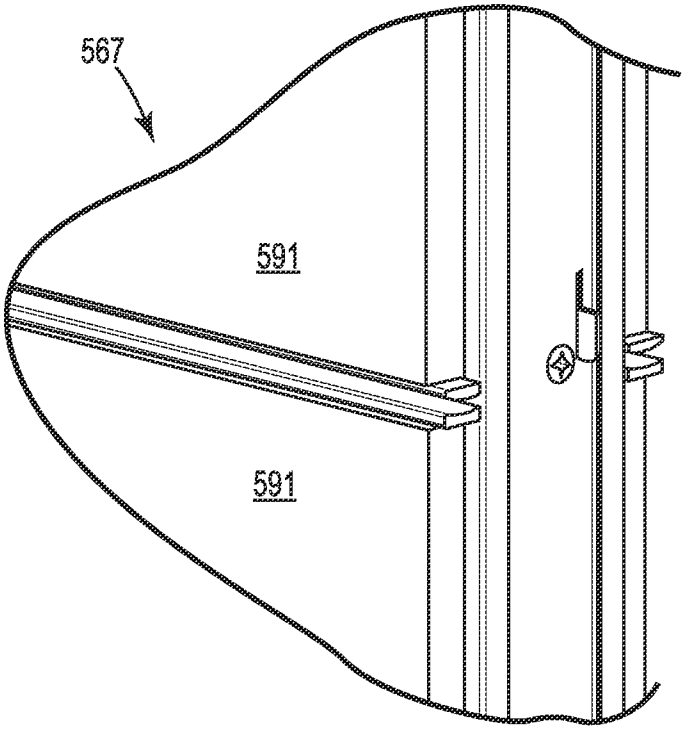

FIG. 137 is a partial perspective view of a wall panel being provided with hooking channels according to one embodiment.

Figure 138:
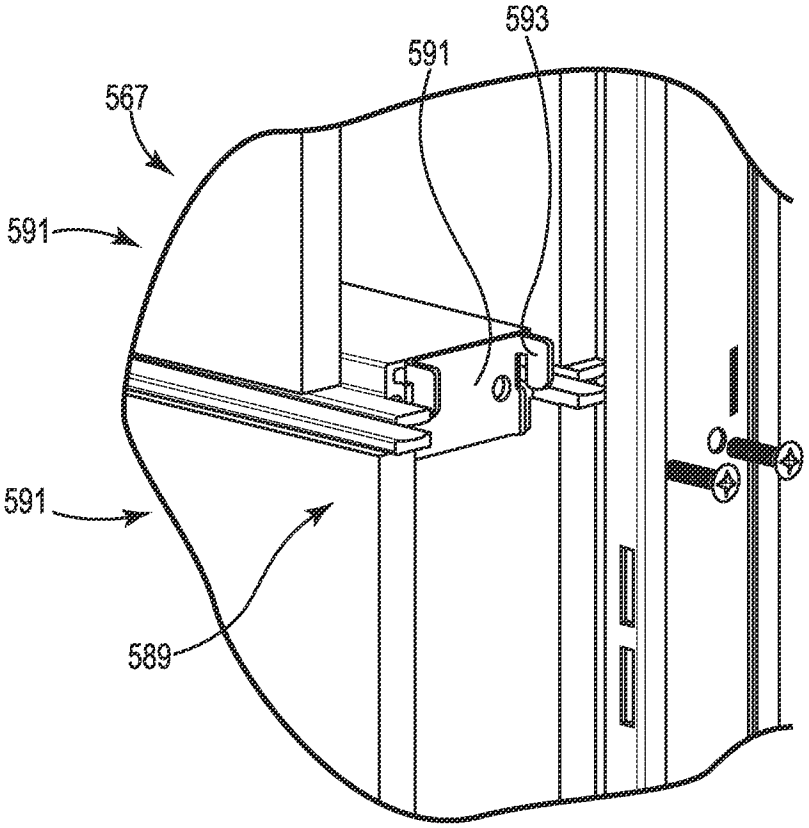

FIG. 138 is an exploded view of what is shown in FIG. 137.

Figure 139:
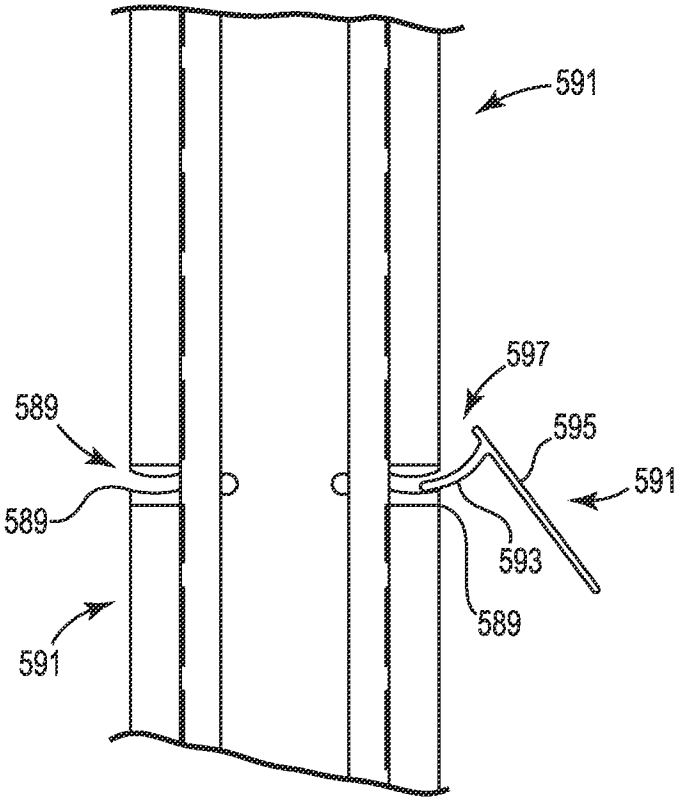

FIG. 139 is a schematic representation of a hooking bracket cooperating with a horizontal hooking channel of a wall panel according to one embodiment.

Figure 140:
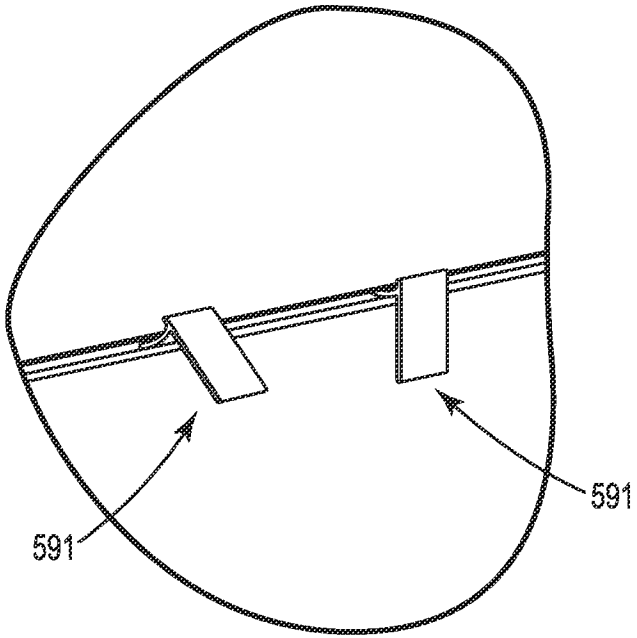

FIG. 140 is a partial view of a wall panel being provided with a pair of hooking brackets, one of the hooking brackets being shown in a hooked configuration within the horizontal hooking channel, and the hooking bracket being shown in intermediate configuration.

Figure 141:
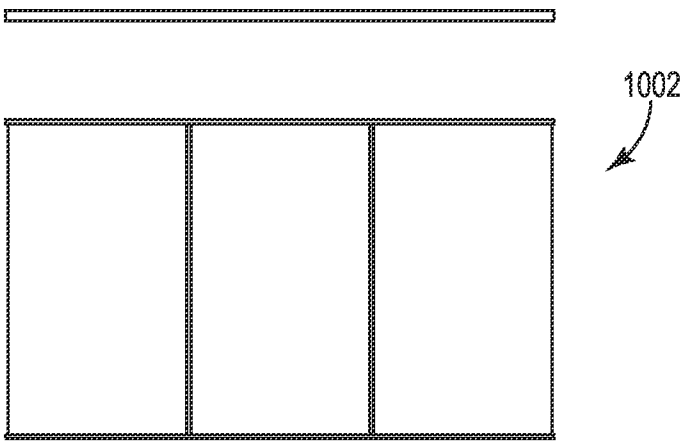

FIG. 141 is a side elevational view of a wall panel assembly disposed along a clear story configuration according to one embodiment.

Figure 142:
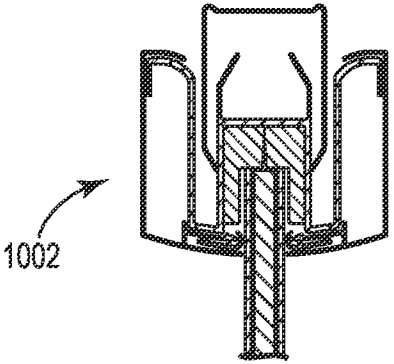

FIG. 142 is an enlarged cross-sectional view of a top portion of what is shown in FIG. 141.

Figure 143:
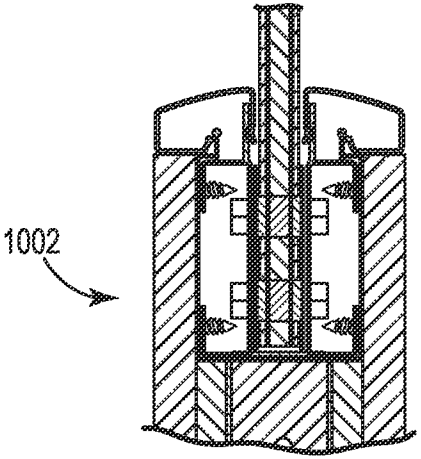

FIG. 143 is an enlarged view of a bottom portion of what is shown in FIG. 141.

Figure 144:
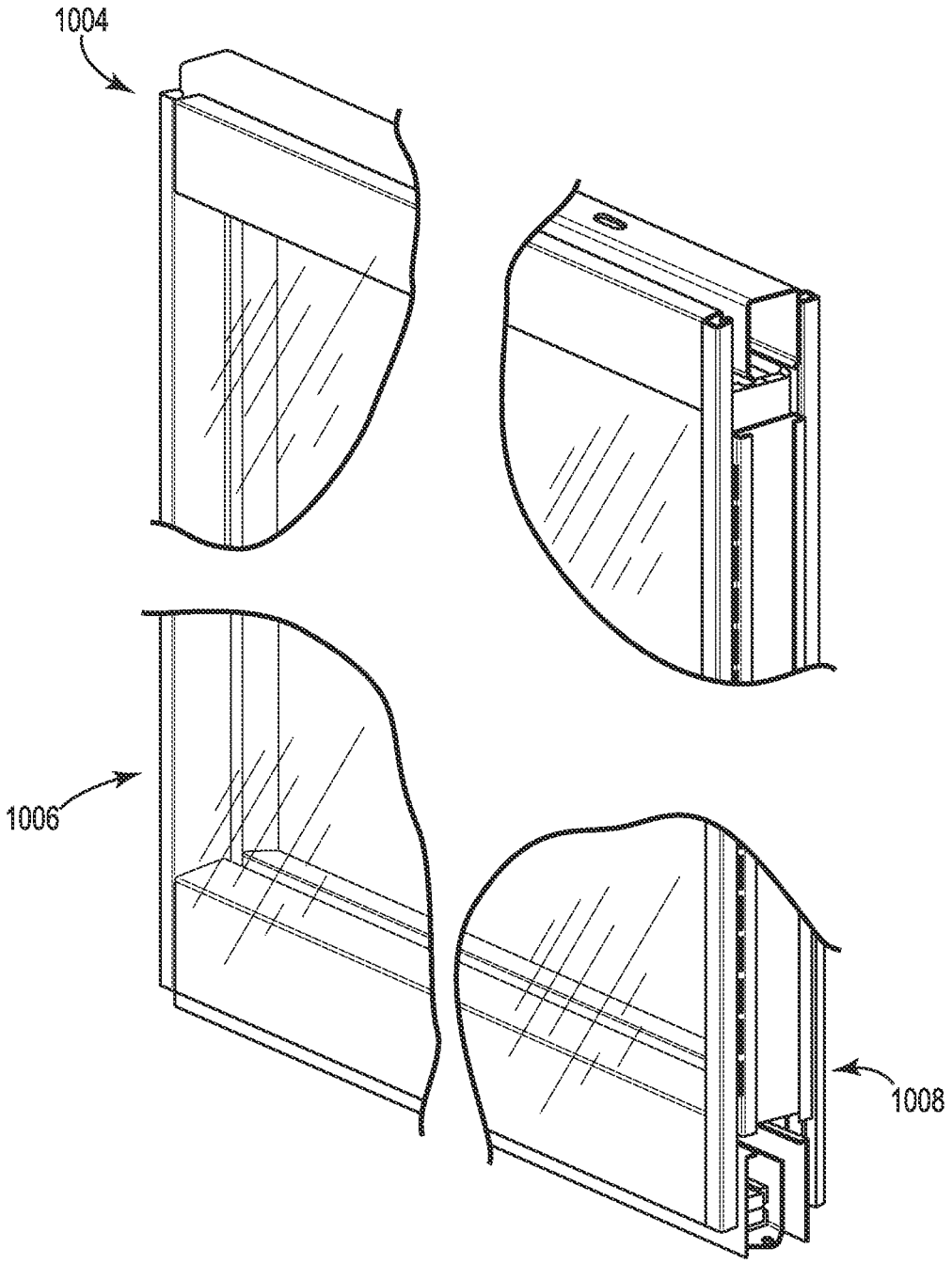

FIG. 144 is a fragmentary perspective view of a framed glass panel being provided with a dropdown cover according to one embodiment.

Figure 145:
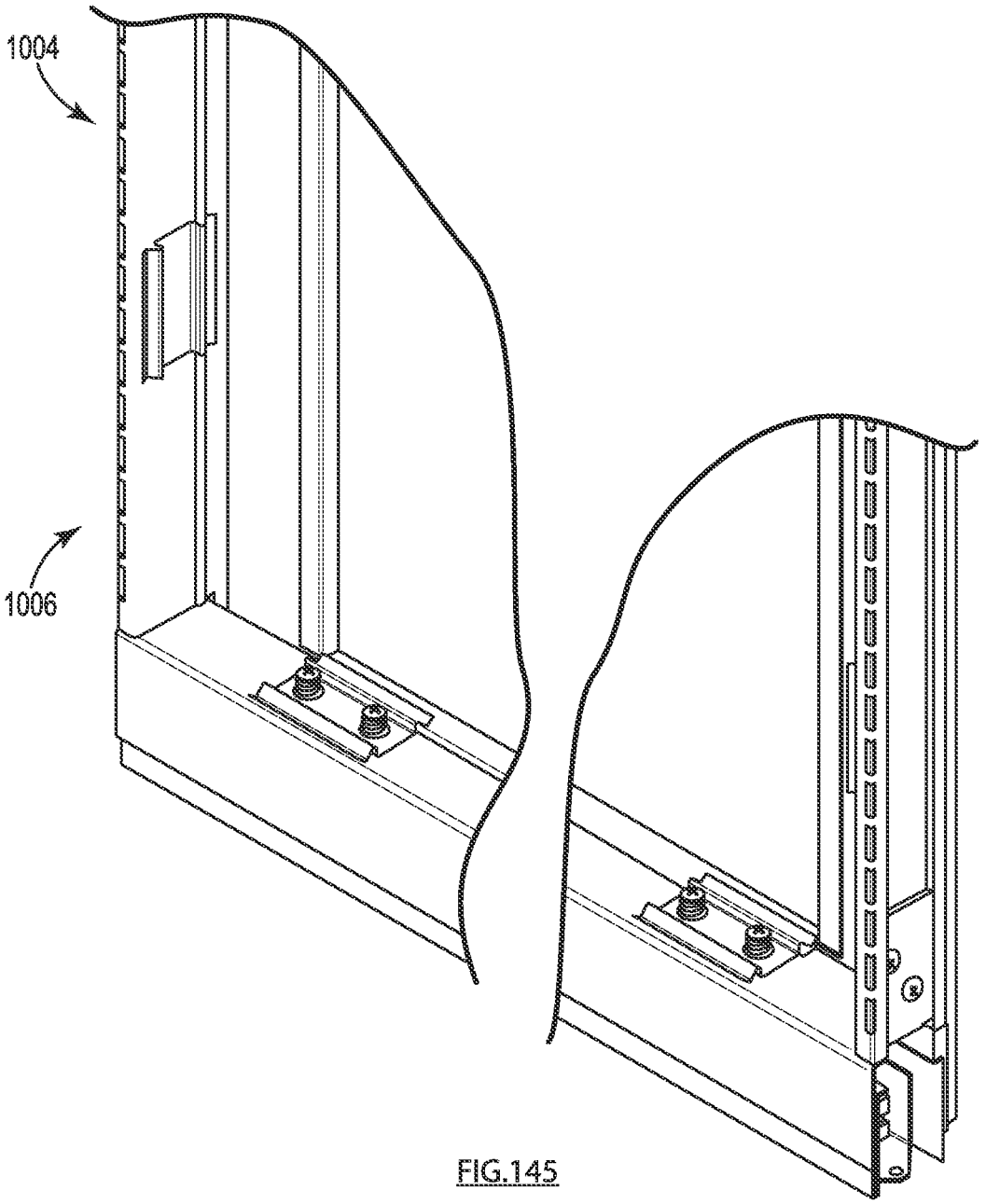

FIG. 145 is a bottom perspective of what is shown in FIG. 144, the framed glass panel being now without a bottom cover.

Figure 146:
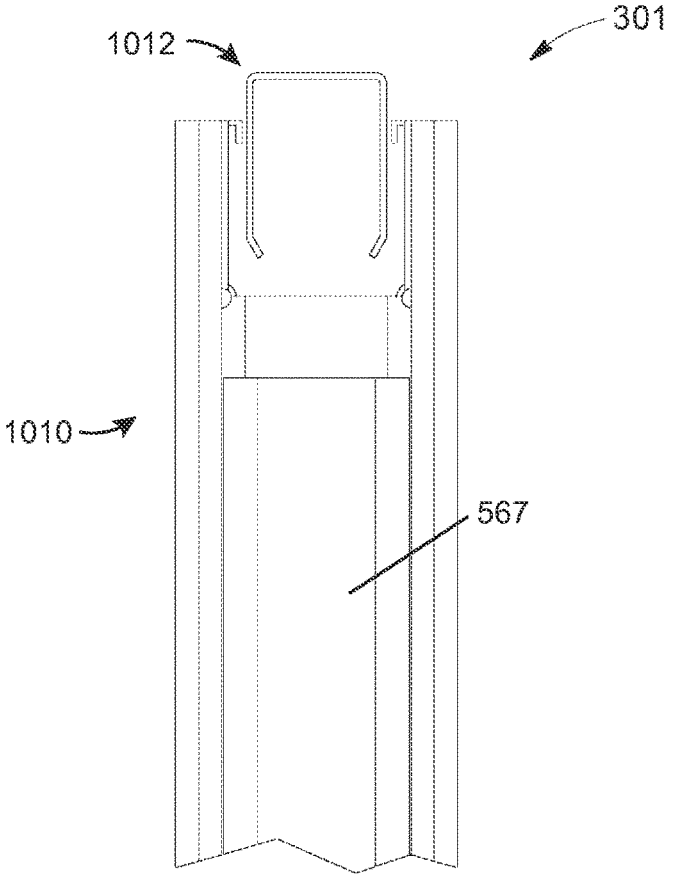
Figure 146:
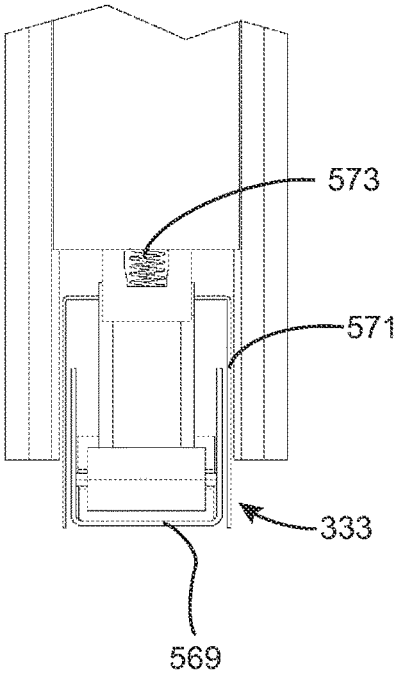

FIG. 146 is a side view of a framed wall panel being provided with a spring-loaded dropdown cover according to one embodiment.

Figure 147:
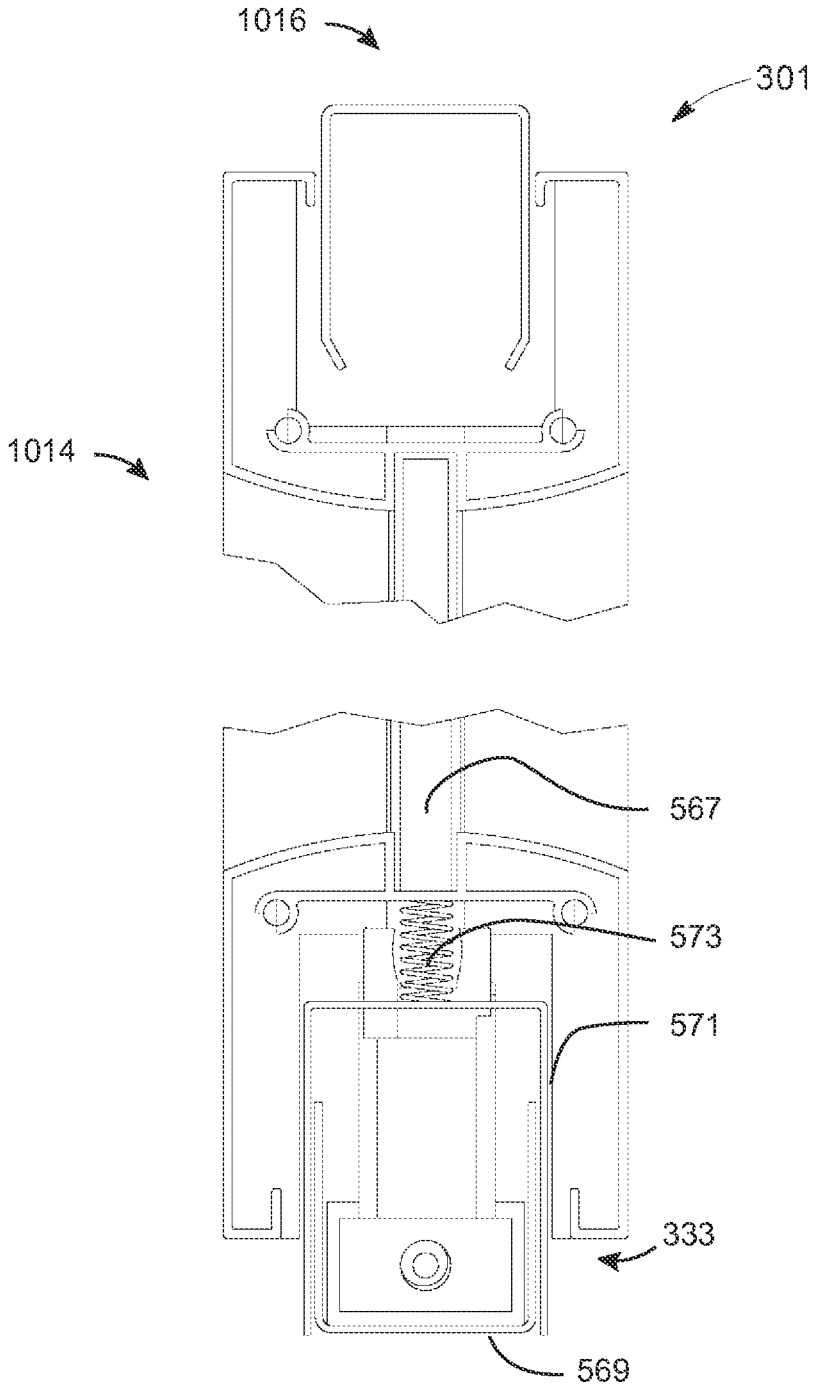

FIG. 147 is a cross-sectional view of a framed wall panel being provided with a spring-loaded dropdown cover according to another embodiment.

Figures 148, 149:
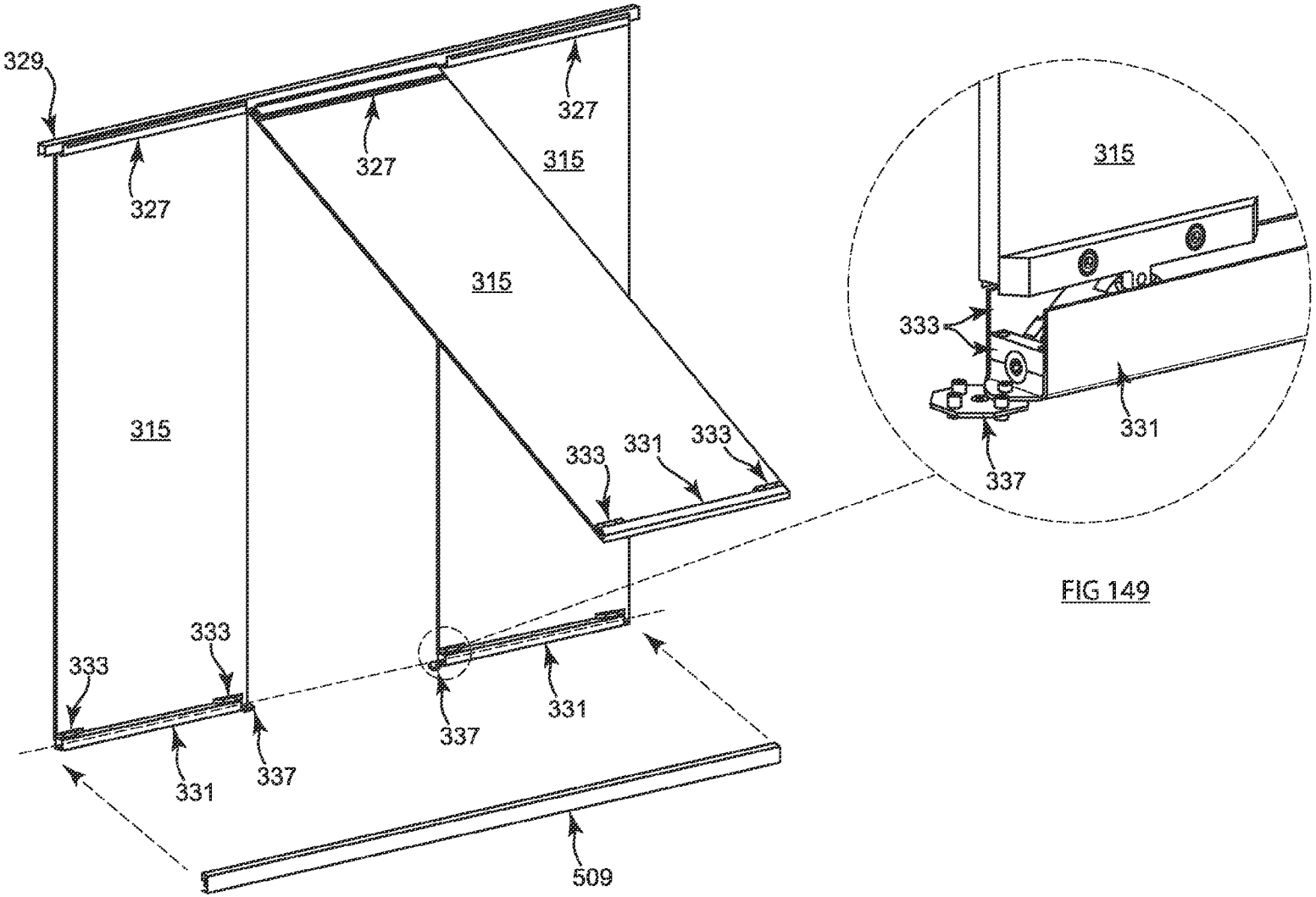

FIGS. 148 and 149 are perspective views showing a butt-glazed frameless wall panel system during installation according to one embodiment.

Figure 150:
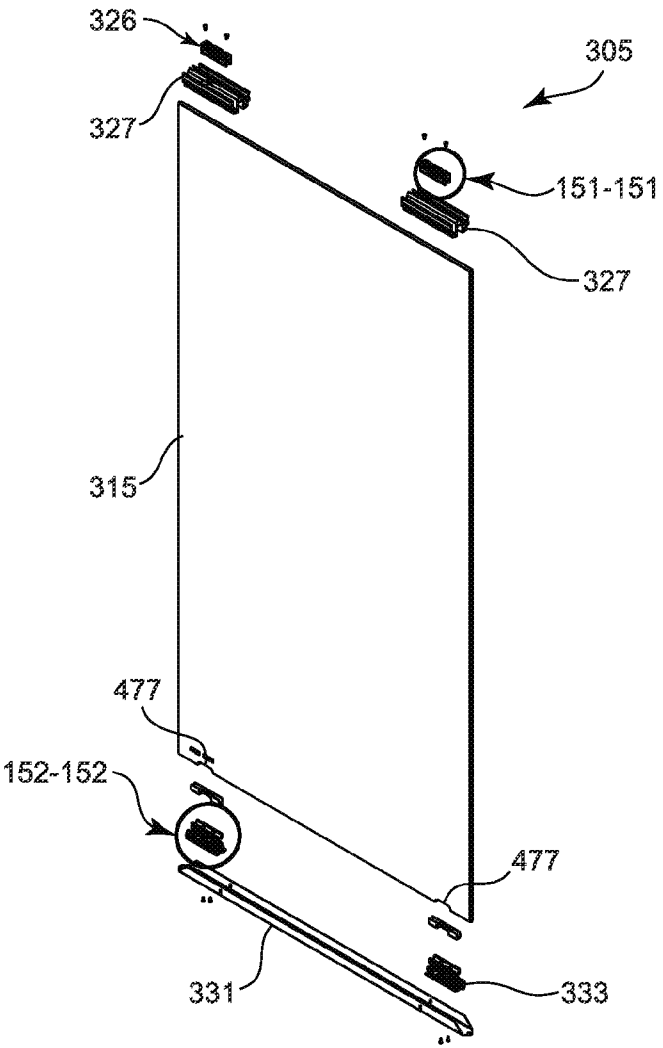

FIG. 150 is an exploded view of a pre-assembled frameless wall panel according to another embodiment.

Figure 151:
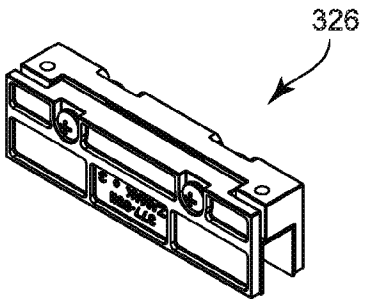

FIG. 151 is a perspective view of an upper clamp assembly of the pre-assembled wall panel of FIG. 150.

Figure 152:
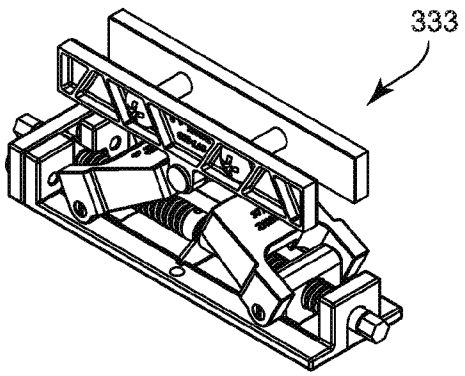

FIG. 152 is a perspective view of a height adjustment assembly of the pre-assembled wall panel of FIG. 150.

Figure 153:
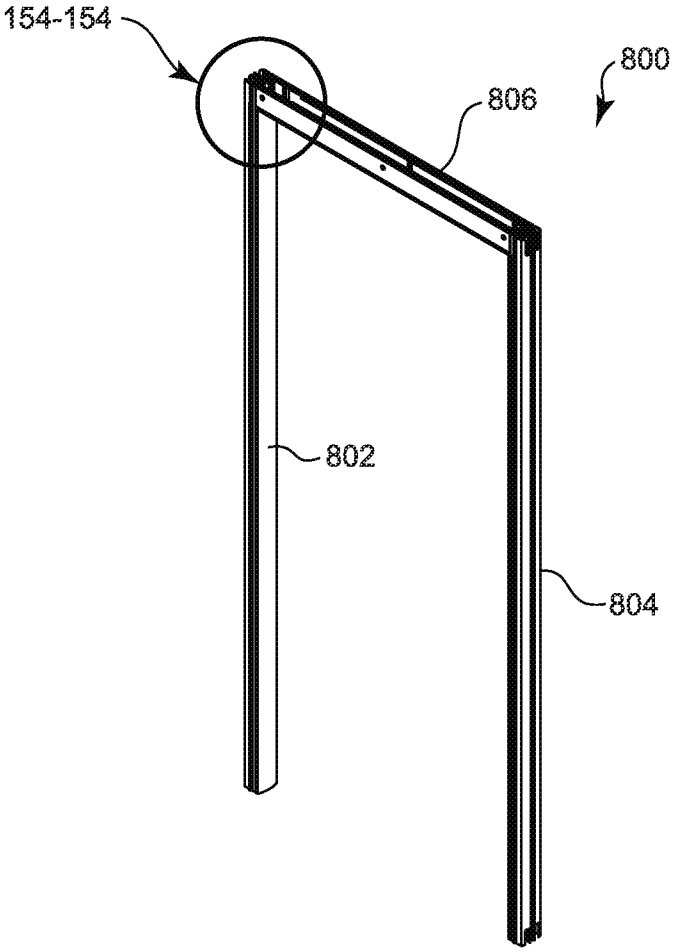

FIG. 153 is a perspective view of a door frame according to one embodiment.

Figure 154:
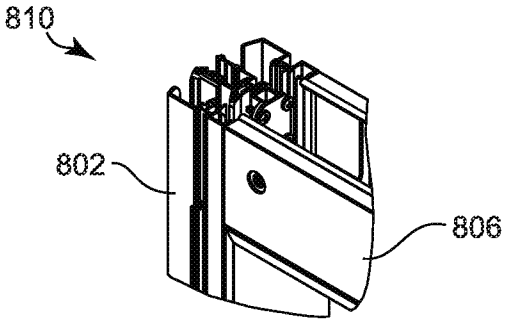

FIG. 154 is an enlarged view of area 154-154 of FIG. 153.

Figure 155:
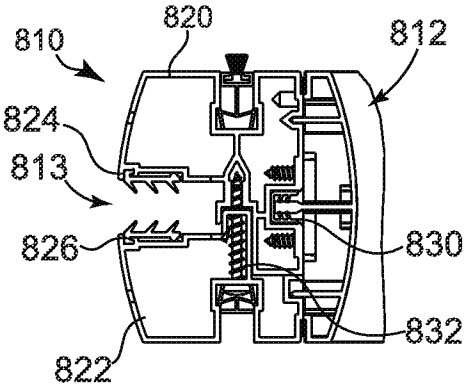

FIG. 155 is a top view of the enlarged area of FIG. 149.

Figure 156:
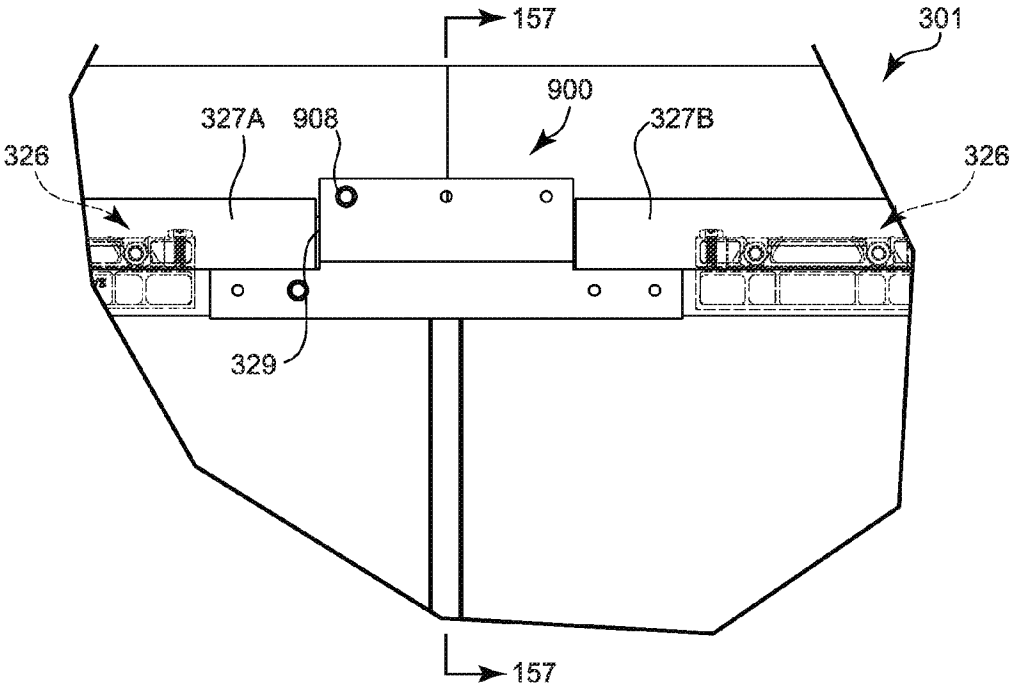

FIG. 156 is an enlarged view showing top portions of adjacent frameless, butt-glazed wall panels according to one embodiment.

Figure 157:
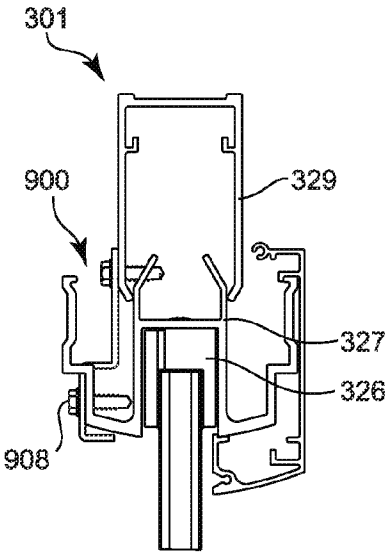

FIG. 157 is a sectional view taken along line 157-157 of FIG. 156.

Figure 158:
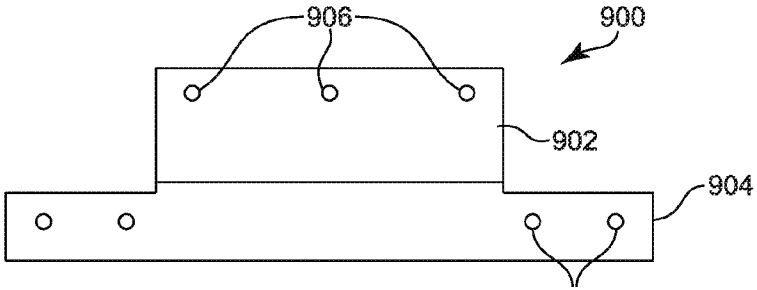

FIG. 158 is a front view of an upper interconnect of FIG. 157 according to one embodiment.

Figure 159:
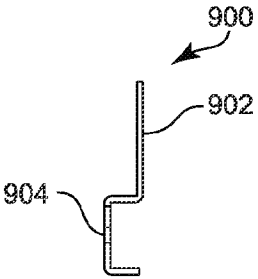

FIG. 159 is a side view of the upper interconnect of FIG. 158 according to one embodiment.

Figure 160:
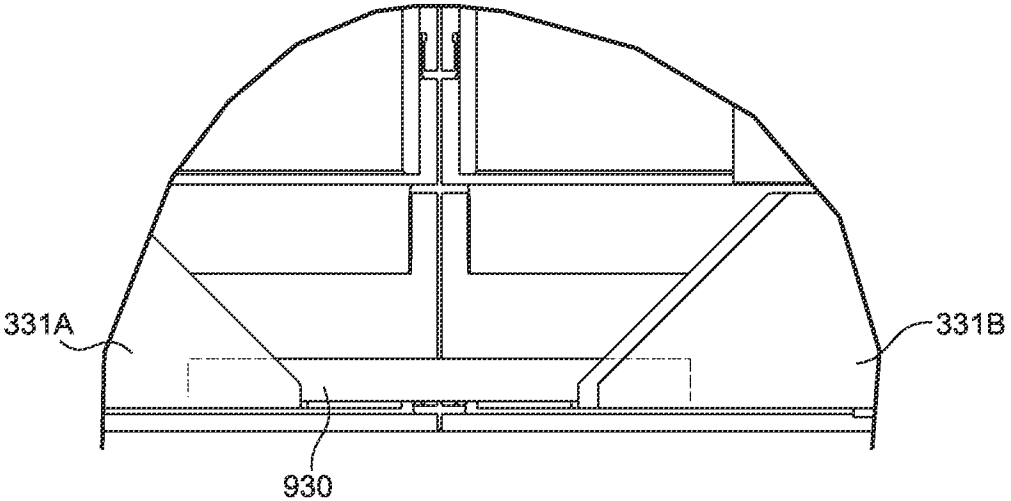

FIG. 160 is an enlarged view showing lower portions of adjacent frameless, butt-glazed wall panels according to one embodiment.

Figure 161:
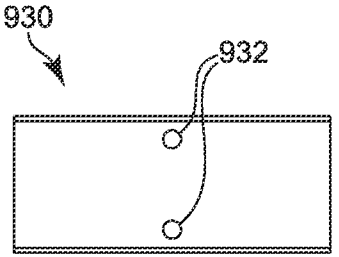

FIG. 161 is a top view of the lower interconnect of FIG. 160 according to one embodiment.

Figure 162:
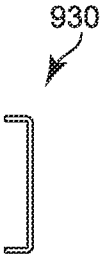
Figure 164:
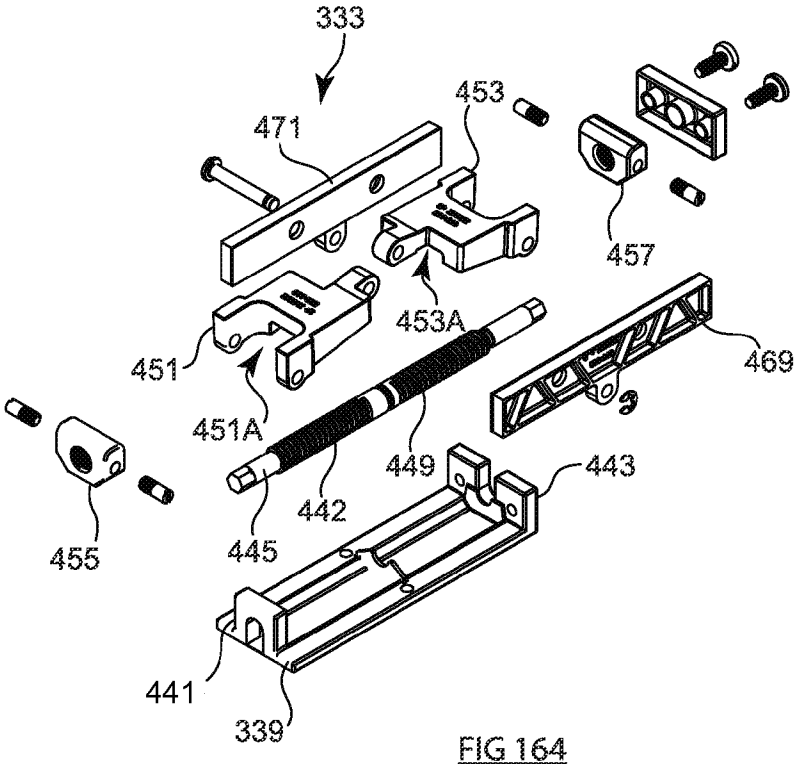
Figure 163:
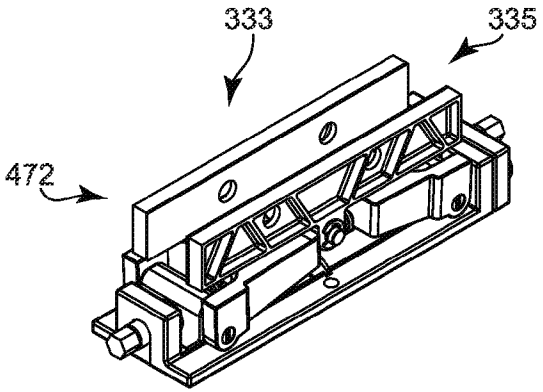

FIG. 162 is a side view of the lower interconnect of FIG. 161 according to one embodiment.

FIGS. 163-167 show a height adjustment assembly, according to one embodiment.

Figure 168:
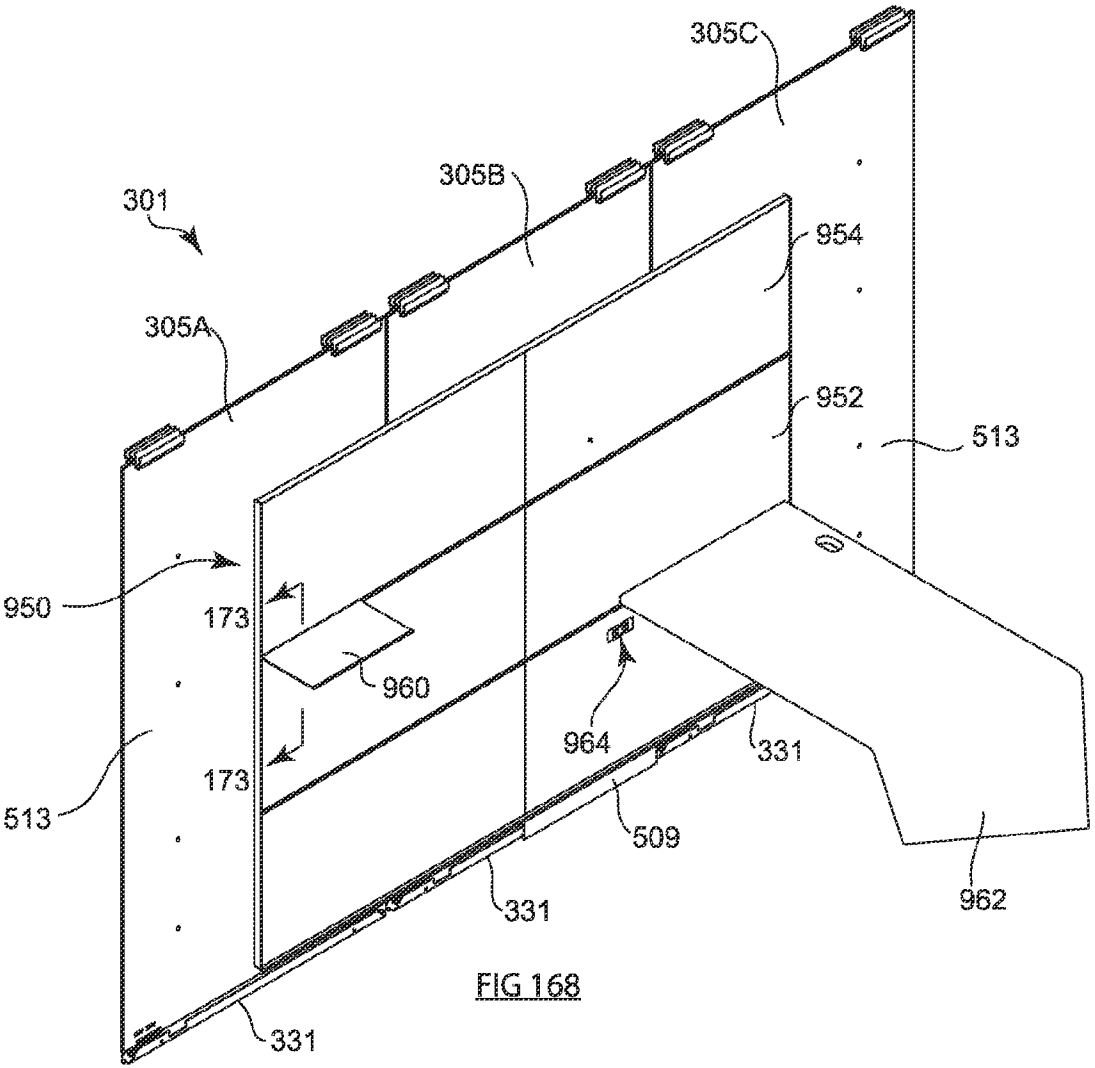

FIG. 168 shows a frameless wall panel system, according to one embodiment.

Figure 169:
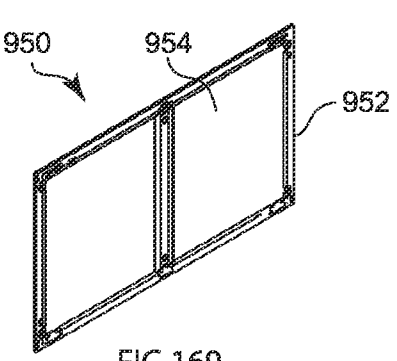
Figure 170:
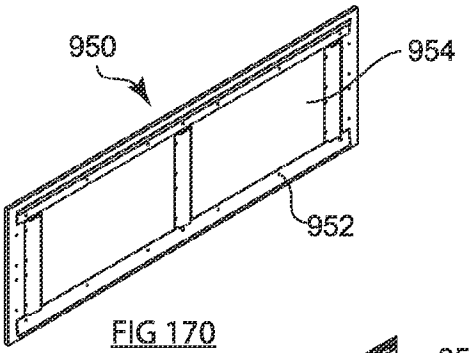
Figure 171:
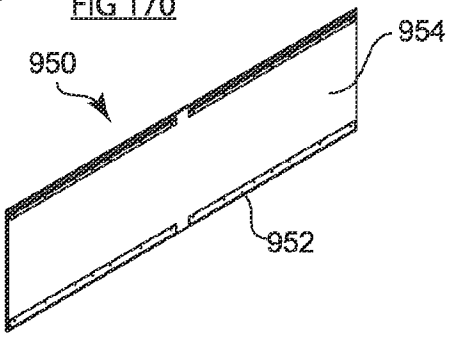

FIG. 169-171 show rail and tile systems usable with the wall panel system of FIG. 168.

Figure 172:
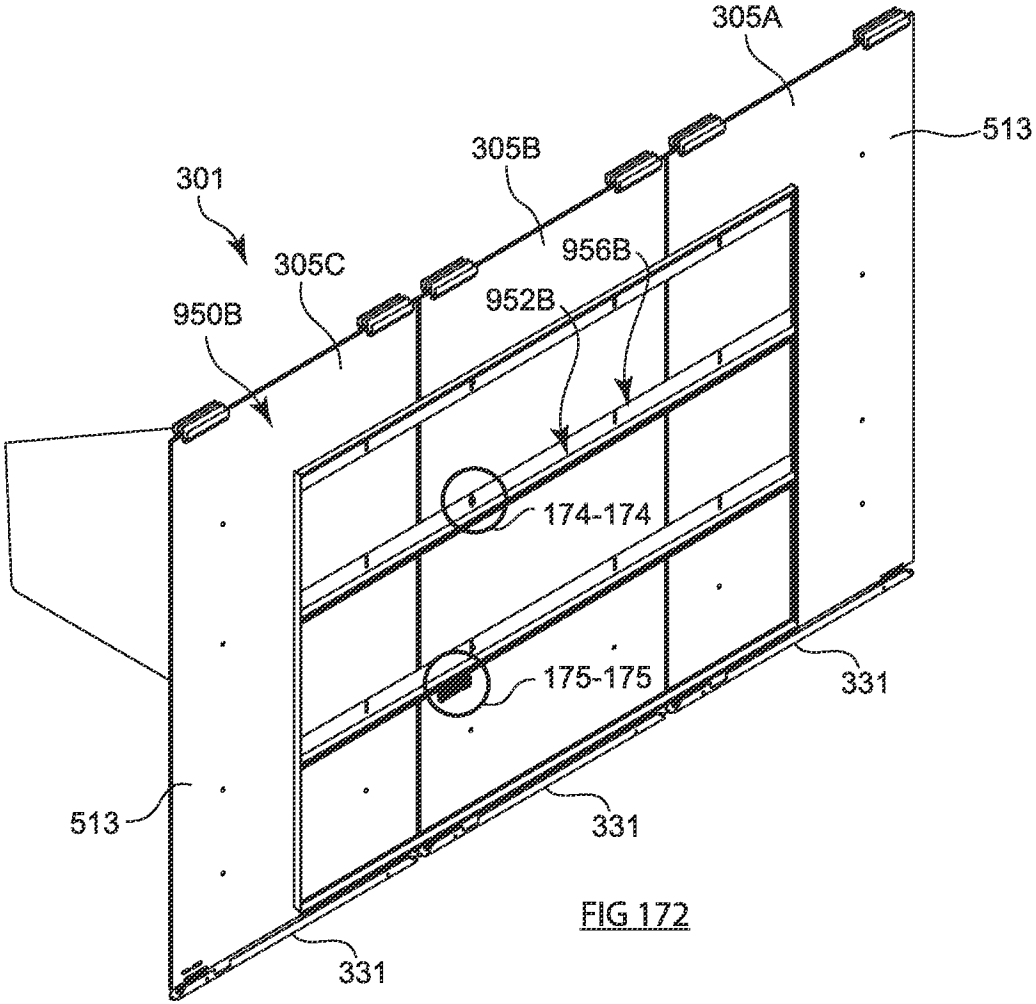

FIG. 172 shows a back view of the wall panel system of FIG. 168.

Figure 173:
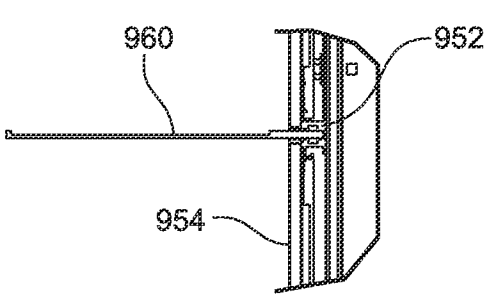

FIG. 173 is a sectional view along line 173-173 of FIG. 168.

Figure 174:
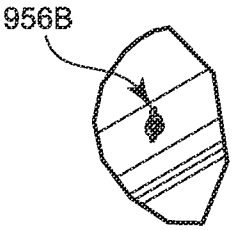
Figure 175:
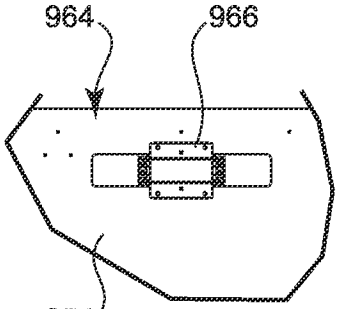

FIGS. 174 and 175 are enlarged views of portions of FIG. 172.

Figure 176:
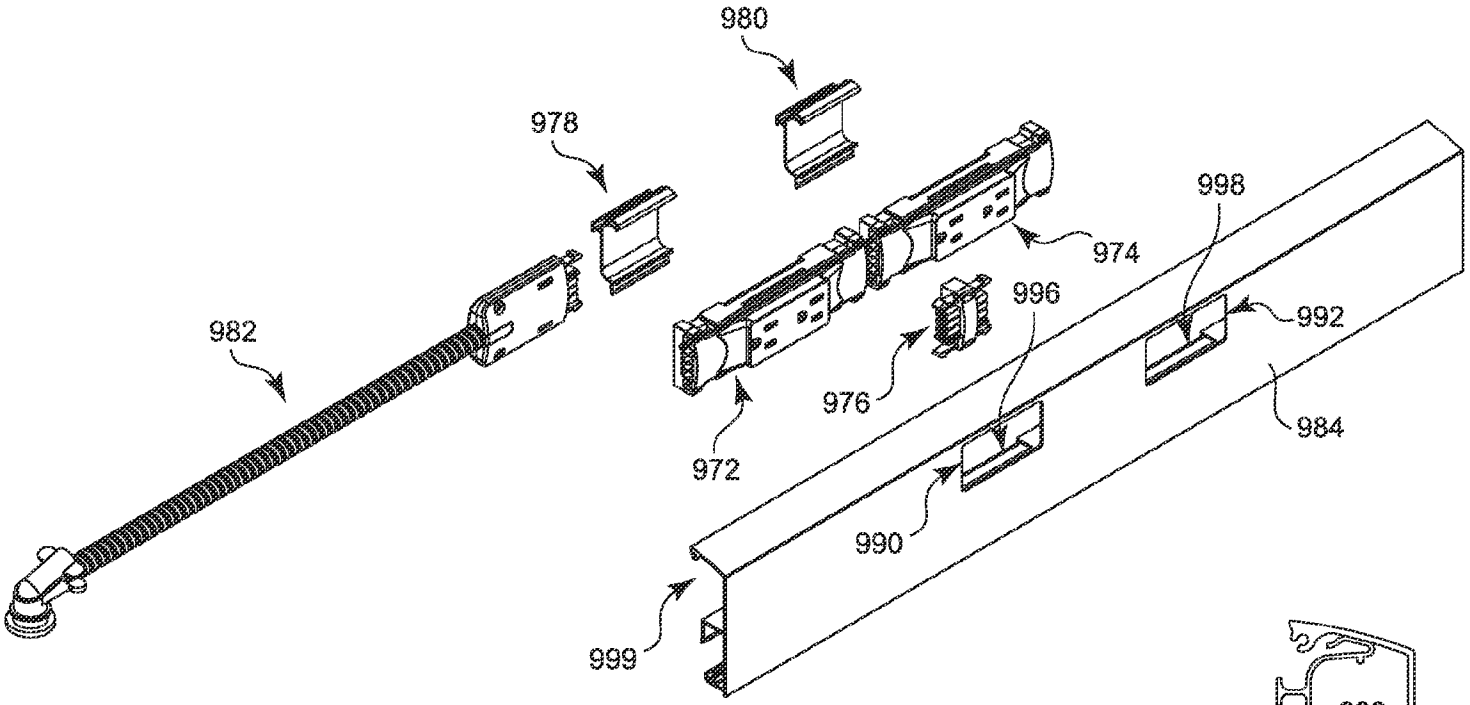
Figure 177:
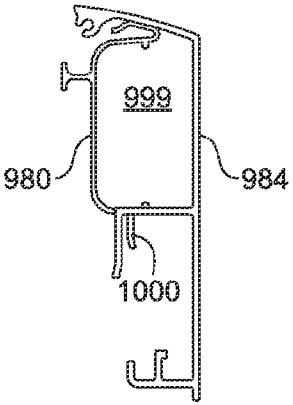

FIGS. 176 and 177 show components of an electrical outlet assembly of the wall panel system of FIG. 168, according to one embodiment.

Figure 178C:
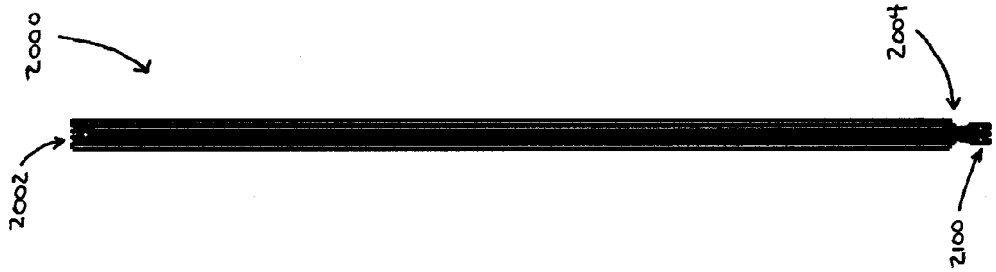
Figure 178B:
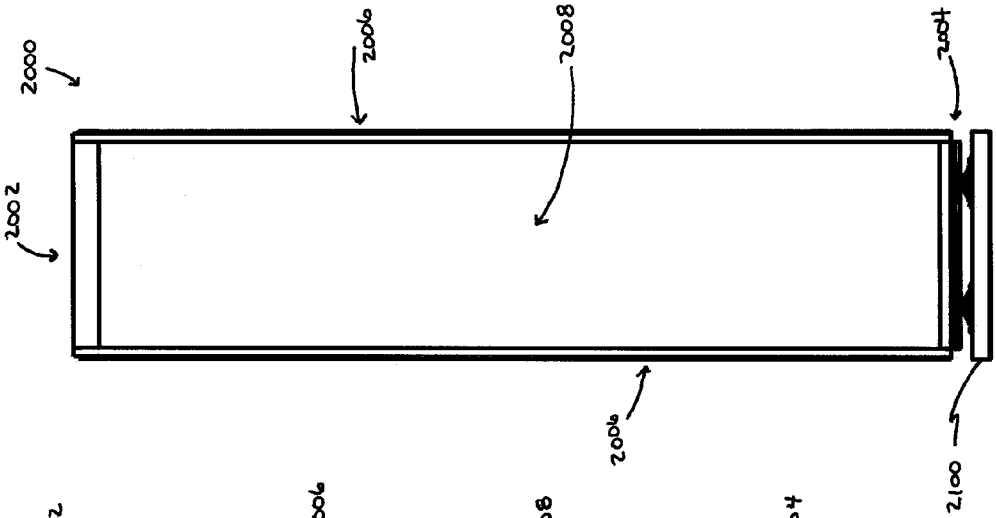
Figure 178A:
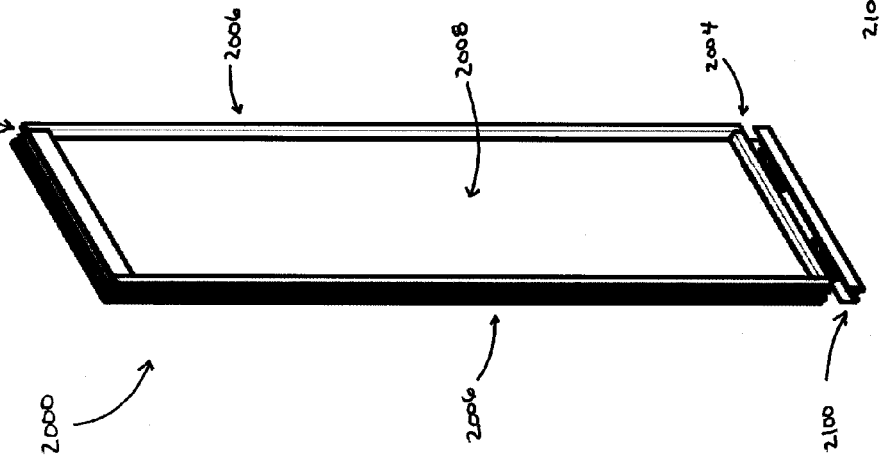

FIG. 178A is a perspective view of a framed wall panel according to certain embodiments.

FIG. 178B is a front view of FIG. 178A.

FIG. 178C is a side view of FIG. 178A.

Figure 179A:
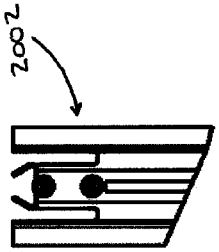

FIG. 179A is an enlarged view of a top portion of what is shown in FIG. 178C.

Figure 179B:
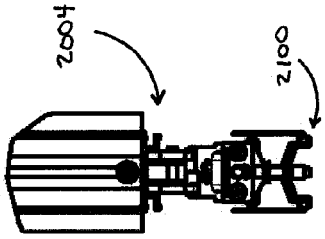

FIG. 179B is an enlarged view of a bottom portion of what is shown in FIG. 178C.

Figure 180C:
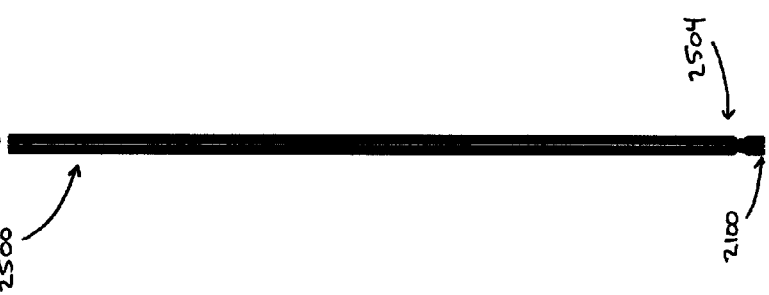
Figure 180B:
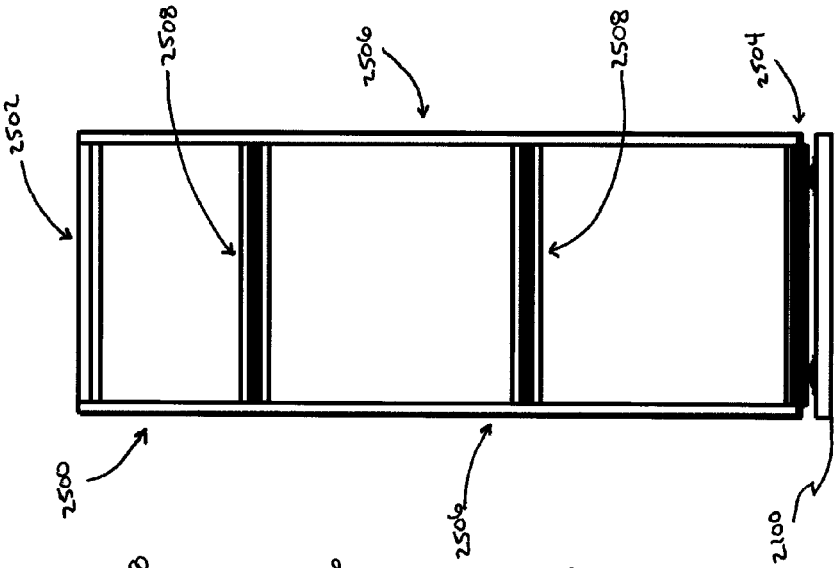
Figure 180A:
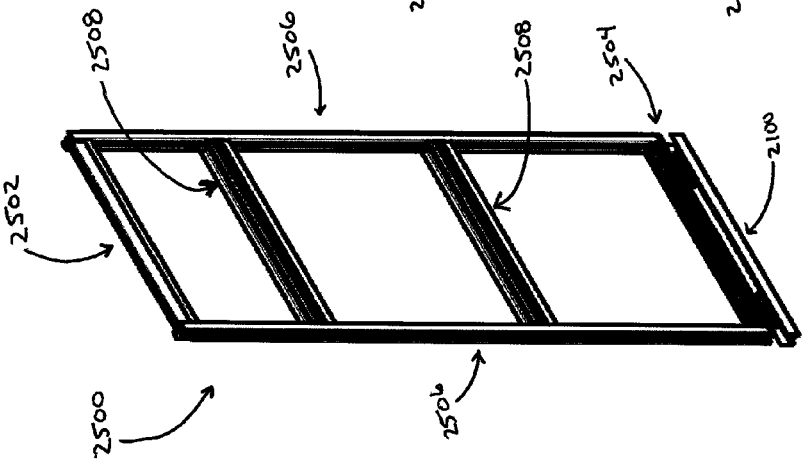

FIG. 180A is a perspective view of a solid wall panel according to certain embodiments.

FIG. 180B is a front view of FIG. 178A.

FIG. 180C is a side view of FIG. 178A.

Figure 181A:
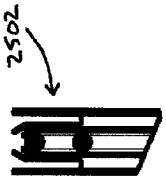

FIG. 181A is an enlarged view of a top portion of what is shown in FIG. 180C.

Figure 181B:
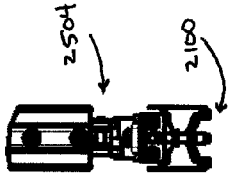

FIG. 181B is an enlarged view of a bottom portion of what is shown in FIG. 180C.

Figure 182:
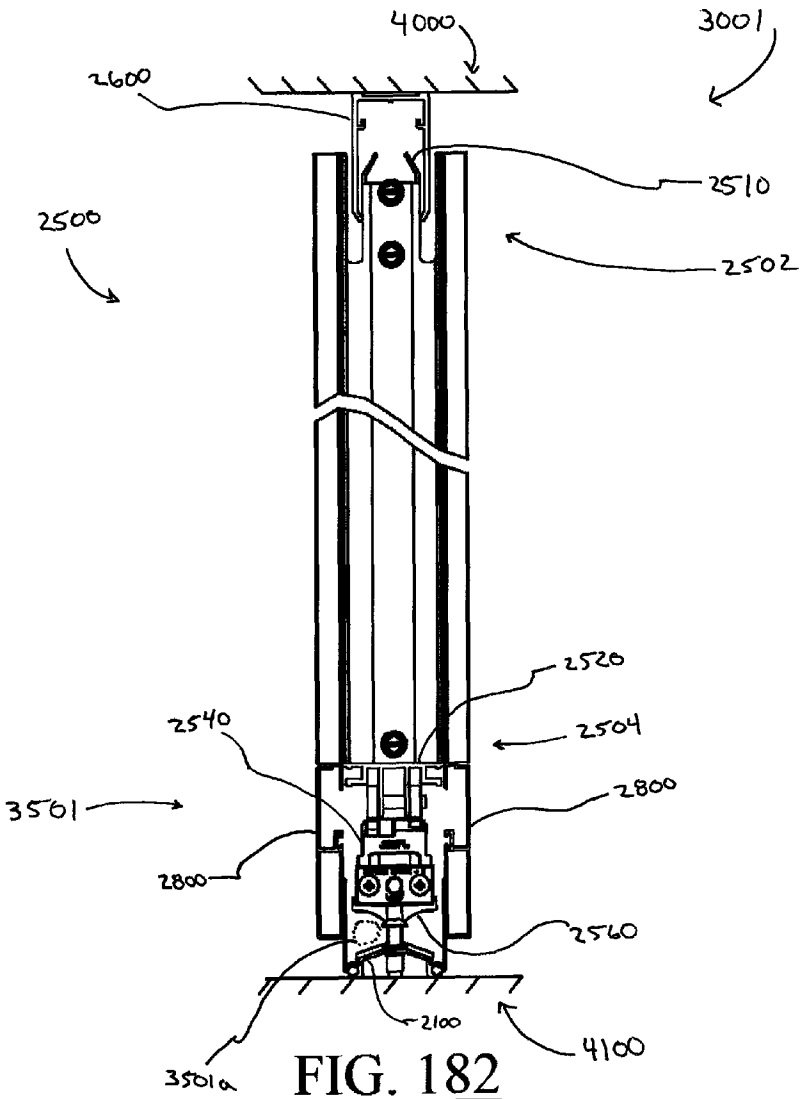

FIG. 182 is a side view of a solid wall panel cooperating with a ceiling rail and operatively mounted to a bottom floor channel.

Figure 183B:
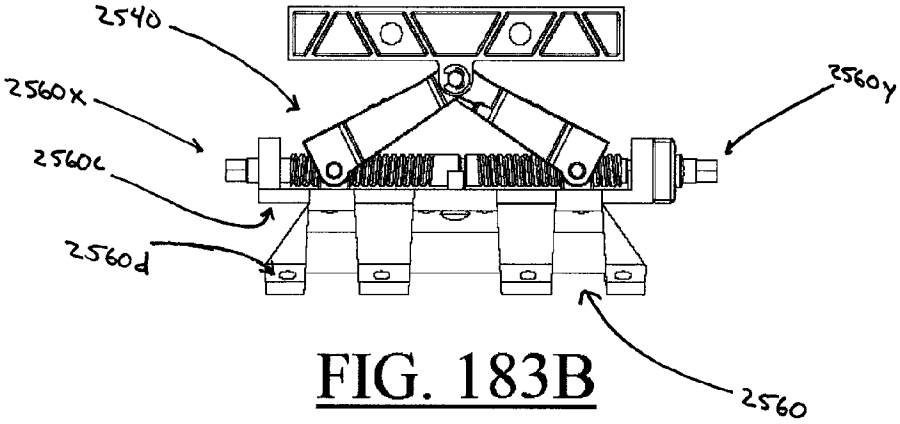
Figure 183A:
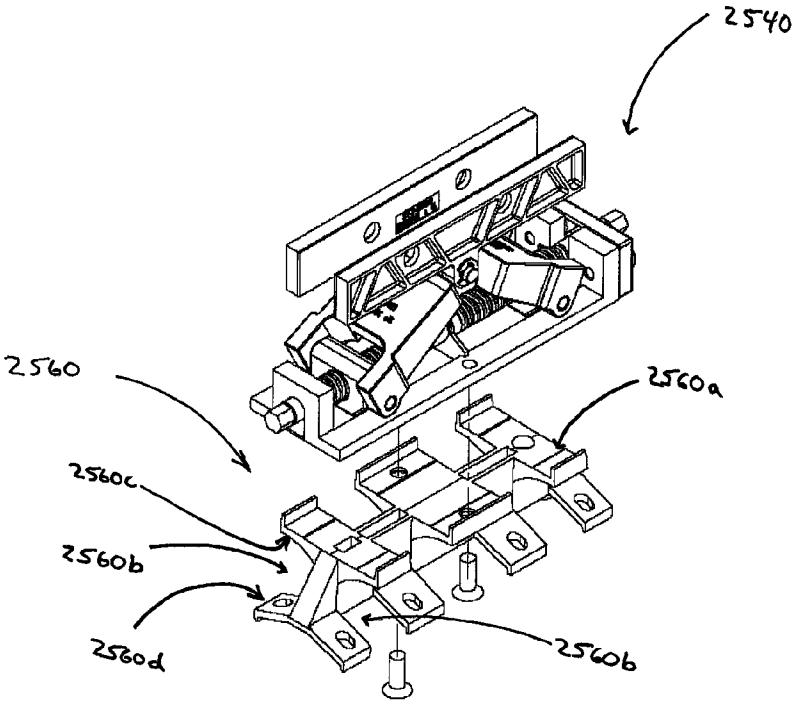

FIG. 183A is a perspective view of a riser support structure and a height adjustment assembly.

FIG. 183B is a front view of a height adjustment assembly mounted to a riser support structure.

Figure 184:
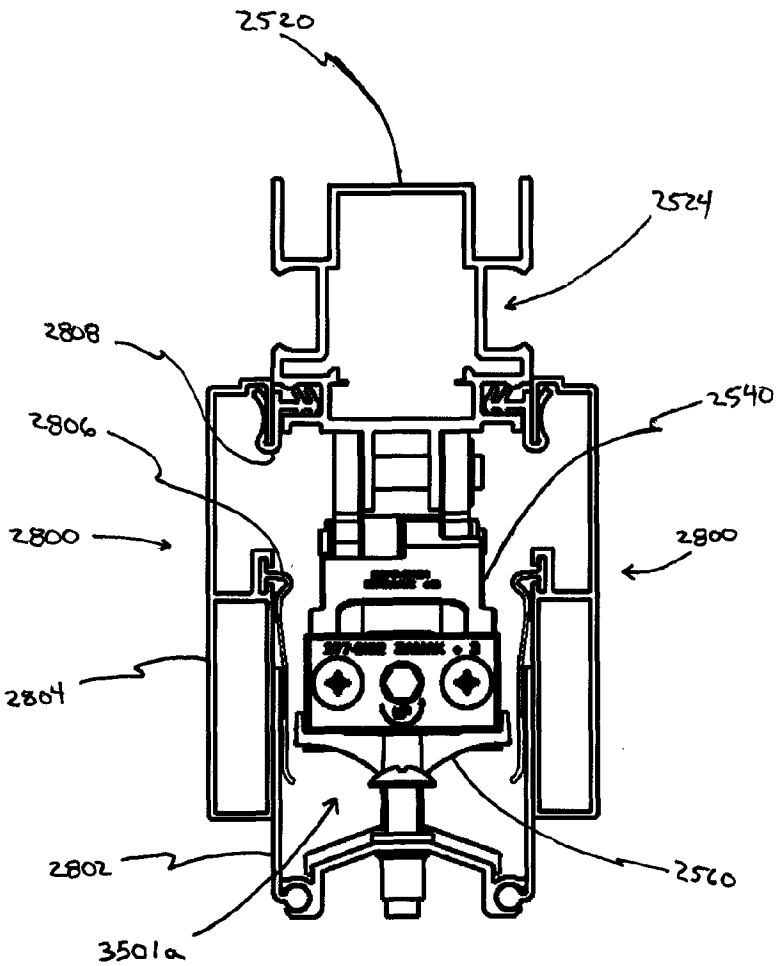

FIG. 184 is an enlarged view of a bottom portion of a solid wall panel according to certain embodiments, including a height adjustment assembly, a solid wall lower support structure, a riser support structure and a lower trim assembly and a floor channel.

Figure 185:
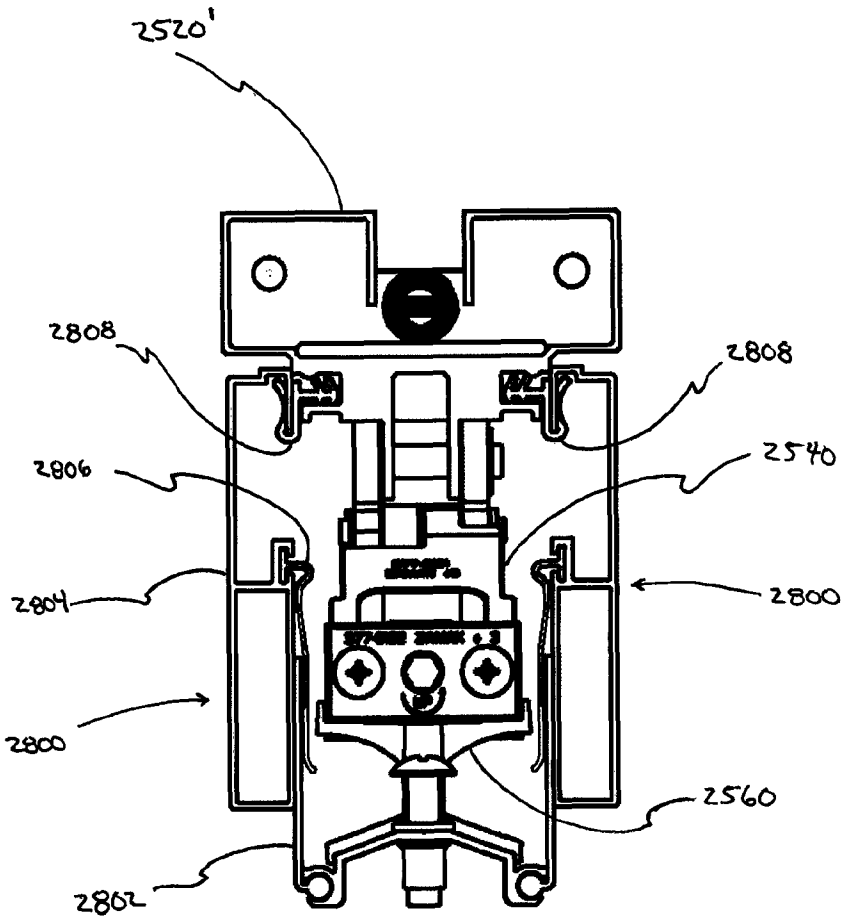

FIG. 185 is an enlarged view of a bottom portion of a framed wall panel according to certain embodiments, including a height adjustment assembly, a solid wall lower support structure, a riser support structure and a lower trim assembly and a floor channel.

Figure 186:
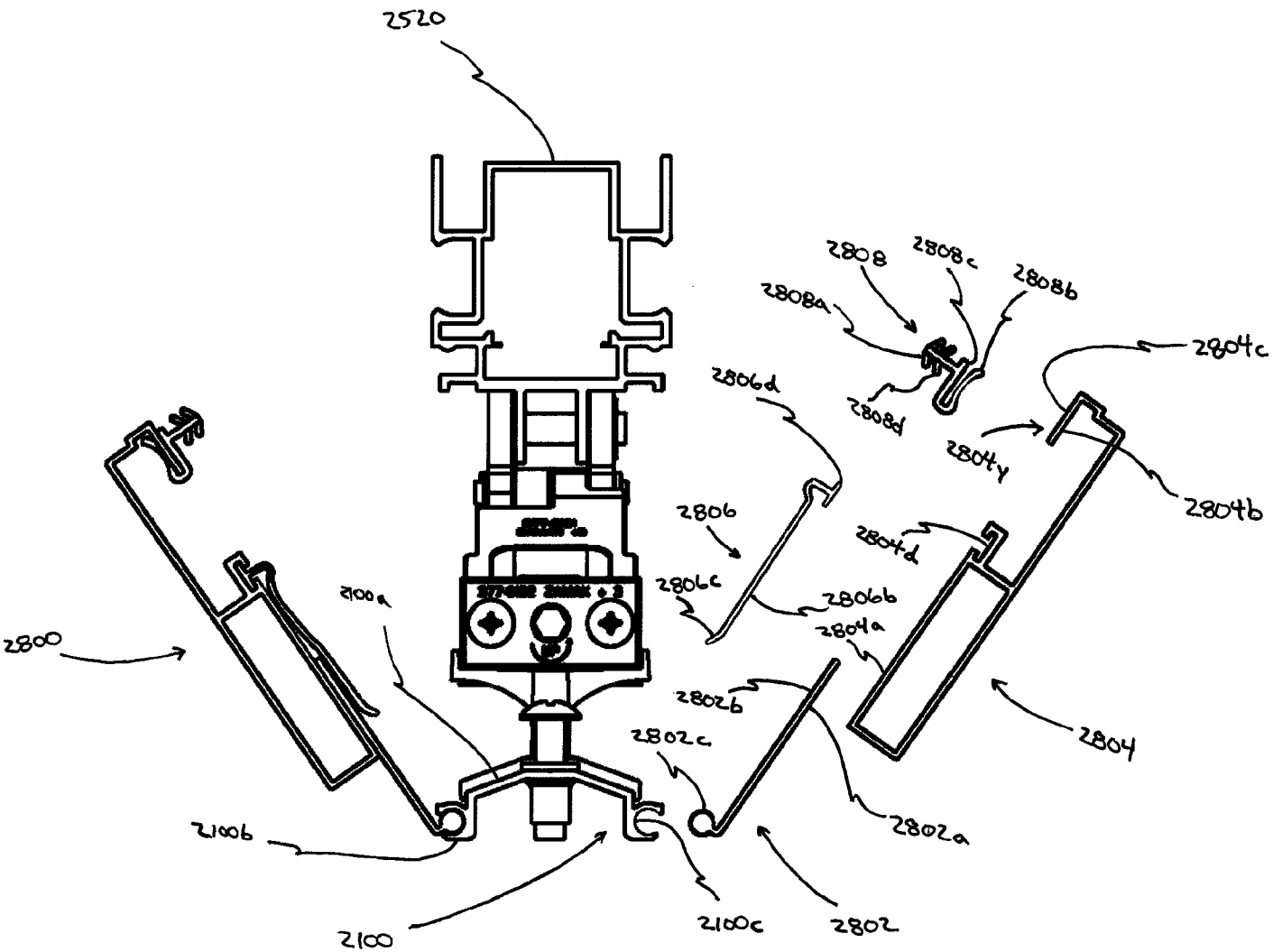
Figure 187A:
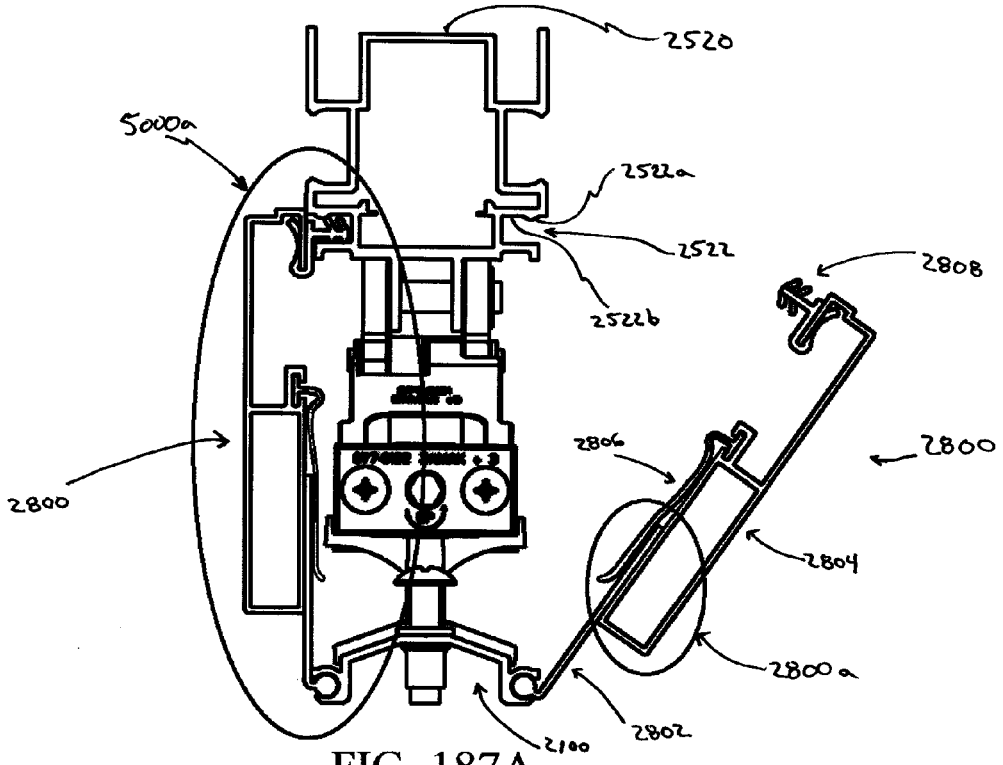

FIG. 186 is an exploded view of the bottom portion of the solid wall panel shown in FIG. 184, wherein a removable trim is shown in an exploded relationship to the framed wall panel FIG. 187A is a detailed view of the bottom portion of the framed wall panel shown in FIG. 184, wherein a lower trim assembly is shown in both a closed state and a pivoted open state.

Figure 187B:
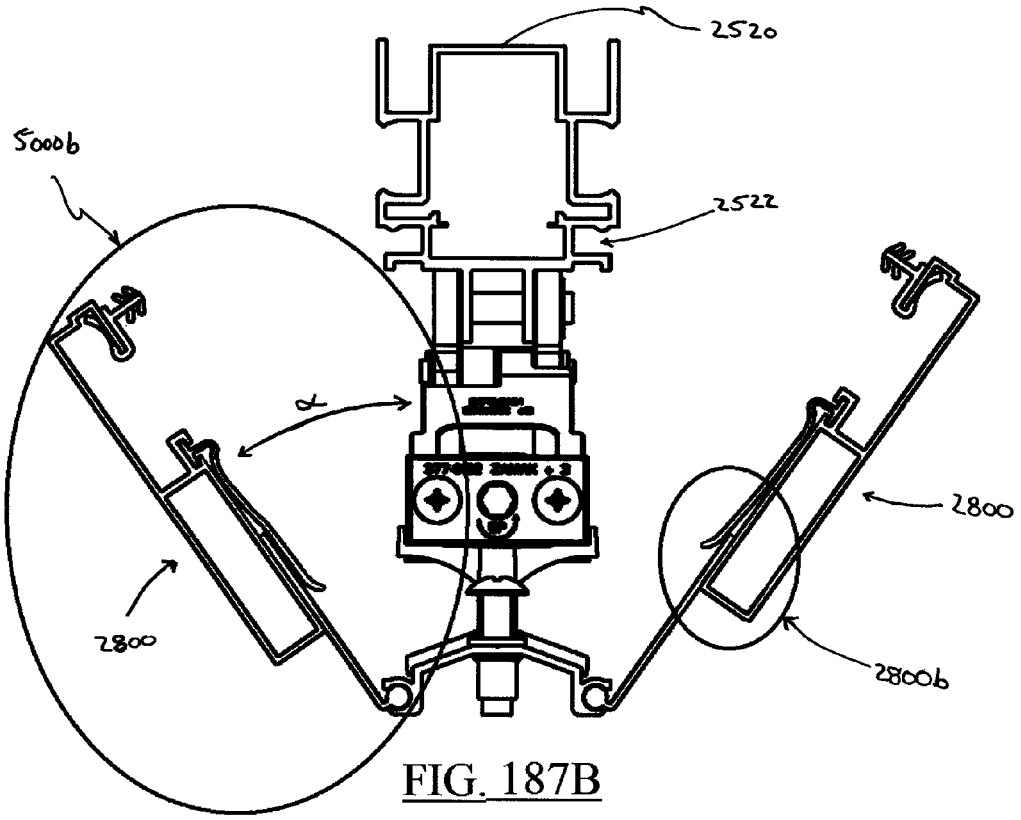

FIG. 187B is a detailed view of the bottom portion of the framed wall panel shown in FIG. 184, wherein a lower trim assembly is shown in a pivoted open state and an extended state.

DETAILED DESCRIPTION

In the following description, the same numerical references refer to similar elements. The embodiments, geometrical configurations, materials mentioned and/or dimensions shown in the figures or described in the present description are illustrative embodiments only, given for exemplification purposes only.

Moreover, although the subject matter as exemplified hereinafter was primarily designed for wall systems intended in work environments, for defining office spaces, etc., it could be used with other objects and for other purposes, as apparent to a person skilled in the art. For this reason, expressions such as "work", "office", "space", "wall", "panel" and any other references and/or other expressions equivalent thereto should not be taken as to limit the scope of the present subject matter and include all other objects and all other applications with which the present subject matter could be used and may be useful.

Moreover, in the context of the present subject matter, the expressions "system", "kit", "set", "assembly", "product" and "device", as well as any other equivalent expressions and/or compounds word thereof known in the art will be used interchangeably, as apparent to a person skilled in the art. This applies also for any other mutually equivalent expressions, such as, for example: a) "mount", "assemble", "define", "build", "erect", etc.; b) "wall", "panel", etc.; c) "office", "work space", "environment", "structure", "enclosure", etc.; d) "rotating", "driving", "displacing", "moving", "supporting", "conveying" etc.; e) "interchangeable", "modular", "progressive", etc.; f) "enable", "allow", "permit", etc.; g) "fastening", "securing", "attaching", "anchoring", "adjusting", "positioning", etc.; h) "hole", "bore", "slot", "slit", "groove", "cavity", etc.; i) "rotating", "pivoting", "turning", "rolling", etc.; j) "ceiling", "upper, "top", etc.; k) "floor", "lower, "bottom", etc.; k) "glass", "laminate", "panel", "gypsum", "board", etc.; l) "positioning", "spacing", "locating", "arranging", "disposing", etc.; m) "adjacent", "neighboring", "sequential", etc.; n) "components", "parts", "elements", etc.; as well as for any other mutually equivalent expressions, pertaining to the aforementioned expressions and/or to any other structural and/or functional aspects of the present subject matter, as also apparent to a person skilled in the art.

Furthermore, in the context of the present description, it will be considered that expressions such as "connected" and "connectable", or "mounted" and "mountable", may be interchangeable, in that the present subject matter also relates to a kit with corresponding components for assembling a resulting fully assembled office space.

Moreover, in the context of the present description, it is also important to make the distinction between a "framed" wall panel which typically consists of a substantially rectangular shape, and comprises opposite top and bottom distance channels, and opposite left and right vertical posts, which make the "frame" of the framed wall panel, and a "frameless" wall panel, which is a wall panel deprived of a full outer frame (e.g. a straightforward glass panel not having a frame around it, etc.), as can be easily understood by a person skilled in the art.

In addition, although one embodiment as illustrated in the accompanying drawings may comprise various components, and although this embodiment of the wall panel system as shown consists of certain geometrical configurations as explained and illustrated herein, not all of these components and geometries are essential and thus should not be taken in their restrictive sense, i.e. should not be taken as to limit the scope of the present subject matter. It is to be understood, as also apparent to a person skilled in the art, that other suitable components and cooperation thereinbetween, as well as other suitable geometrical configurations may be used for the wall panel system and corresponding components according to the present subject matter, as will be briefly explained hereinafter and as can be easily inferred herefrom by a person skilled in the art, without departing from the scope of the present subject matter.

By virtue of its design and its components, the present wall panel system is a moveable non-progressive mountable and demountable wall panel system, particularly well suited for mounting both framed and frameless wall panels, such as framed glass panels, framed solid panels and butt-glazed wall panels, for example, in a very quick, easy and systematic manner, something that is not possible with conventional wall panel systems.

Figure 1:
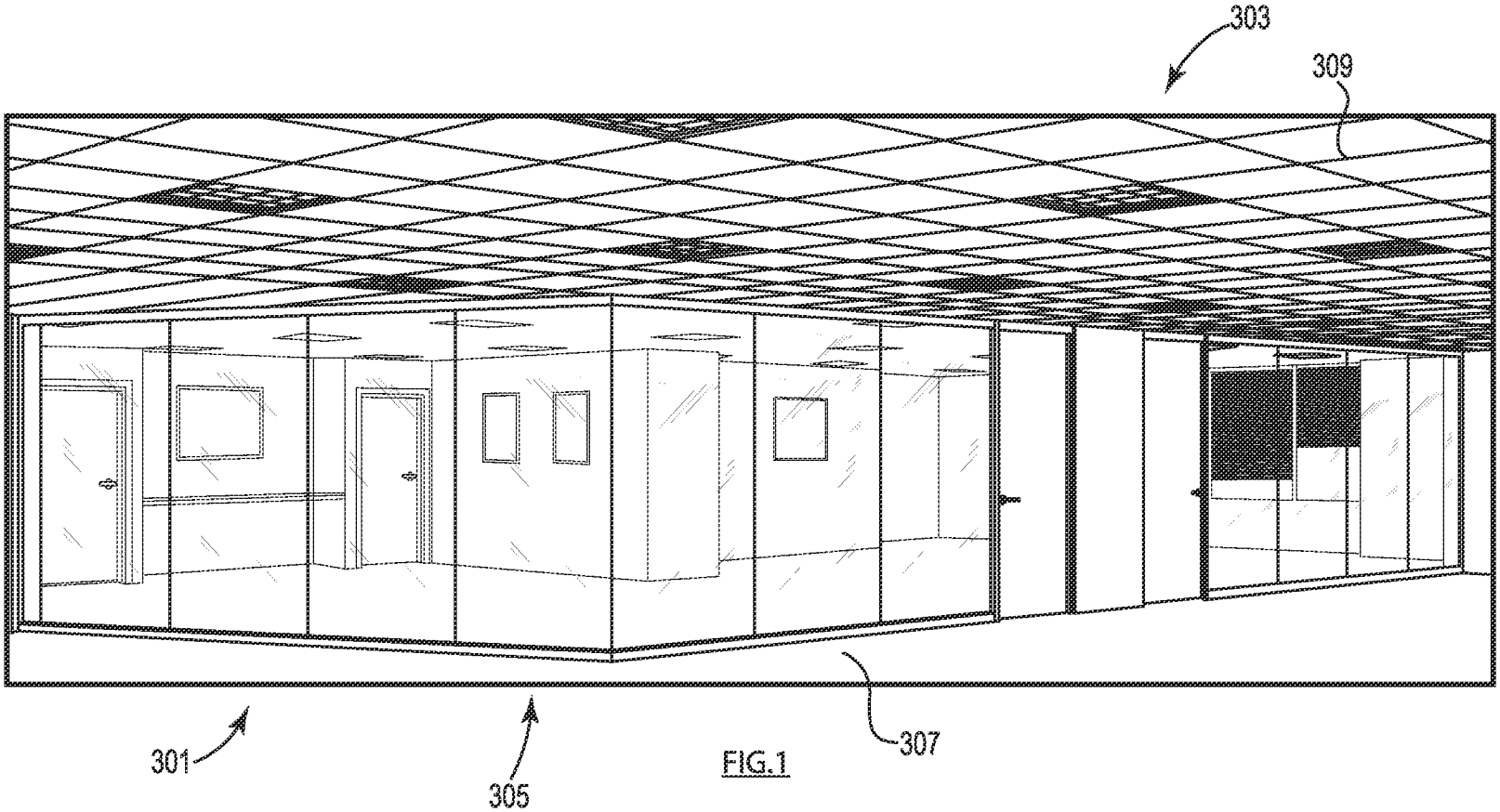
FIG. 1 is a perspective view of an office space assembly having been assembled with a wall panel system according to one embodiment, the office space assembly being shown with butt-glazed wall panels and a pair of corresponding doors.
Figure 18:
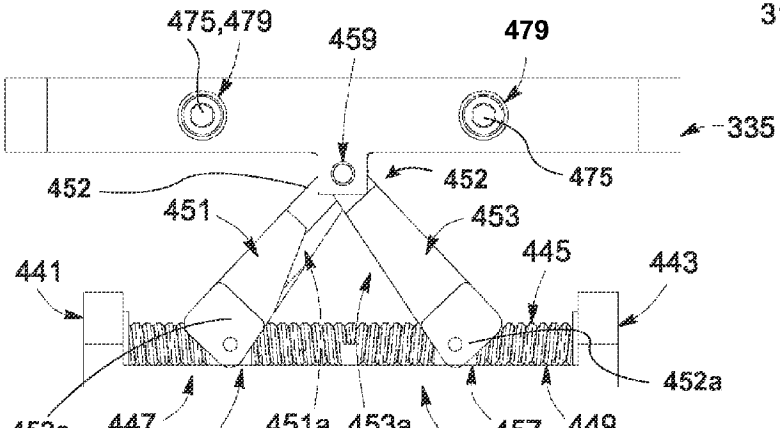
FIG. 18 is a side elevational view of what is shown in FIG. 17.
Figure 21:
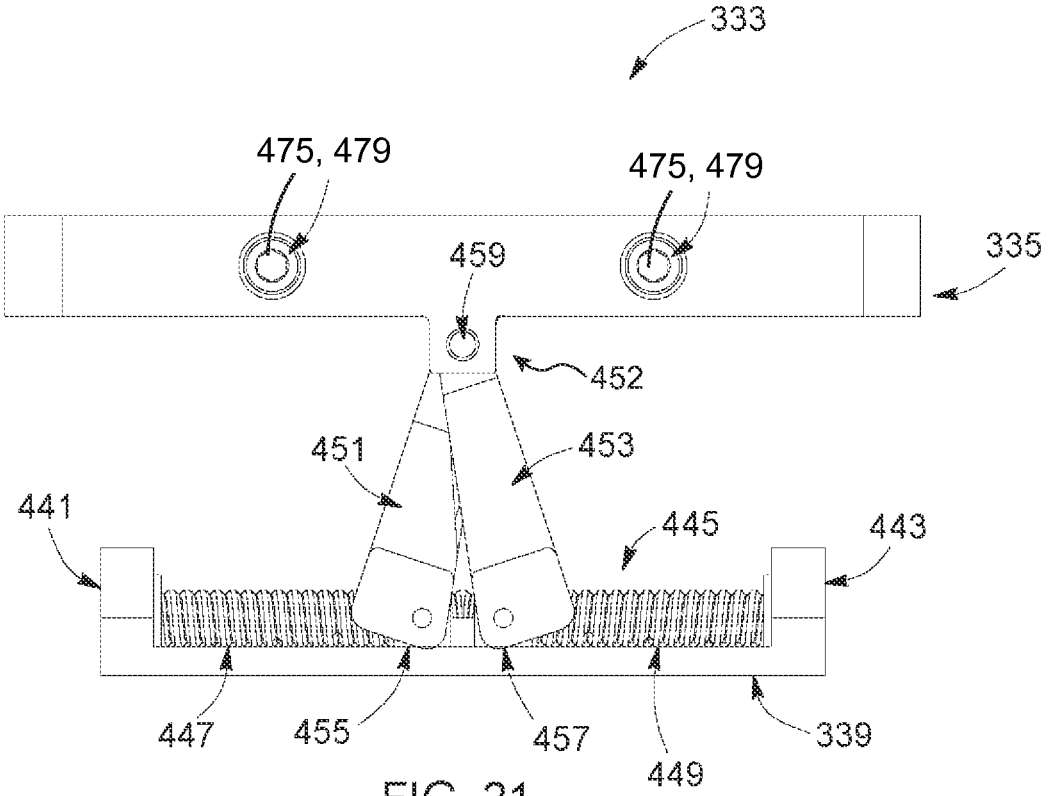
FIG. 21 is another side elevational view of what is shown in FIG. 18, the height adjustment assembly being now shown in a raised configuration.

Broadly described, the wall panel system (301) according to one embodiment, as illustrated in the accompanying drawings, is a moveable and demountable wall panel system (301) for defining an office space (303) with a plurality of wall panels (305) disposable in a substantially upright manner between a floor (307) and a ceiling (309) each having respectively a series of uppermost and lowermost deviations, each wall panel (305) having a vertical axis (311) and a horizontal axis (313), and comprising:

at least one prefabricated frameless panel (315), each panel (315) having a given height (317) defined between top and bottom edges (319,321), and a given width (323) defined between left and right side edges (325*a*,325*b*), a pair of top clamp assemblies (326) secured to the top edge (319) of each panel (305) such that the top edge (310) is provided with a ceiling track (327) configured for being removably insertable into a corresponding ceiling rail (329) extending along the ceiling (309) and delimiting the office space (303);

a bottom floor channel (331) associated with each corresponding panel (315) and being configured for operatively resting against the floor (307) opposite to the ceiling rail (329) extending along the ceiling (309);

integrated first and second power-drivable height adjustment assemblies (333) associated with each panel (315) and insertable into a corresponding bottom floor channel (331), each height adjustment assembly (333) comprising a support edge (335) for operatively supporting a bottom portion of each panel (315), each height adjustment assembly (333) being selectively operable as to be adjustably raised or lowered, thereby allowing a vertical height adjustment of each panel (315) and a rotational angle adjustment thereof by virtue of a pivot axis (459), as illustrated for example in FIG. 18; and at least one connecting plate (337) for removably connecting a pair of bottom floor channels (331), each connecting plate (337) and bottom floor channel (331) being positioned, shaped and sized with respect to one another for ensuring that the side edges (325) of a pair of neighboring prefabricated frameless panels (315) cooperate with one another in order to define the office space (303). An example of a resulting office space (303) is shown in FIG. 1.

In one embodiment, and as better shown in FIGS. 2-27, each height adjustment assembly (333) may comprise a scissors-type height adjustment mechanism including: a) a base (339); b) opposite first and second end caps (441,443) projecting from the base (339); c) a height adjusting rod (445) being rotatively mounted about the end caps (441, 443), the height adjusting rod (445) having first and second threaded segments (447,449) each being oppositely threaded with respect to one another; and d) first and second adjustment legs (451,453), the first adjustment leg (451) having a first extremity (452*a*) pivotably mounted onto a runner component (455) threadedly engaged onto the first threaded segment (447) of the height adjusting rod (445) and a second extremity (452) pivotably mounted onto the support edge (335), and the second adjustment leg (453) having a first extremity (452*a*) pivotably mounted onto a runner component (457) threadedly engaged onto the second threaded segment (449) of the height adjusting rod (445) and a second extremity (452) pivotably mounted onto the support edge (335), such that a rotation of the common height adjusting rod (445) along a first direction causes a raising of the support edge (335), and a rotation of the common height adjusting rod (445) along a second and opposite direction causes a lowering of the support edge (335).

Preferably, the second extremities 452 of the first and second adjustment legs (451,453) are pivotably mounted onto a bottom portion of the support edge (335) about a common pivot axis (459), as better shown in FIGS. 17, 18, 21 and 22.

Figure 17:
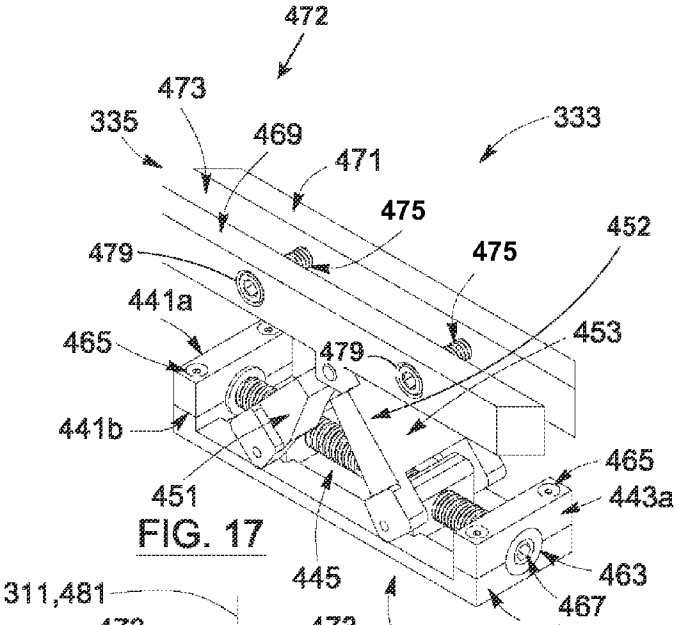
FIG. 17 is a perspective view of a height adjustment assembly according to one embodiment.
Figure 22:
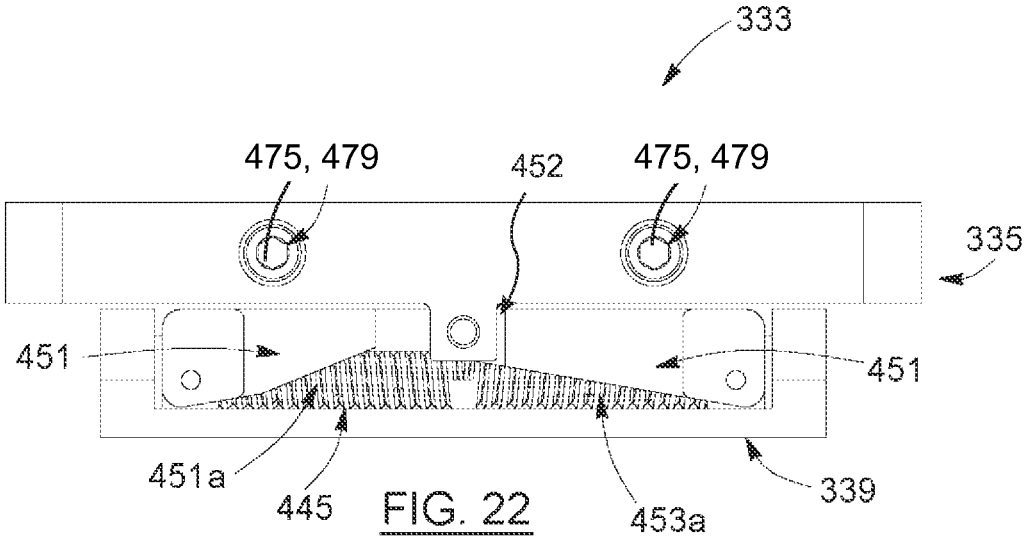
FIG. 22 is another side elevational view of what is shown in FIG. 21, the height adjustment assembly being now shown in a lowered configuration.
Figure 23:
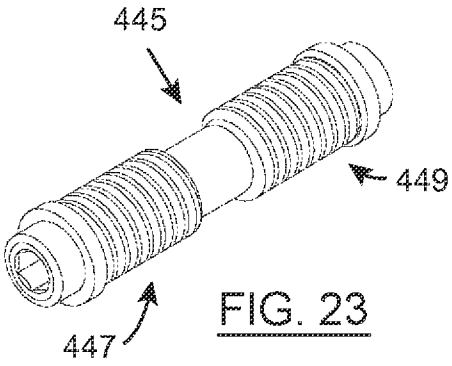
FIG. 23 is a perspective view of a height adjusting rod provided with a pair of distal bushings according to one embodiment.
Figure 25:
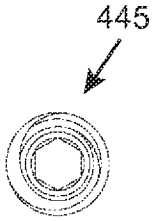
FIG. 25 is a front plan view of what is shown in FIG. 24.
Figure 27:
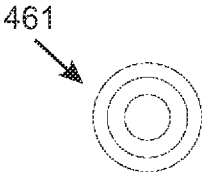
FIG. 27 is a rear elevational view of what is shown in FIG. 26.
Figure 24:
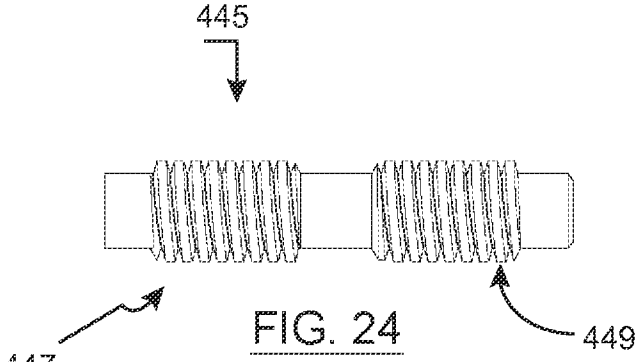
FIG. 24 is a side elevational view of the height adjusting rod shown in FIG. 23.
Figure 26:
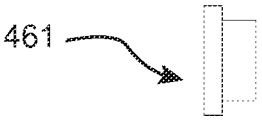
FIG. 26 is a side elevational view of one of the bushings shown in FIG. 23.
Figure 28:
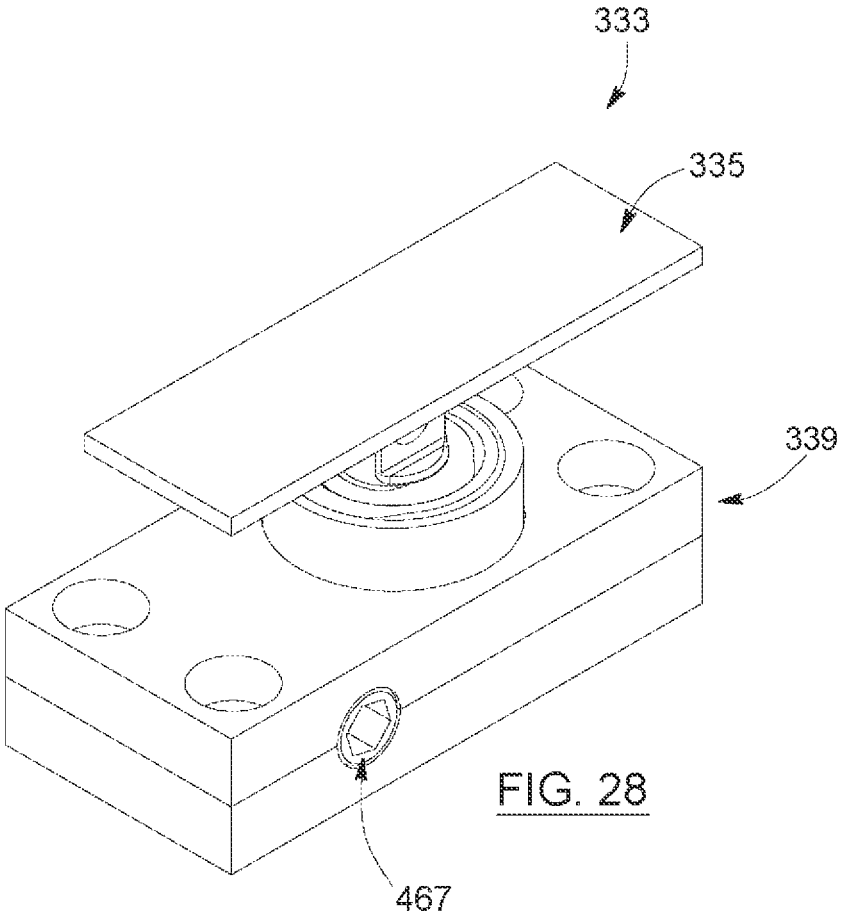
FIG. 28 is a perspective view of a height adjustment assembly according to another embodiment, the height adjustment assembly being shown in a lowered configuration.
Figure 29:
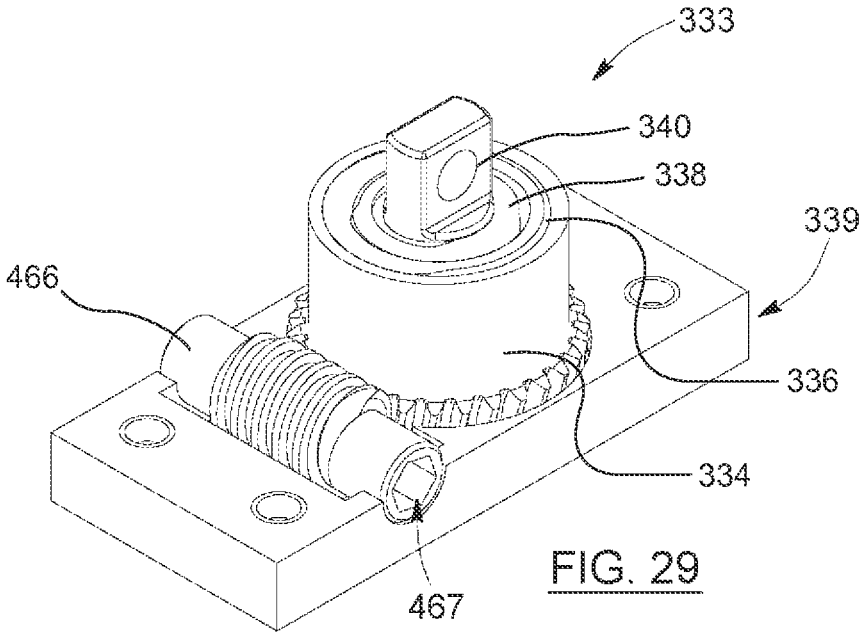
FIG. 29 is another perspective view of what is shown in FIG. 28, the height adjustment assembly being now shown with certain parts having been removed so as to better illustrate inner components of the height adjustment assembly.
Figure 30:
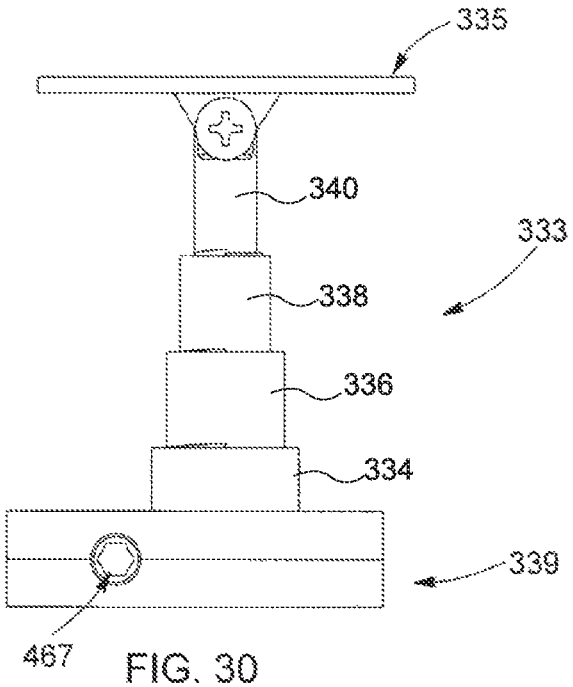
FIG. 30 is a side elevational view of what is shown in FIG. 28, the height adjustment assembly being now shown in a raised configuration.
Figure 31:
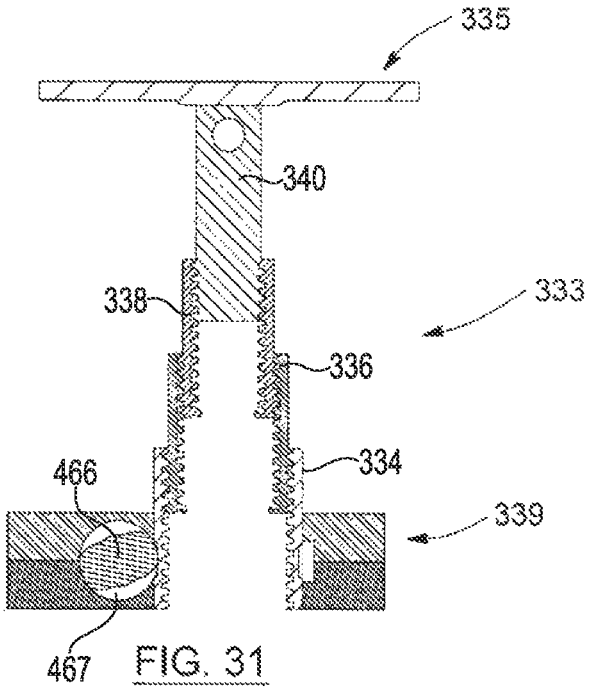
FIG. 31 is a cross-sectional view of what is shown in FIG. 30.
Figure 32:
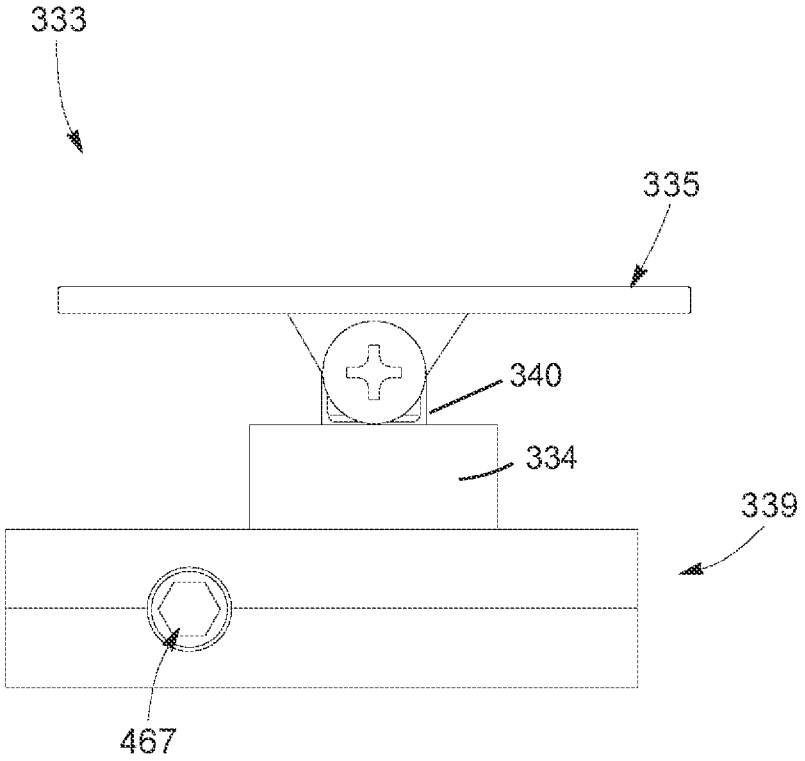
FIG. 32 is another side elevational view of what is shown in FIG. 30, the height adjustment assembly being now shown in a lowered configuration.
Figure 33:
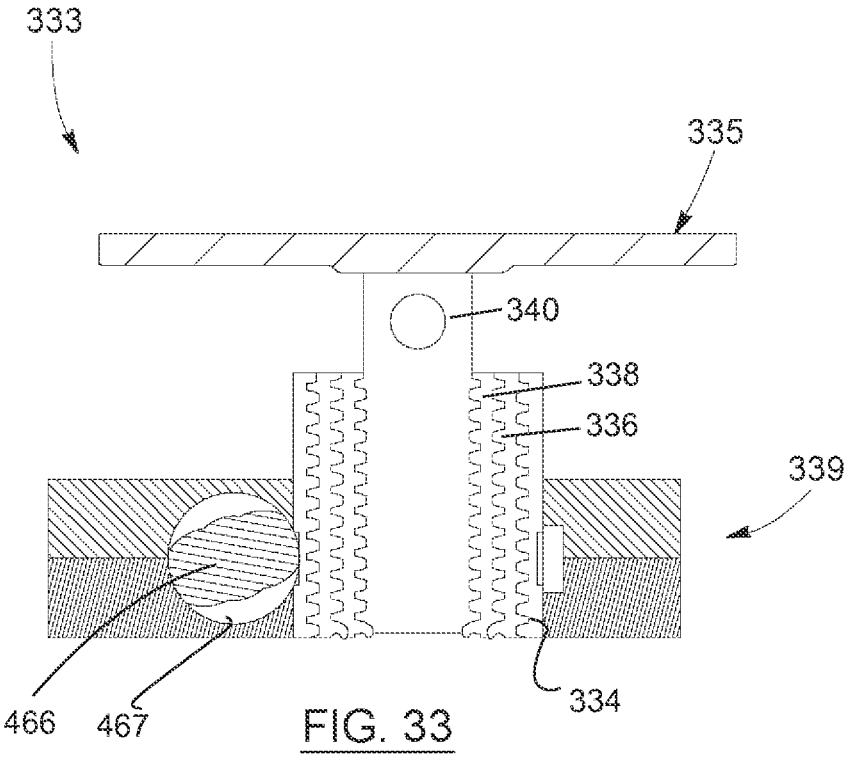
FIG. 33 is a cross-sectional view of what is shown in FIG. 32.
Figure 34:
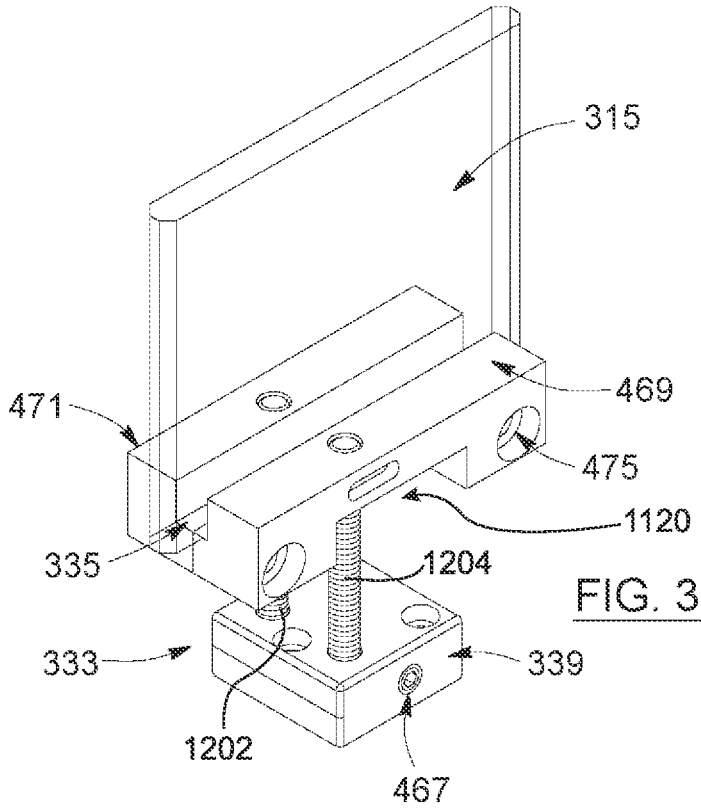
FIG. 34 is a perspective view of a height adjustment assembly according to yet another embodiment.
Figure 35:
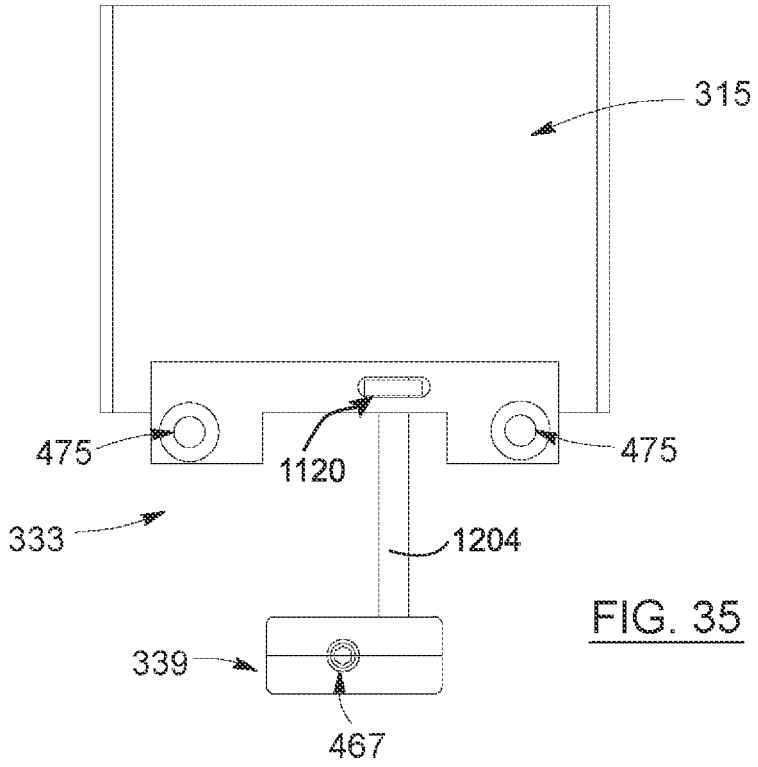
FIG. 35 is a side elevational view of what is shown in FIG. 34.
Figure 41:
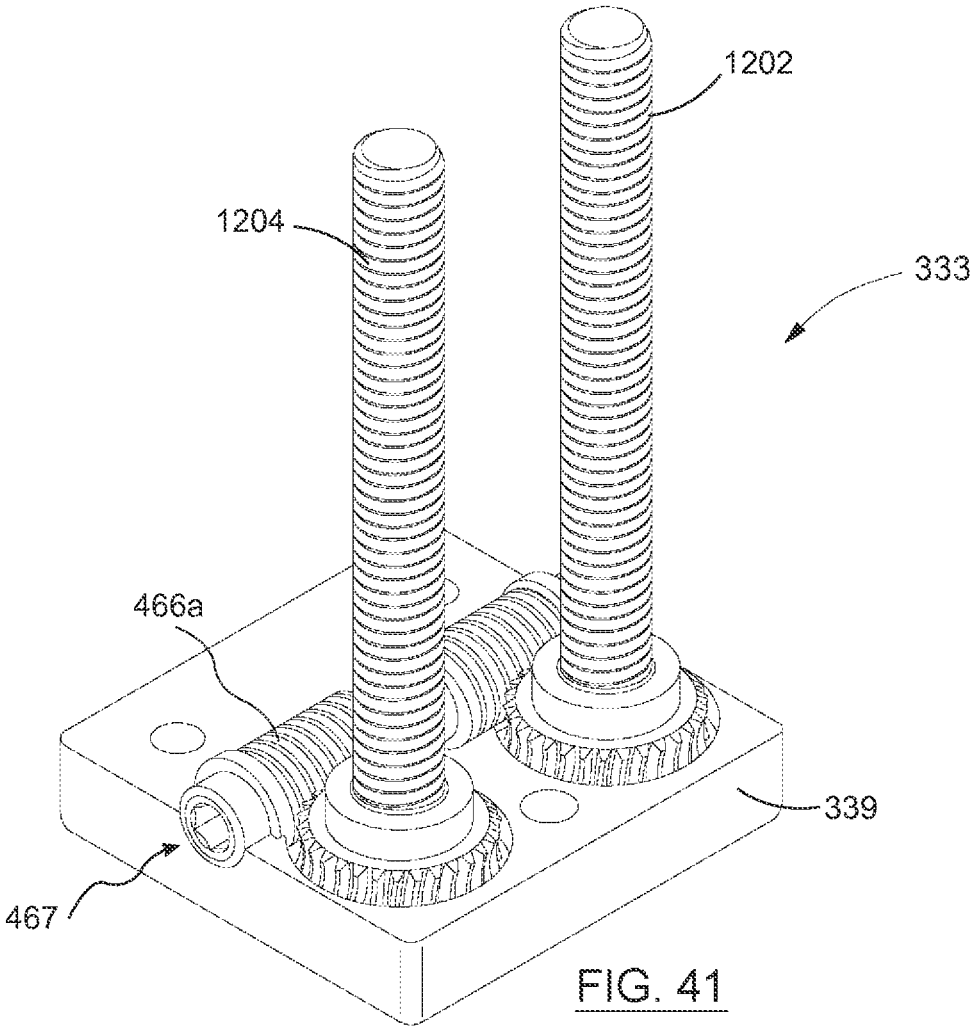
FIG. 41 is a perspective view of a height adjustment assembly according to yet another embodiment, the height adjustment assembly being shown with certain components having been removed therefrom so as to better illustrate inner components of the height adjustment assembly.
Figure 42:
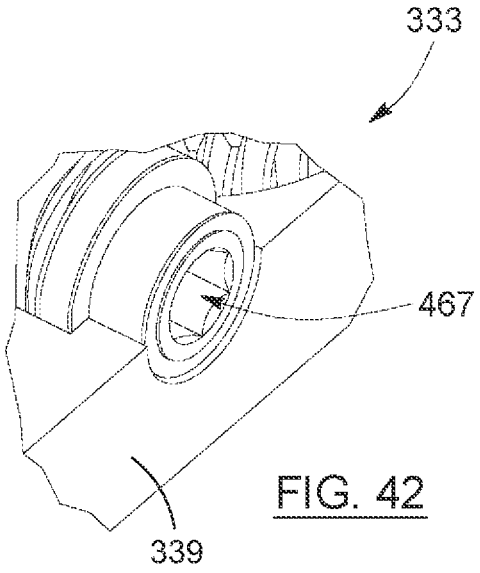
FIG. 42 is an enlarged view of a portion of what is shown in FIG. 41.
Figure 45:
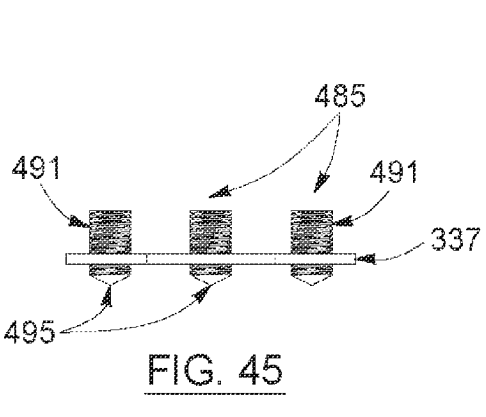
FIG. 45 is a side elevational view of what is shown in FIG. 43.
Figure 44:
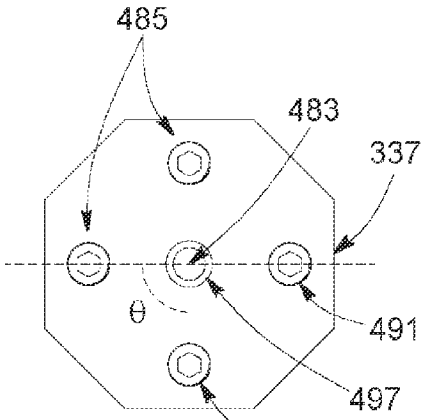
FIG. 44 is a top plan view of what is shown in FIG. 43.
Figure 43:
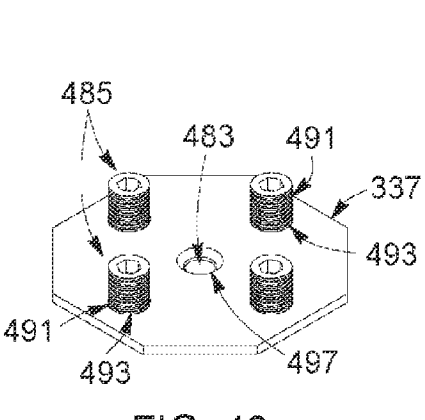
FIG. 43 is a perspective view of a connecting plate provided with four projections and an anchoring hole about the center point according to one embodiment.
Figure 48:
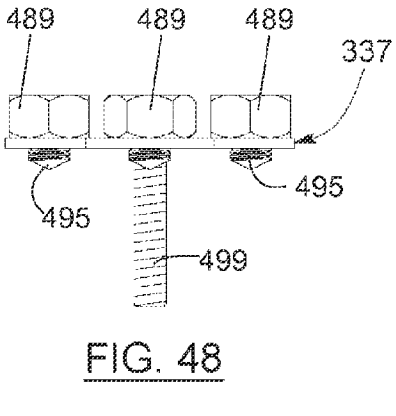
FIG. 48 is a side elevational view of what is shown in FIG. 46.
Figure 47:
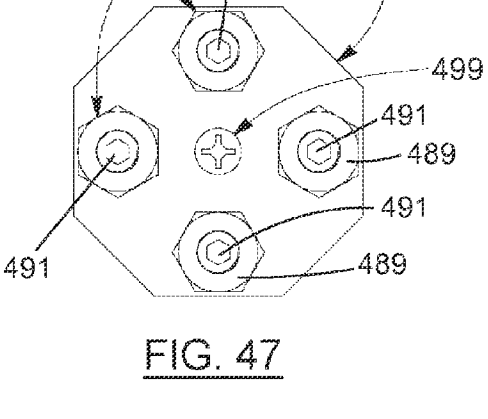
FIG. 47 is a top plan view of what is shown in FIG. 46.
Figure 46:
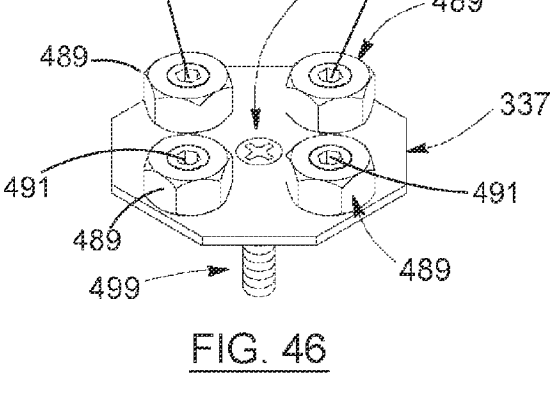
FIG. 46 is another perspective view of what is shown in FIG. 43, the projections of the connecting plate being now provided with corresponding nuts, and the connecting plate being further provided with a threaded anchor extending downwardly from a center point of the connecting plate according to one embodiment.
Figure 52:
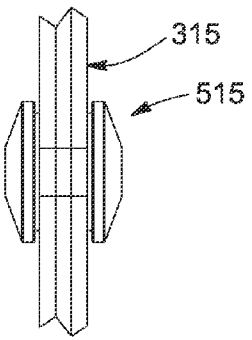
FIG. 52 is an enlarged view of a portion of what is shown in FIG. 50.
Figure 54:
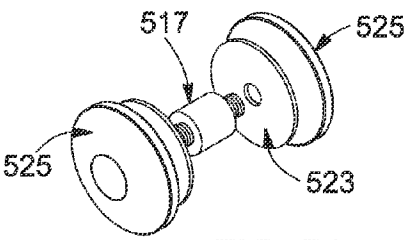
FIG. 54 is an exploded view of the component shown in FIG. 53.
Figure 51:
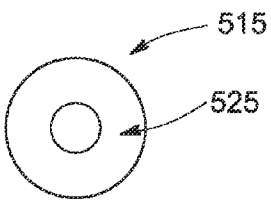
FIG. 51 is an enlarged view of a portion of what is shown in FIG. 49.
Figure 53:
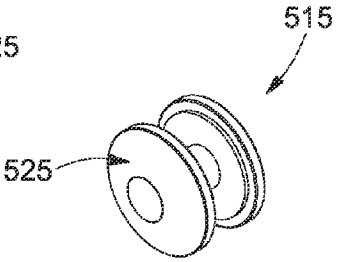
FIG. 53 is a perspective view of a complementary accessory assembly according to one embodiment.

Preferably also, the adjustment legs (451,453) comprise recessed portions (451*a*,453*a*) for avoiding the height adjusting rod (445) when the adjustment legs (451,453) are drawn down into a lowered configuration, as can be easily understood when referring to FIGS. 17, 18 and 22.

The height adjusting rod (445) can be manufactured in a great number of ways, but according to one embodiment, it comprises first and second separate rod components being provided with the first and second threaded segments (447, 449) respectively, the first rod component comprising an extremity with a male component being securely insertable into a female component of a corresponding extremity of the second rod component, as can be easily understood when referring to FIGS. 22-25.

Figure 20:
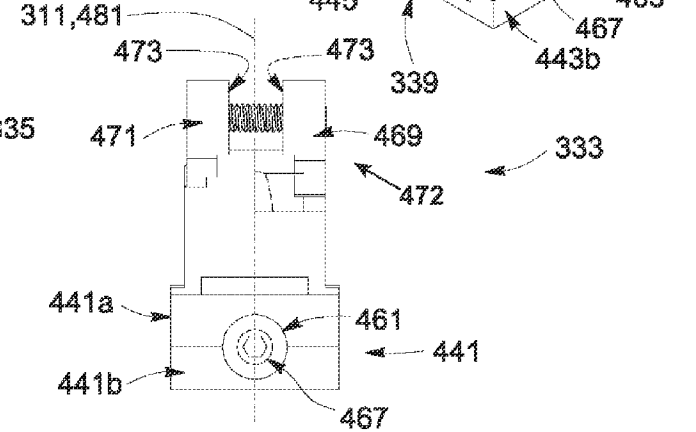
FIG. 20 is a front elevational view of what is shown in FIG. 17.

Referring to FIGS. 17-27, it is shown how the height adjusting rod (445) can be rotatively mounted about first and second bushings (461,463) provided on the first and second end caps (441,443) respectively, although other suitable mounting methods may be used. FIG. 20 provides an illustration of the first bushing (461), for example, while FIG. 17 provides an illustration of the second bushing 461.

According to one embodiment, each end cap (441,443) comprises a first end cap component (441*a*,443*a*) being removably connectable via at least one corresponding fastener (465) onto a second end cap component (441*b*,443*b*) being fixed to the base (339) of the height adjustment assembly (333), as can be easily understood from FIGS. 17 and 20.

As also shown in FIG. 20, at least one distal extremity of the height adjusting rod (445) is provided with a socket (467) for receiving a corresponding insert of a driving tool, but preferably, both extremities of the height adjusting rod (445) are provided with a socket (467) for receiving a corresponding insert of a driving tool, so as to namely enable to operate the height adjustment assembly (333) from both sides thereof.

Preferably, and as can be easily understood from FIGS. 3-22, each socket (467), height adjusting rod (445) and support edge (335) of each height adjustment assembly (333) lie substantially in a same vertical plane, under a corresponding wall panel (305,315).

Figure 19:
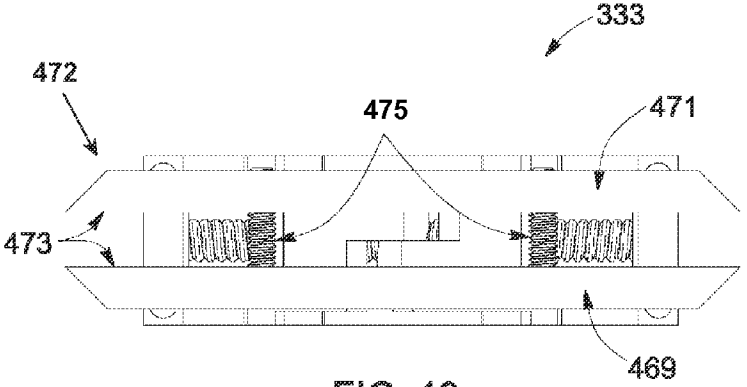
FIG. 19 is a top plan view of what is shown in FIG. 17.

According to one embodiment, and as also shown for example in FIGS. 17 and 19, each height adjustment assembly (333) comprises opposite first and second clamps (469, 471) to define a lower clamp assembly (472) for clamping a bottom portion of a corresponding wall panel (315). Preferably, inner surfaces of the first and second clamps (469, 471) are provided with a gasket at location (473), as can be easily understood when referring to FIGS. 6, 7 and 17. In one such embodiment the lower is clamp assembly operatively coupled to a wall panel, such as a frameless panel, a framed panel or a solid panel. In another embodiment, as discussed in greater detail below, each height adjustment assembly is operatively coupled to a solid wall panel (or alternatively a framed wall panel).

As better shown in FIGS. 17-22, each height adjustment assembly (333) comprises at least one connector (475) extending between the first and second clamps (469,471). Preferably, each connector (475) is a clamp screw being configured with respect to the first and second clamps (469,471) for urging the clamps (469,471) towards one another via a corresponding rotation of the clamp screw. Each connector (475) may be provided with a bushing (479), and in such a case, the bushing is preferably a nylon bushing (479), although other suitable components and materials may be used.

According to one embodiment, the bottom edge of each prefabricated frameless panel (315) is provided with at least one positioning notch (477) for cooperating with a corresponding connector (475), which is part of the clamp assembly (472). Each notch (477) is preferably prefabricated onto each panel (315) in a precise manner using an appropriate method. While the notch(es) (477) are not visible, for example, in FIGS. 7 and 9, an embodiment of the notch (477) can be seen in FIG. 150. Among other advantages, the presence of such positioning notches (477) enable to easily and precisely place each panel (315) onto a corresponding pair of height adjustment assemblies (333), as can be easily understood when referring to FIGS. 7 and 9, for example. In this regard, each height adjustment assembly (333) is preferably made symmetrical along a longitudinal axis (481) thereof.

According to another embodiment, each height adjustment assembly (333) is a power-drivable height adjustment assembly (333) being selectively adjustable via a power drill through a corresponding socket (467) of the height adjustment assembly (333). The socket (467) of the height adjustment assembly (333) may extend in a substantially parallel relationship with respect to the support edge (335) thereof, as explained earlier, and as exemplified in FIGS. 17-22. Alternatively, the socket (467) of the height adjustment assembly (333) may extend in a substantially traverse relationship with respect to the support edge (335) thereof.

Obviously, various other types of suitable height adjustment assemblies (333) and cooperations with remaining components of the present wall panel system (301) may be used, as apparent to a person skilled in the art. As way of an example, reference is made to FIGS. 28-33, among various alternatives, there is shown a telescopic height adjustment assembly (333) including a telescoping screw-type height adjustment mechanism the adjustment mechanism including a first substantially vertical member (334) that is cylindrical in shape and has inner threads and outer threads, a second substantially vertical member (336) that is cylindrical in shape and has inner and outer threads, and a third substantially vertical member (338) that is cylindrical in shape and has inner and outer threads. The third vertical member (338) is telescopically received in the second vertical member (336) and the second vertical member (336) is telescopically received in the first vertical member (334). If desired, greater or fewer telescoping members (e.g., a fourth vertical member (340) telescopically received in the third vertical member 338) are provided. Actuation of the adjustment mechanism (e.g., using a worm gear) includes rotating the first, second, and third members (334,336,338) relative to one another to telescopically extend the third member (338) from the second member (336) and the second member (336) from the first member (334).

In other embodiments, as shown in FIGS. 34-42, the system (301) includes a double-shaft height adjustment assembly (333) including a screw-type height adjustment mechanism. As illustrated, the double-shaft height adjustment assembly (333) includes a first vertical shaft 1202 extending upwards from a base 339 and a second vertical shaft 1204 extending upwards from a base 339. The first vertical shaft 1202 and the second vertical shaft may be rotated by rotating the worm gear 467. The first vertical shaft 1202 can engage a first nut 1120*a*, which is disposed within the second clamp 471 while the second vertical shaft 1204 can engage a second nut 1120, which is disposed within the first clamp 469. As seen, the nuts 1120, 1120*a* are disposed against rotation within the first clamp 469 and the second clamp 471, respectively, and thus rotation of the first and second vertical shafts 1202, 1204 can cause the clamps 469, 471 to move vertically in response to rotation of the worm gear 467.

To facilitate and expedite installation, each wall panel, such as prefabricated frameless panel (315), each bottom floor channel (331) and each height adjustment assembly (333) associated with each wall panel (305) are delivered on site in a "pre-assembled" manner prior to the on-site assembling of the wall panels (305,315) to define the office space (303). It should be appreciated that, according to some embodiments, each wall panel, such as prefabricated frameless panel (315) is further pre-assembled with each top clamp assembly (326), and each ceiling track (327) associated with each wall panel (305) in a "pre-assembled" manner. In other words, wall panels (305) are provided on site for installation with the bottom floor channels (331), height adjustment assemblies (333), top clamp assemblies (326), and ceiling tracks (327) pre-attached, or otherwise pre-assembled thereto.

According to another embodiment, and as better shown in FIGS. 43-48, each connecting plate (337) is a non-invasive connecting plate (337) having a center point (483). By "non-invasive", it is meant that the connecting plate (337) need not be anchored (penetrated, nailed, screwed, etc.) onto the floor, except in areas subject to earthquakes, in which case, legislation may require a corresponding anchoring to the floor, that is why the present connecting plate (337) may also come in a "seismic" version, as explained hereinbelow.

Figures 6, 7, 8:
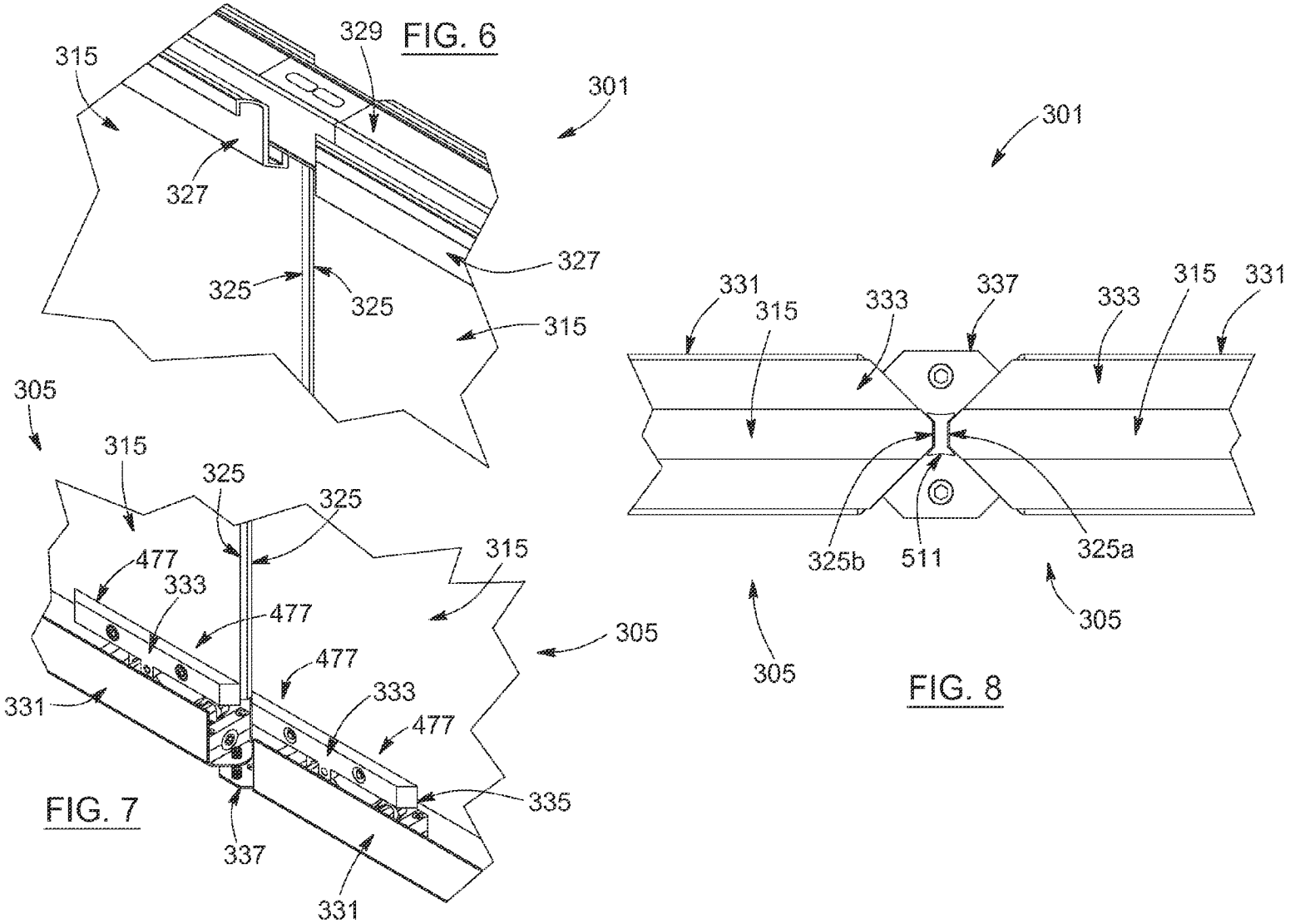
FIG. 6 is a partial top perspective view of an assembly of a pair of butt-glazed wall panels disposed along a 180°-angle connection according to one embodiment, the assembly being shown without a ceiling cover so as to better illustrate the ceiling track of each wall panel.
FIG. 7 is a partial bottom perspective view of an assembly of a pair of butt-glazed wall panels disposed along a 180°-angle connection according to one embodiment, the assembly being shown without a bottom cover so as to better illustrate the bottom channel and height adjustment assemblies of each wall panel, as well as the connecting plate interconnecting extremities of a pair of bottom channels according to one embodiment.
FIG. 8 is a cross-sectional view taken along a given segment of what is shown in FIG. 7.
Figure 10:
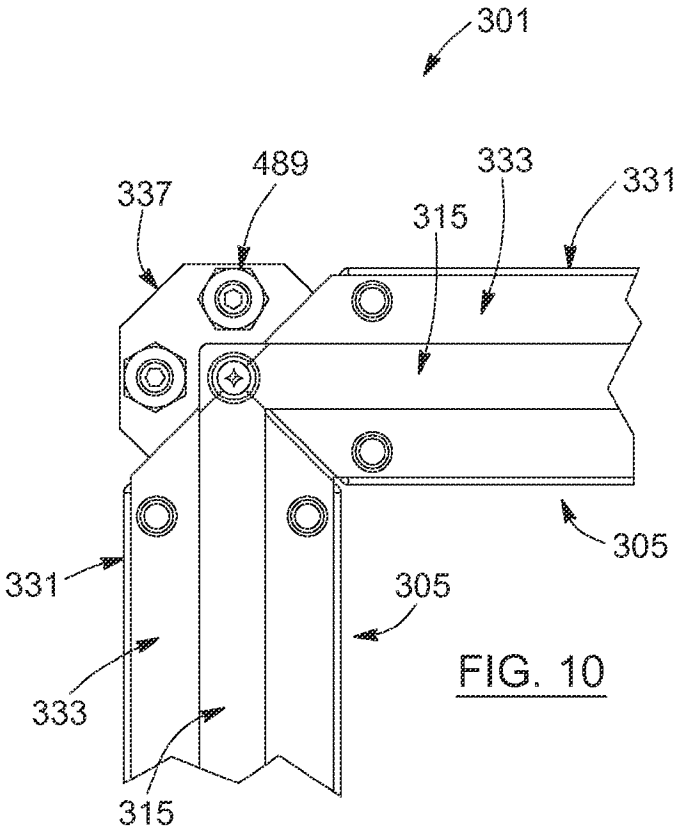
FIG. 10 is a cross-sectional view taken along a given segment of what is shown in FIG. 9.
Figure 9:
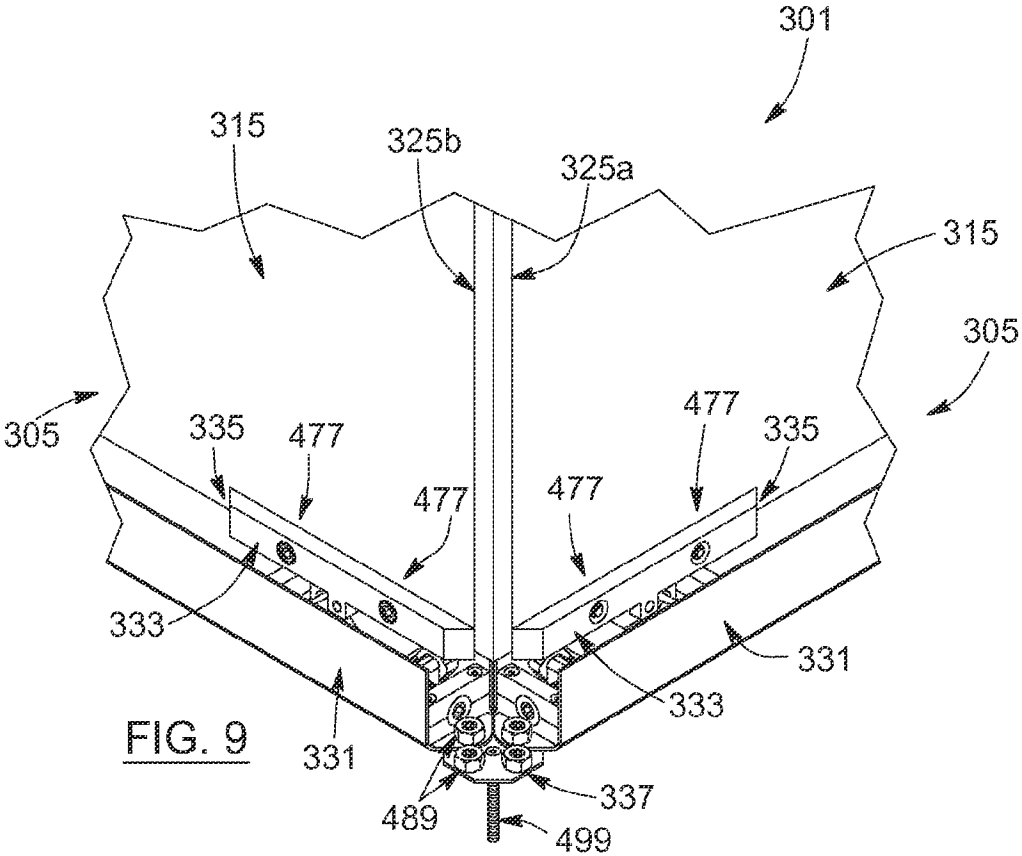
FIG. 9 is a partial bottom perspective view of an assembly of a pair of butt-glazed wall panels disposed along a 90°-angle connection according to one embodiment, the assembly being shown without bottom covers so as to better illustrate the bottom channel and height adjustment assemblies of each wall panel, as well as the connecting plate interconnecting extremities of a pair of bottom channels according to one embodiment.
Figure 13:
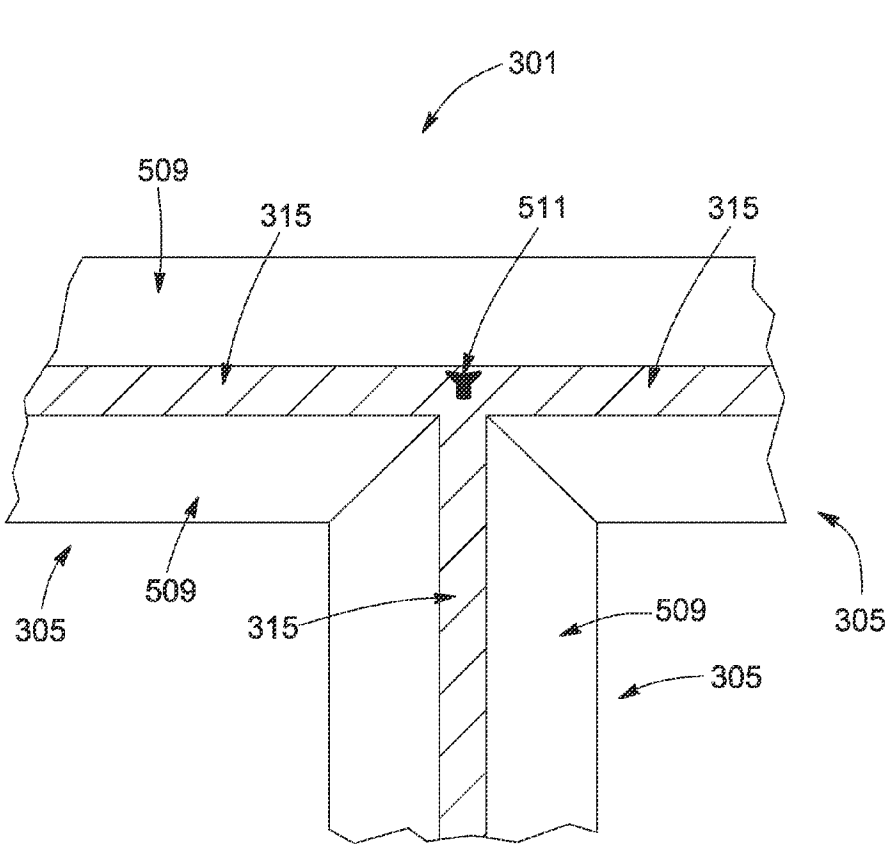
FIG. 13 is a cross-sectional view taken along a given segment of what is shown in FIG. 12.

Preferably, each connecting plate (337) comprises a plurality of projections (485) disposed about the center point (483), each projection (485) being positioned, shaped and sized for receiving a corresponding positioning hole of a neighboring bottom floor channel (331) of the wall panel system (301), the positioning between a pair of adjacent projections (485) being configured so as to ensure proper positioning between adjacent wall panels (305,315) of the system when corresponding bottom floor channels (331) are connected to one another via a same connecting plate (337), as can be easily understood when referring to FIGS. 7 and 9, for example.

As better shown in FIGS. 43-48, each projection (485) is preferably a threaded projection configured for receiving a corresponding nut (489) for removably securing an adjacent bottom floor channel (331) against the connecting plate (337). The radial angle (θ) originating from the center point (483) of the connecting plate (337) and extending between a pair of adjacent projections (485) is substantially the same throughout the connecting plate (337). In the case where the connecting plate (337) comprises first and second projections (485), the radial angle (θ) between adjacent projections (485) is about 180°. In the case where the connecting plate (337) further comprises third and fourth projections (485), and the radial angle (θ) between adjacent projections is about 90°.

When the present wall panel system (301) is used on a carpeted floor, each connecting plate (337) is preferably a carpet gripper. Preferably also, each projection (485) comprises a setscrew (491) threadedly engageable into a corresponding hole (493) of the connecting plate (337), and each setscrew (491) preferably further comprises a pointed tip (495) for inserting between fibers of a corresponding carpet of the floor (307), so as to avoid damaging or leaving marks on the carpet, as can be easily understood by a person skilled in the art.

In the case connecting plate (337) is intended to be used as a seismic connecting plate (337), the seismic connecting plate (337) preferably comprises an anchoring hole (497) disposed about the center point (483) for receiving therein a threaded anchor (499) or other suitable component configured for extending downwardly and anchoring the seismic connecting plate (337) onto the floor (307).

As shown in FIGS. 43-48, each connecting plate (337) preferably has a substantially octagonal shape, although other suitable shapes and forms may be used depending on the particular applications for which the present wall panel system (301) is used, and the desired end results, as can be easily understood by a person skilled in the art.

As exemplified in the various accompanying drawings, the wall panel (305,315) comprises a ceiling rail (329) associated with each wall panel (305,315), the ceiling rail (329) being removably mountable onto the ceiling (309), shown in FIG. 1, in a suitable manner, as is well known in the art, such as with Caddy clips, for example. The ceiling rail (329) is illustrated, for example, in FIGS. 6 and 11. As shown in the figures, the ceiling rail (329) is preferably substantially U-shaped, and comprises a pair of projecting elements (501) having extremities (503) being slanted towards one another, as shown in FIG. 4, for example.

Preferably, the ceiling track (327) of each frameless wall panel (305,315) is an extruded profiled ceiling track (327) being substantially complementary in shape to that of the ceiling rail (329), and comprises a pair of longitudinal grooves (505) for receiving a corresponding pair of projecting elements (501) of the ceiling rail (329). As shown in FIGS. 4 and 150, the ceiling track (327) is optionally secured to the top edge (319) of the panel (305) by a pair of top clamp assemblies (326). FIG. 151 is an enlarged view of the clamp assembly (326). In some embodiments, the pair of top clamp assemblies (326) are laterally spaced apart a similar distance to that of the pair of lower clamp assemblies (472). Each of the top clamp assemblies (326) is substantially shorter in length than the ceiling track 327, for example being about the same length as the lower clamp assemblies (472). In other embodiments, each panel (305) includes a pair of ceiling tracks (327) that have lengths substantially less than the overall width of the panel (305), each of the pair of ceiling tracks (327) secured to a corresponding top clamp assembly (326).

Figure 4:
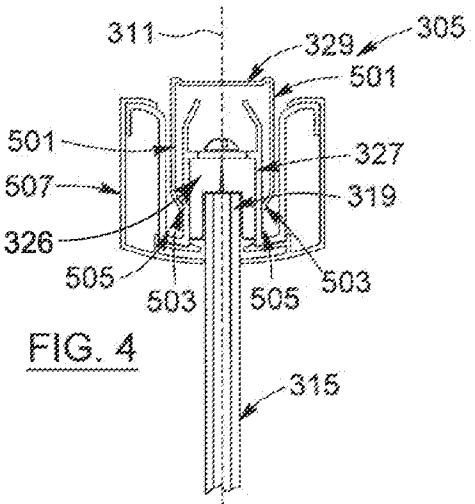
FIG. 4 is an enlarged view of a top portion of what is shown in FIG. 3.
Figure 5:
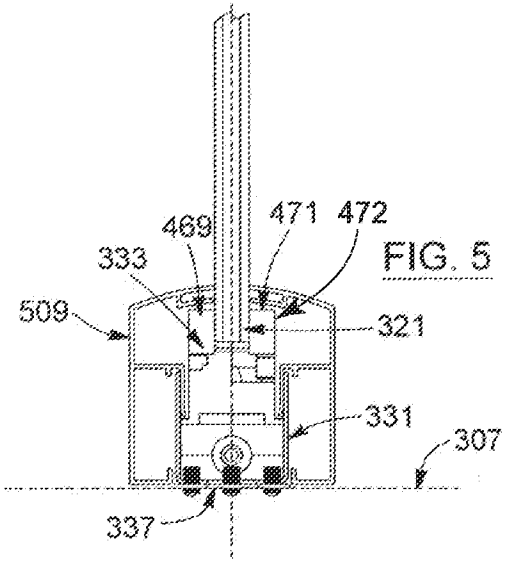
FIG. 5 is an enlarged view of a bottom portion of what is shown in FIG. 3.
Figure 3:
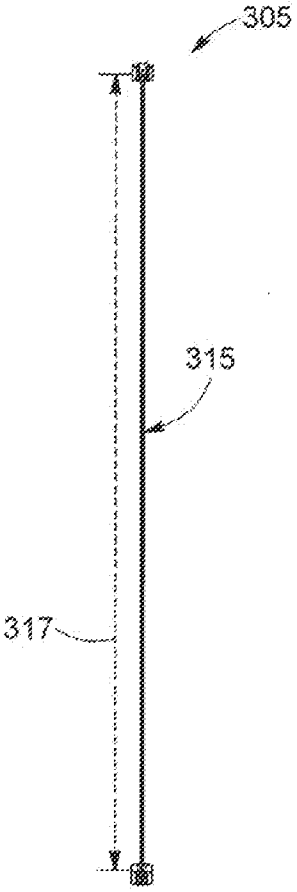
FIG. 3 is a cross-sectional view of FIG. 2.
Figure 2:
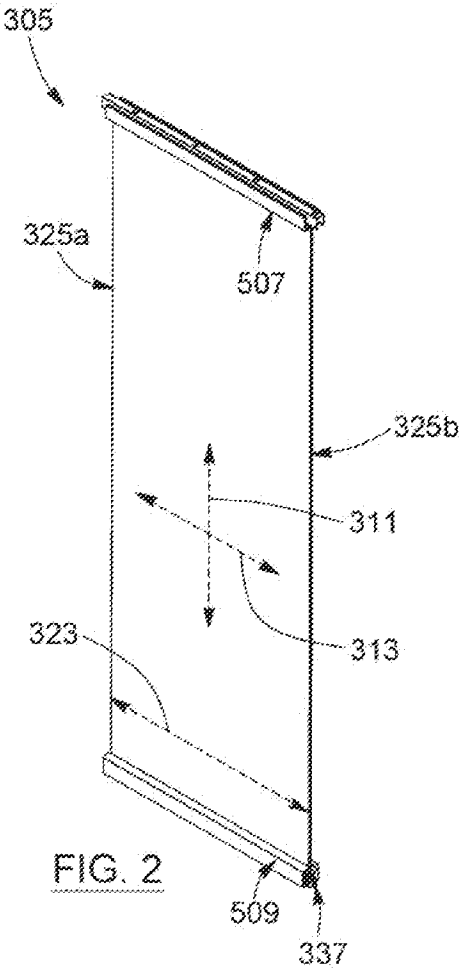
FIG. 2 is a perspective view of a butt-glazed frameless wall panel cooperating with a ceiling rail according to one embodiment.
Figure 11:
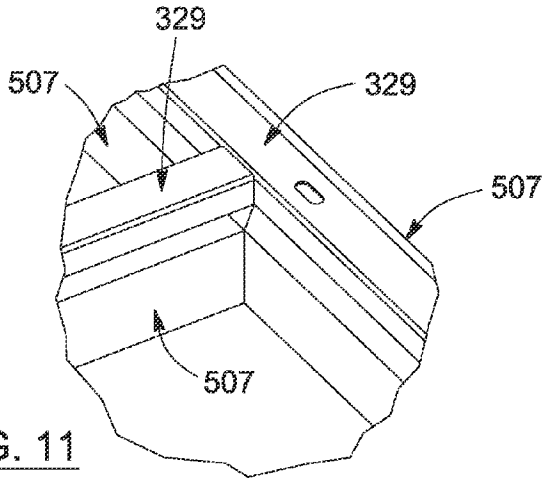
FIG. 11 is a partial top perspective view of an assembly of butt-glazed wall panels disposed along a 3-way connection according to one embodiment, the assembly being shown with corresponding ceiling covers.
Figure 12:
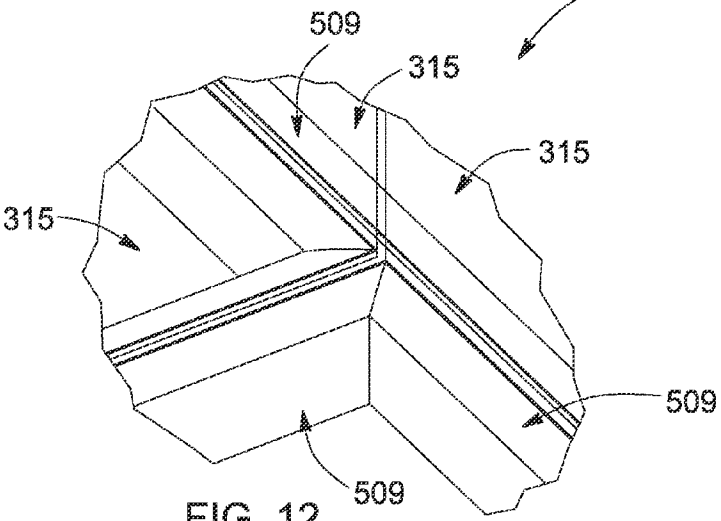
FIG. 12 is a partial bottom perspective view of an assembly of butt-glazed wall panels disposed along a 3-way connection according to one embodiment, the assembly being shown with corresponding bottom covers.
Figure 15:
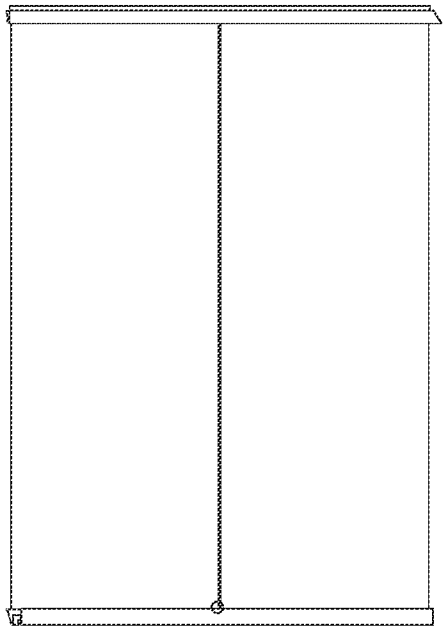
FIG. 15 is a side elevational view of a butt-glazed wall panel assembly disposed along a three-way connection according to one embodiment, the wall panel assembly being shown with top and bottom covers.
Figure 16:
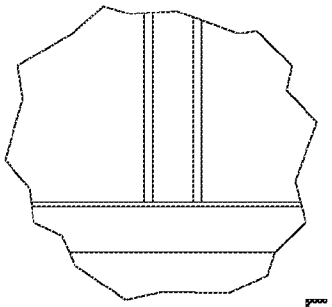
FIG. 16 is an enlarged view of a bottom portion of what is shown in FIG. 15.
Figure 14:
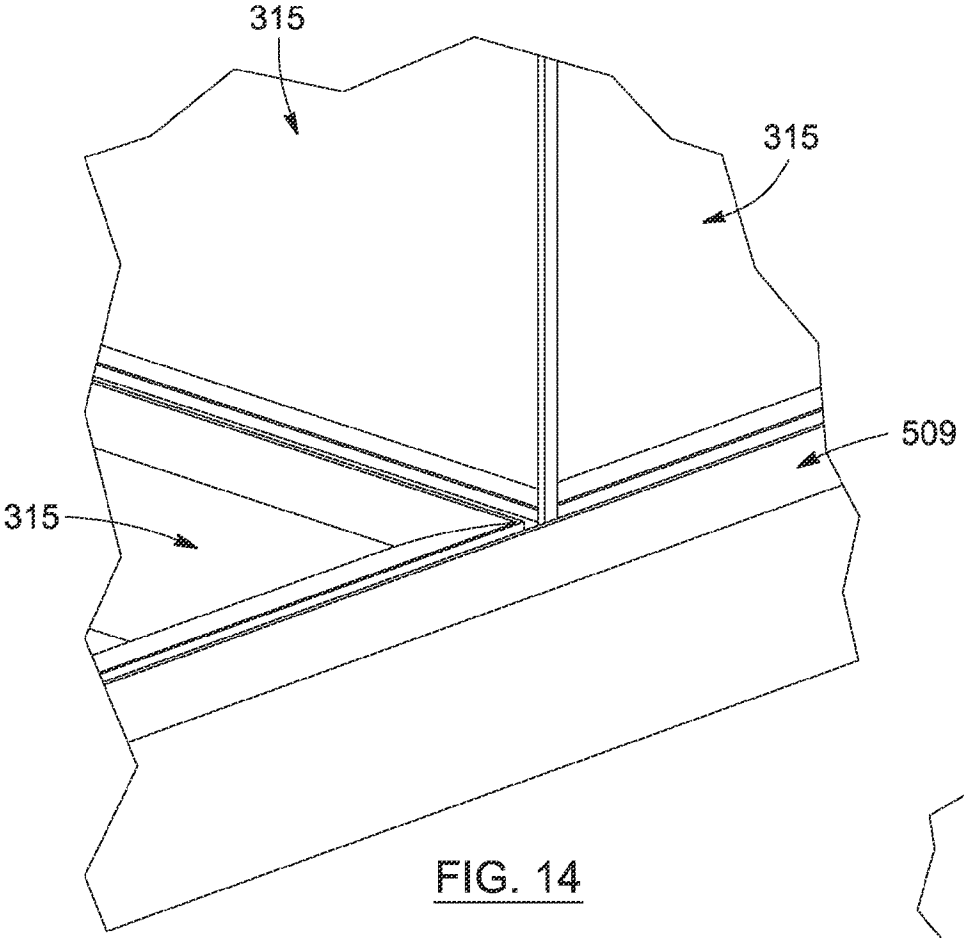
FIG. 14 is a partial bottom perspective view of a butt-glazed wall panel assembly disposed along a three-way connection according to one embodiment, the assembly being shown with corresponding bottom covers.

As exemplified in the various accompanying drawings, such as FIGS. 4 and 11, the wall panel system (301) preferably comprises a ceiling cover (507) associated with each wall panel (305,315), the ceiling cover (507) being removably mountable onto the ceiling track (327) of wall panel (305,315) in a variety of suitable manners, as apparent to a person skilled in the art. Similarly, the wall panel system (301) comprises a bottom cover (509) associated with each wall panel (305,315), the bottom cover (509) being removably mountable onto the bottom floor channel (331) of the wall panel (305,315), in a variety of suitable manners, as apparent to a person skilled in the art. The bottom cover (509) is illustrated, for example, in FIGS. 12 and 13.

In one embodiment, each frameless wall panel (305,315) is a frameless wall panel, such as a frameless glass wall panel for defining a frameless butt-glazed wall panel system (301), as exemplified in FIG. 1, for instance. Preferably, a gasket (511) is provided between adjacent side edges (325) of neighboring wall panels (305,315), as shown in FIG. 8, for example. In another embodiment, as discussed in more detail below, each wall panel (305,315) is a framed wall panel thereby defining wall panel system (301). In another embodiment, as discussed below, a combination of frameless and framed wall panels define wall panel system (301). In yet another embodiment, one or more of the wall panels are solid wall panels.

Figure 56:
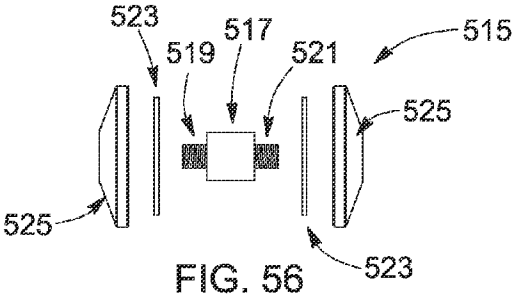
FIG. 56 is a side view of what is shown in FIG. 54.
Figure 50:
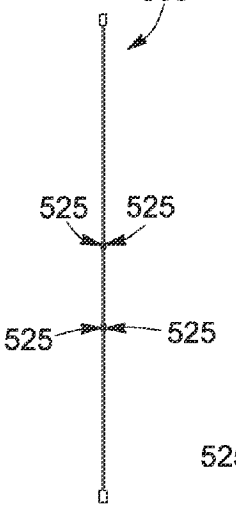
FIG. 50 is a cross-sectional view of what is shown in FIG. 49.
Figure 49:
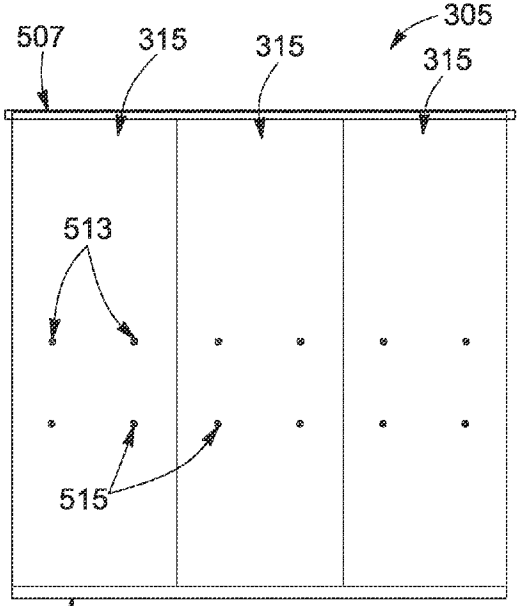
FIG. 49 is a side elevational view of a wall panel assembly provided with butt-glazed distraction markers according to one embodiment.
Figure 55:
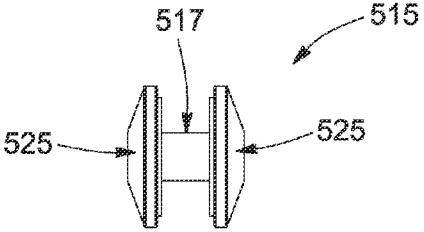
FIG. 55 is a side view of what is shown in FIG. 53.

Referring now to FIGS. 49-75, and according to another embodiment, each wall panel (305,315) comprises at least one pre-perforated through-hole (513), as seen in FIG. 49, for receiving a corresponding complementary accessory (515). Preferably, the complementary accessory (515) comprises a bushing (517) insertable into a corresponding through-hole (513), the bushing (517) having opposite ends provided with first and second threaded studs (519,521) configured for respectively receiving first and second components of the complementary accessory (515), as better shown in FIG. 56, for example. Preferably also, the complementary accessory (515) comprises a washer (523) disposed between each end of the bushing (517) and a corresponding component.

In one such embodiment, the complementary accessory (515) comprises a butt-glazed distraction marker (525), and at least one of the first and second components of the complementary accessory is a distraction marker (525). Preferably, the complementary accessory (515) comprises a pair of distraction markers (525), both inner and outer, as shown.

Figures 57, 58, 59, 60, 61, 62, 63, 64, 65, 66, 67:
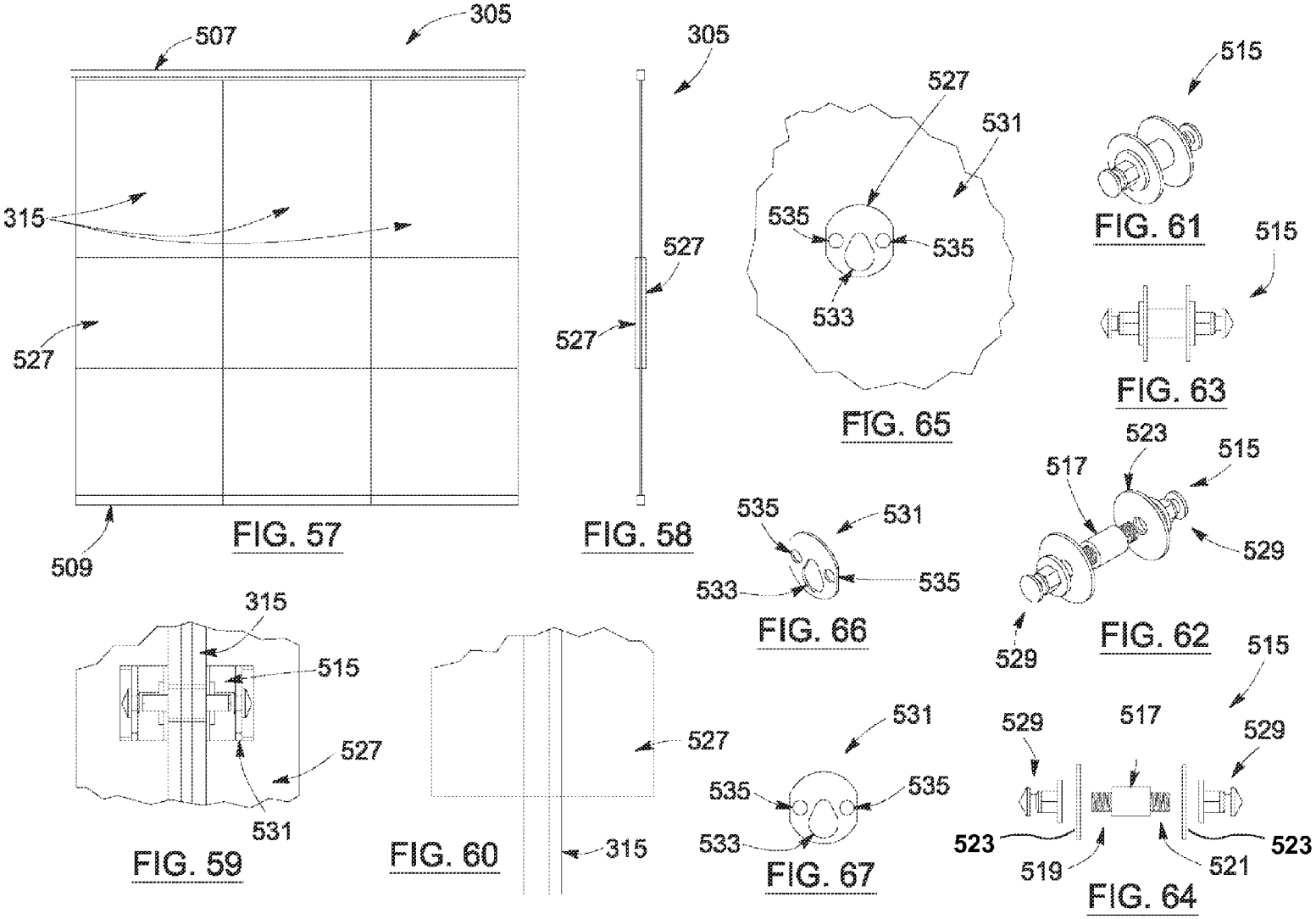
FIG. 57 is a side elevational view of a wall panel assembly being provided with butt-glazed snap-on wood shelves according to one embodiment.
FIG. 58 is a cross-sectional view of what is shown in FIG. 57.
FIG. 59 is an enlarged view of a portion of what is shown in FIG. 58.
FIG. 60 is an enlarged view of a portion of what is shown in FIG. 58.
FIG. 61 is a perspective view of a complementary accessory assembly according to another embodiment.
FIG. 62 is an exploded view of the components shown in FIG. 61.
FIG. 63 is a side elevational view of what is shown in FIG. 61.
FIG. 64 is a side elevational view of what is shown in FIG. 62.
FIG. 65 is a partial view of a wood shell provided with a hooking plate according to one embodiment.
FIG. 66 is a perspective view of the hooking plate shown in FIG. 65.
FIG. 67 is a front plan view of what is shown in FIG. 66.
Figures 68, 69, 70, 71, 72, 73, 74, 75:
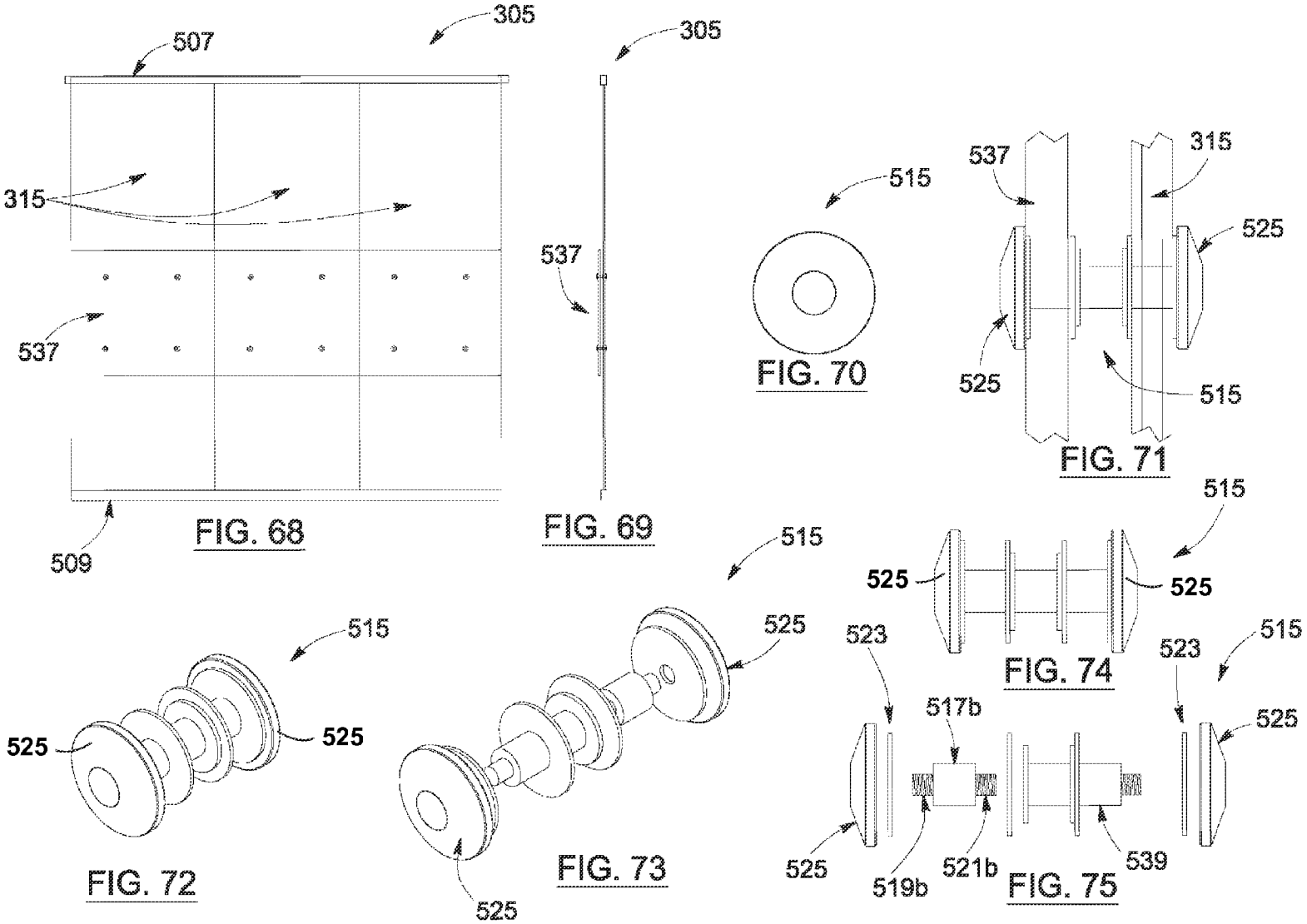
FIG. 68 is a side elevational view of a wall panel assembly being provided with butt-glazed snap-on glass shells according to one embodiment.
FIG. 69 is a cross-sectional view of what is shown in FIG. 68.
FIG. 70 is an enlarged view of a portion of what is shown in FIG. 68.
FIG. 71 is an enlarged view of a portion of what is shown in FIG. 69.
FIG. 72 is a perspective view of a complementary accessory assembly according to yet another embodiment.
FIG. 73 is an exploded view of the component shown in FIG. 72.
FIG. 74 is a side elevational view of what is shown in FIG. 72.
FIG. 75 is a side elevational view of what is shown in FIG. 73.

In one embodiment, as FIGS. 57-67, the complementary accessory (515) may comprise a butt-glazed snap-on wood shell (527), in which case, at least one of the first and second components of the complementary accessory (515) is preferably a hooking knob (529), as better shown in FIG. 62. In one such embodiment, the hooking knob (529) is configured for receiving a hanging plate (531) of the butt-glazed snap-on wood shell (527), and the hanging plate (531) comprises a hanging hook (533), and at least one hole (535) for receiving a corresponding fastener, as can be easily understood when referring to FIGS. 65-67.

In one embodiment, as exemplified in FIGS. 68-75, the complementary accessory (515) may comprise a butt-glazed snap-on glass shell (537), in which case, at least one of the first and second components of the complementary accessory (515) is preferably a threaded stand-off stud (539). In one such embodiment, the complementary accessory (515) further comprises another bushing (517*b*) having opposite ends provided with first and second threaded studs (519*b*, 521*b*) configured for respectively receiving the threaded stand-off stud (539) and a distraction marker (525), as better exemplified in FIGS. 70-75

In various embodiments, wall panels (305,315) can be of various natures and types, as can be easily understood by a person skilled in the art. For example, the wall panels (305,315), such as the prefabricated frameless panels, prefabricated framed panels, or prefabricated solid wall panels described herein could be a suitable laminated panel, or as exemplified in the drawings, simply a glass panel, such as a tempered or laminated glass panel. However, it should be appreciated that various other suitable types of frameless, framed, and solid wall panels may be used and could be useful, such as for example: gypsum, melamine, MDF, etc.

In various embodiments, and as exemplified in the accompanying figures, namely FIGS. 1 and 76-100, the wall panel system (301) comprises a sliding door assembly (541) being removably mountable onto the ceiling track (327) of a given wall panel (305,315) of wall panel system (301).

Figures 76, 77, 78, 79:
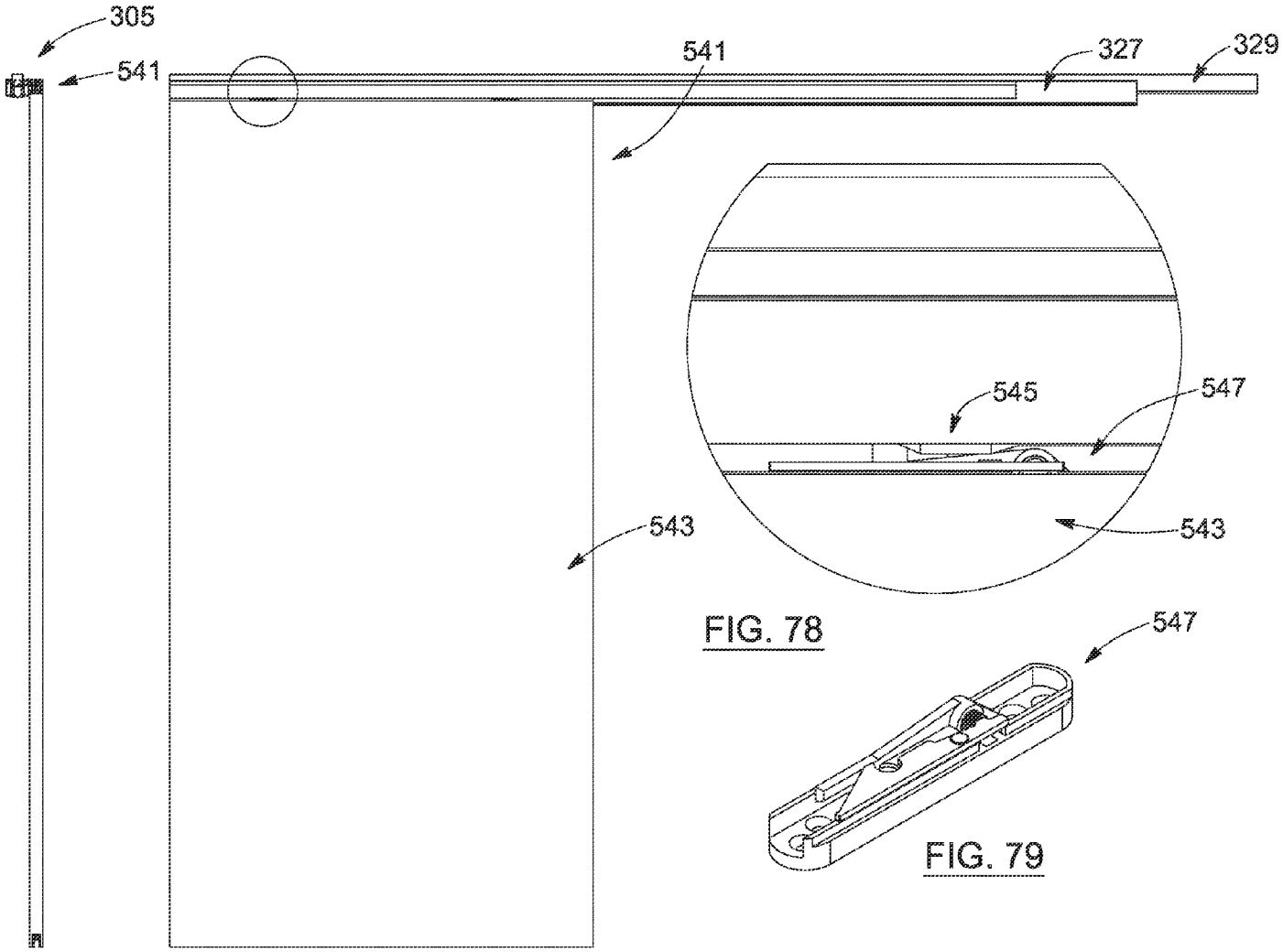
FIG. 76 is a side elevational view of a sliding door assembly operatively mounted onto a ceiling track and comprising a sliding wood door according to one embodiment.
FIG. 77 is a cross-sectional view of what is shown in FIG. 76.
FIG. 78 is an enlarged view of a portion of what is shown in FIG. 76.
FIG. 79 is a perspective view of a sliding door mounting bracket according to one embodiment.
Figure 82:
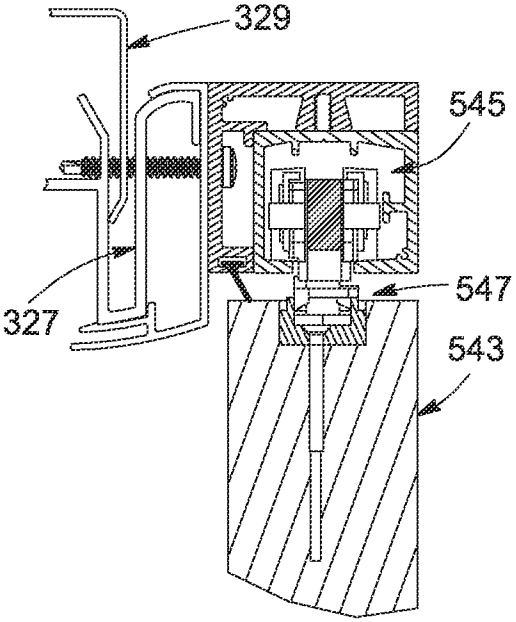
FIG. 82 is a partial cross-sectional view taken along a given segment of what is shown in FIG. 78.
Figure 81:
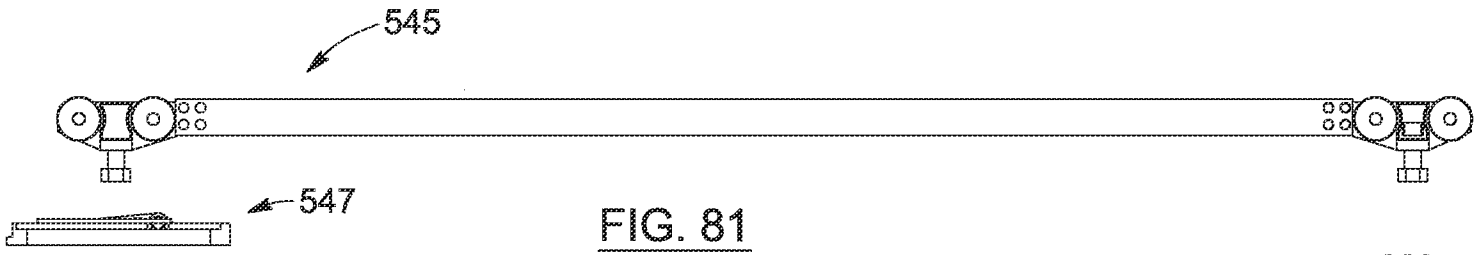
FIG. 81 is a side elevational view of a sliding door hardware being shown in an exploded relationship with a corresponding sliding door mounting bracket according to one embodiment.
Figure 80:
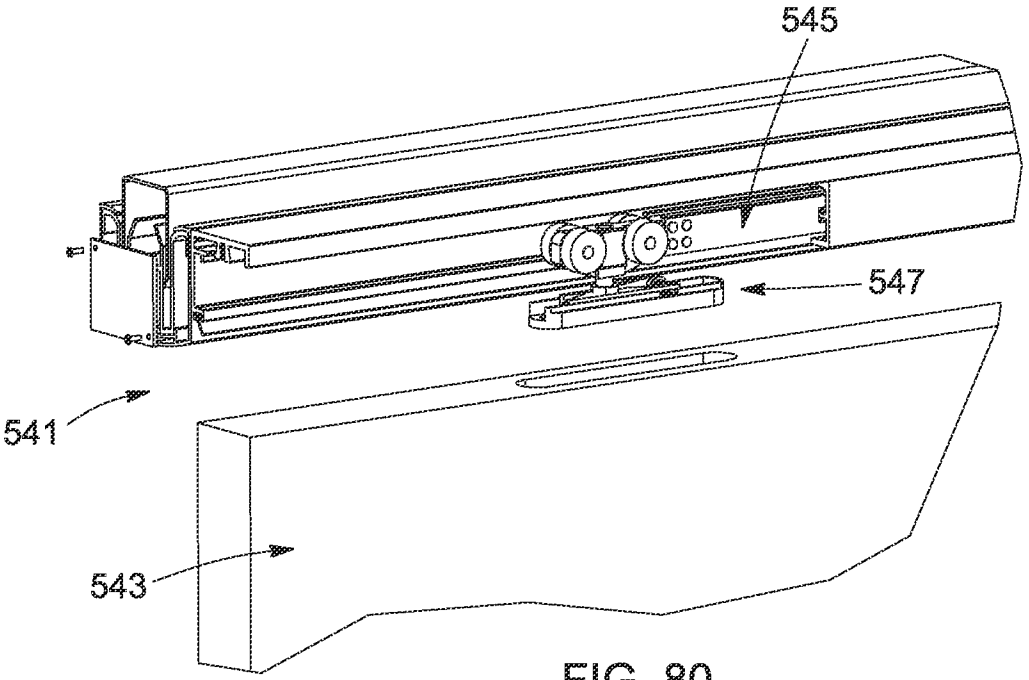
FIG. 80 is a partial top view of a sliding door assembly operatively mounted onto a corresponding ceiling track and ceiling rail according to another embodiment, some of the components being shown in an exploded relationship, including sliding door mounting bracket and wood door.
Figure 86:
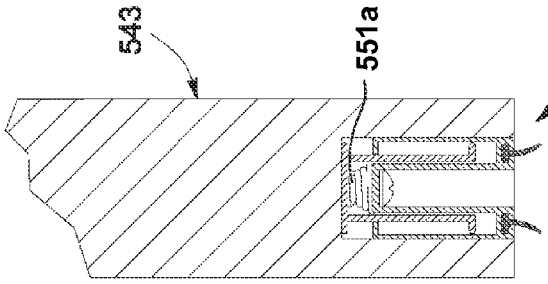
FIG. 86 is a cross-sectional view taken along a given segment of what is shown in FIG. 84.
Figure 84:
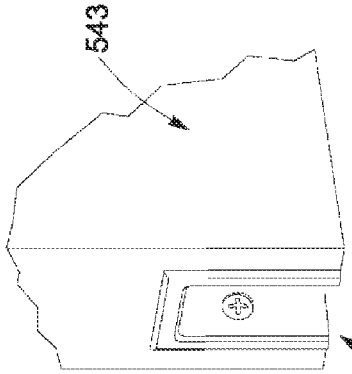
FIG. 84 is a bottom perspective view of a portion of what is shown in FIG. 83.
Figure 85:
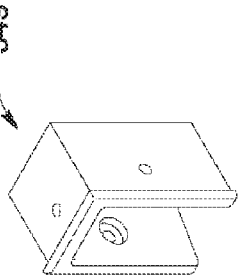
FIG. 85 is a perspective view of the bottom guide plug shown in FIG. 84.
Figure 83:
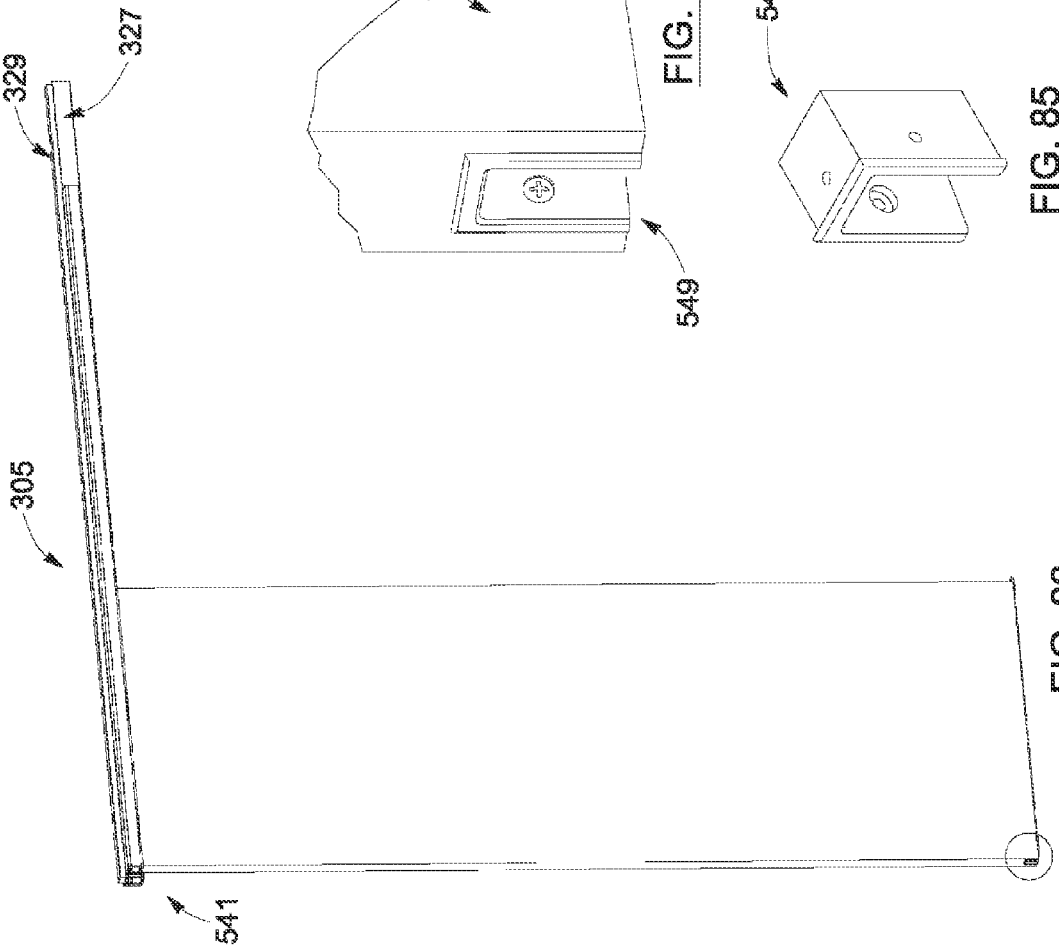
FIG. 83 is a perspective view of what is shown in FIG. 76.
Figures 87, 88, 89:
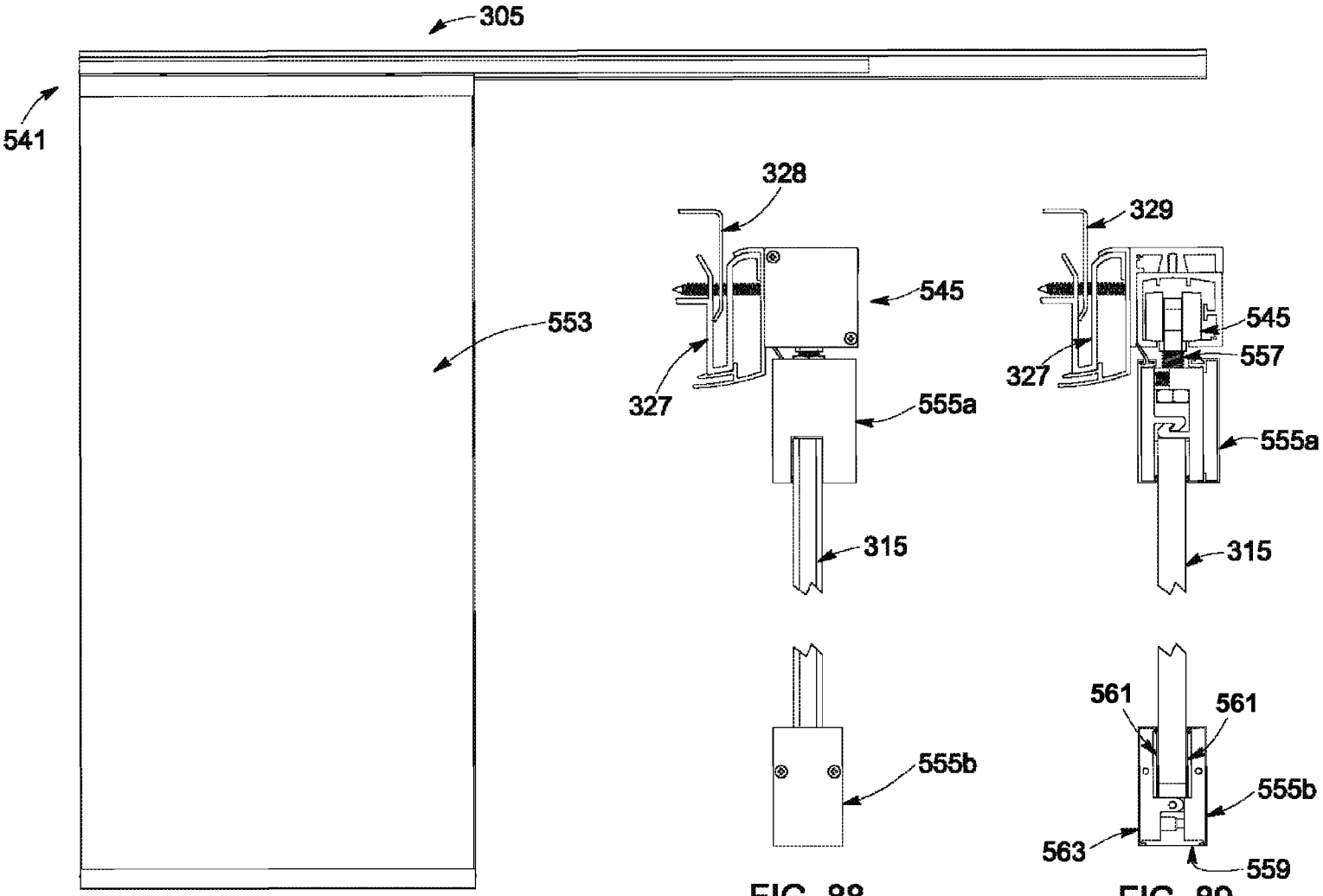
FIG. 87 is a side elevational view of a sliding door assembly operatively mounted onto a ceiling track and ceiling rail and comprising a sliding glass door according to one embodiment.
FIG. 88 is a schematic side view of what is shown in FIG. 87.
FIG. 89 is a cross-sectional view taken along a given segment of what is shown in FIG. 88.
Figure 90:
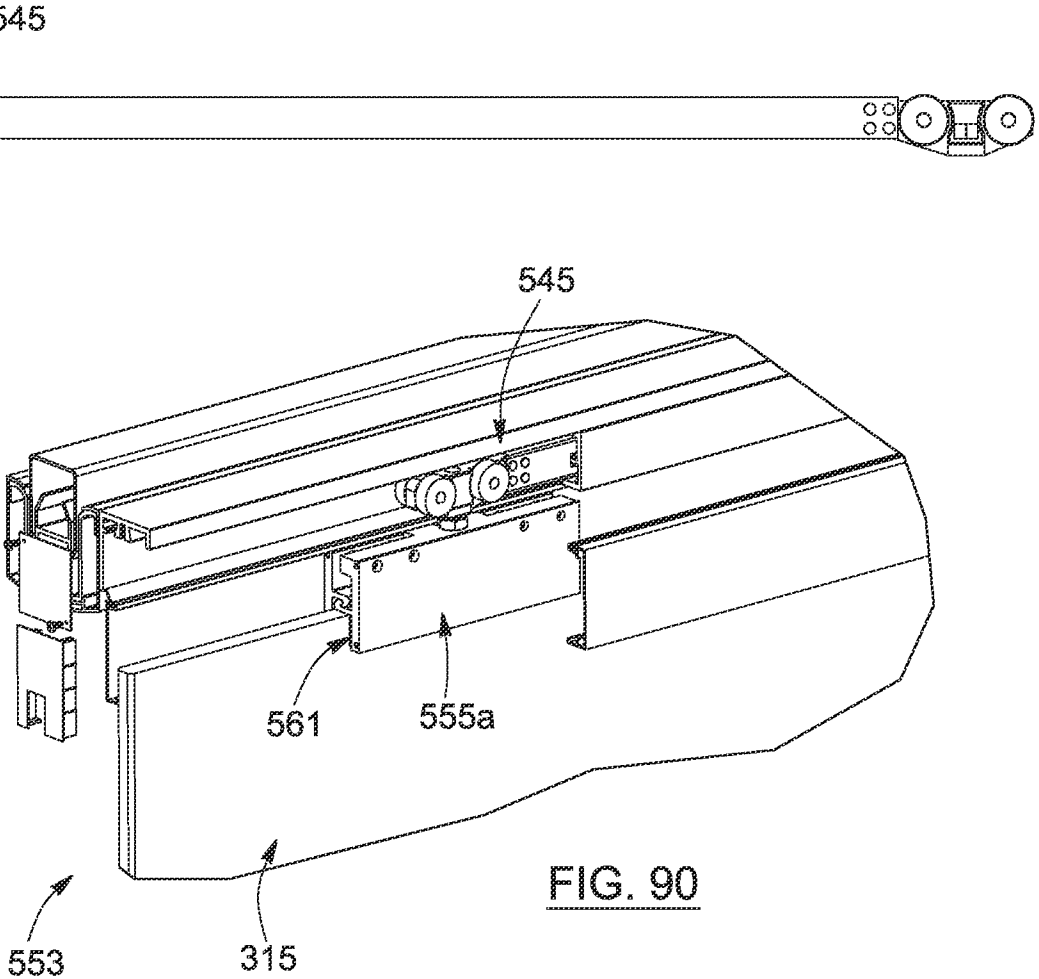
FIG. 90 is a partial top perspective view of a sliding door assembly operatively mounted onto a corresponding ceiling track and ceiling rail and comprising a sliding glass door according to yet another embodiment, some of the components shown in an exploded relationship with respect to others so as to namely better illustrate a corresponding glass clamp according to one embodiment.
Figure 91:
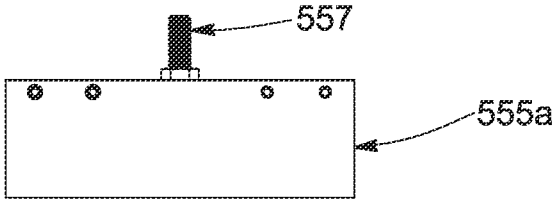
FIG. 91 is a side elevational view of a sliding door hardware being shown in an exploded relationship with respect to a corresponding glass clamp according to one embodiment.
Figure 92:
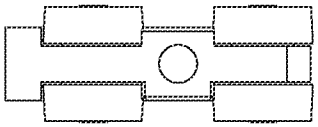
FIG. 92 is a top plan view of a rightmost portion of what is shown in FIG. 91.
Figure 93:
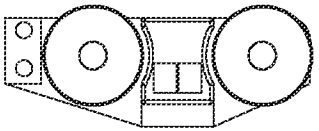
FIG. 93 is a partial side elevational view of a rightmost portion of what is shown in FIG. 91.
Figure 95:
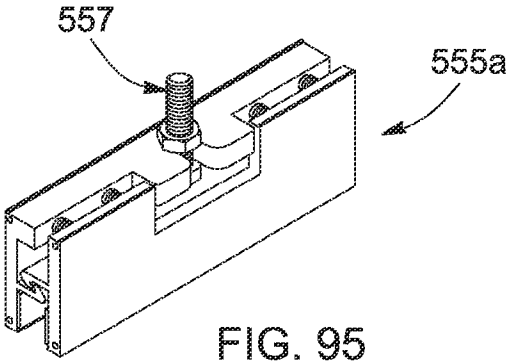
FIG. 95 is a front elevational view of what is shown in FIG. 94.
Figure 97:
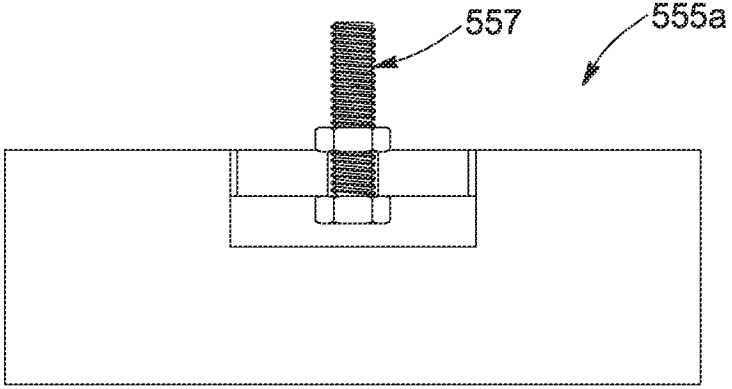
FIG. 97 is another side elevational view of what is shown in FIG. 94.
Figure 94:
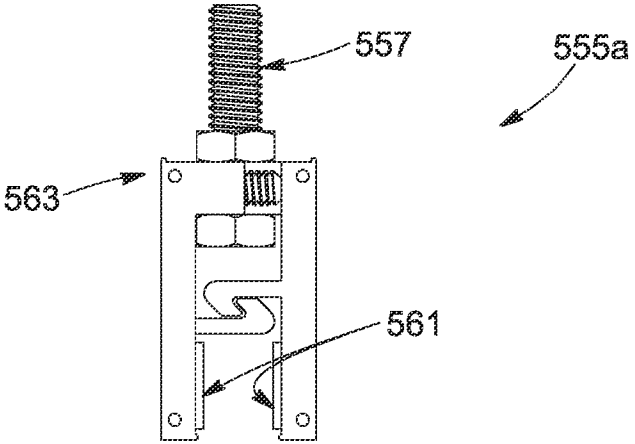
FIG. 94 is a perspective view of the upper glass clamp shown in FIG. 90, the upper glass clamp being shown provided with a height adjustment fastener.
Figure 96:
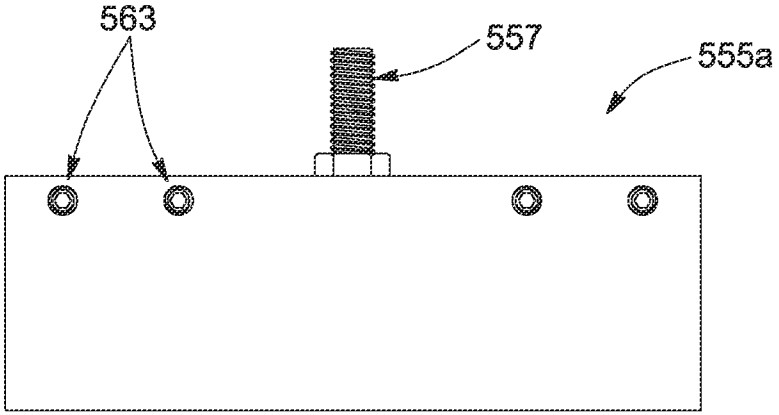
FIG. 96 is a side elevational view of what is shown in FIG. 94.
Figure 100:
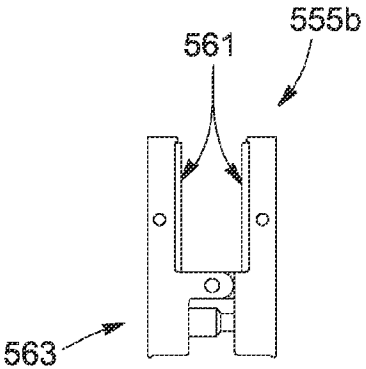
FIG. 100 is a front elevational view of what is shown in FIG. 99.
Figure 101:
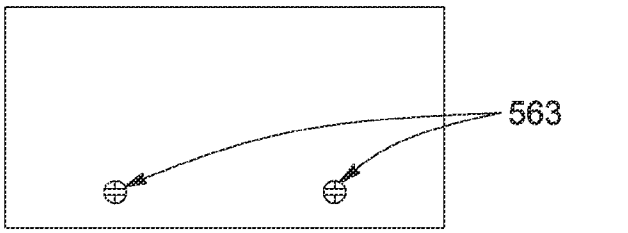
FIG. 101 is a side elevational view of what is shown in FIG. 99.
Figure 99:
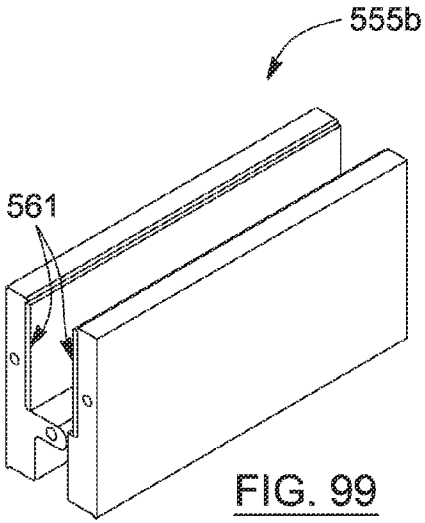
FIG. 99 is a perspective view of a bottom glass clamp shown in FIG. 98.
Figure 98:
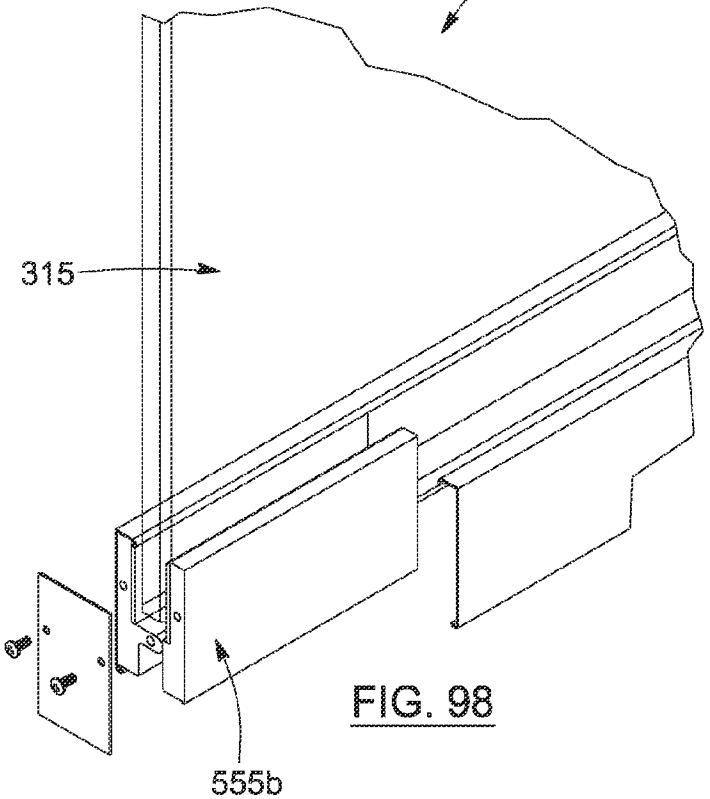
FIG. 98 is a partial bottom perspective view of a glass sliding door assembly, according to one embodiment, some of the components being shown in an exploded relationship with respect to others so as to better illustrate a bottom glass clamp according to one embodiment.

As illustrated, for example, in FIGS. 76, 77, and 78 the sliding door assembly (541) comprises a sliding door (543) removably mountable onto a sliding door hardware (545) of the sliding door assembly (541) via an upper sliding door mounting bracket (547). In one embodiment, a bottom portion of the sliding door (543) is provided with a bottom guide plug (549), as better shown in FIGS. 84 and 85. In one embodiment, a bottom portion of the sliding door (543) is provided with a bottom floor seal (551). In one embodiment the bottom floor seal (551) is spring-loaded via a spring (551*a*) so as to be biased downwardly, as exemplified in FIG. 86.

In various other embodiments, as illustrated in FIGS. 87-100, the sliding door assembly (541) comprises a sliding glass door (553) removably mountable onto a sliding door hardware (545) of the sliding door assembly (541) via a pair of upper glass clamps (555*a*), the sliding door assembly (541) further comprising a height adjustment fastener (557) cooperating between the sliding door hardware (545) and each upper glass clamp (555*a*), and configured for selectively adjusting the vertical distance between the sliding door hardware and each upper glass clamp (555*a*), so as to in turn selectively adjust the height and angle of the sliding glass door (553) with respect to the floor (307). In one embodiment, the sliding glass door (553) is provided with a pair of bottom glass clamps (555*b*), including a bottom floor seal (559). In one embodiment, opposite inner surfaces of each glass clamp (555) are provided with corresponding gaskets (561).

In one embodiment, each glass clamp (555) comprises a tightening assembly (563) for urging the inner surfaces of the clamp (555) towards one another via a corresponding tightening of the tightening assembly (563), as can be easily understood when referring to FIGS. 89 and 94-100.

It should be appreciated that the sliding door hardware (545) includes a soft-stop mechanism, not illustrated, for stopping a sliding wooden door (543) or, alternatively, a sliding glass door (553) or any other door type at a preferred stopping position.

Figure 105:
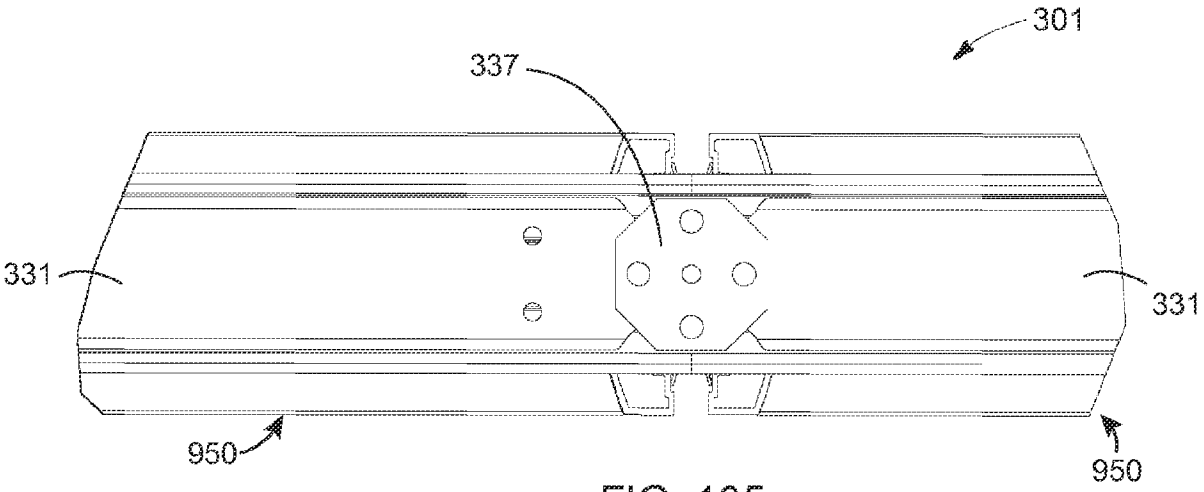
FIG. 105 is a bottom plan view of a pair of glass post panels being assembled onto one another according to one embodiment.
Figure 106:
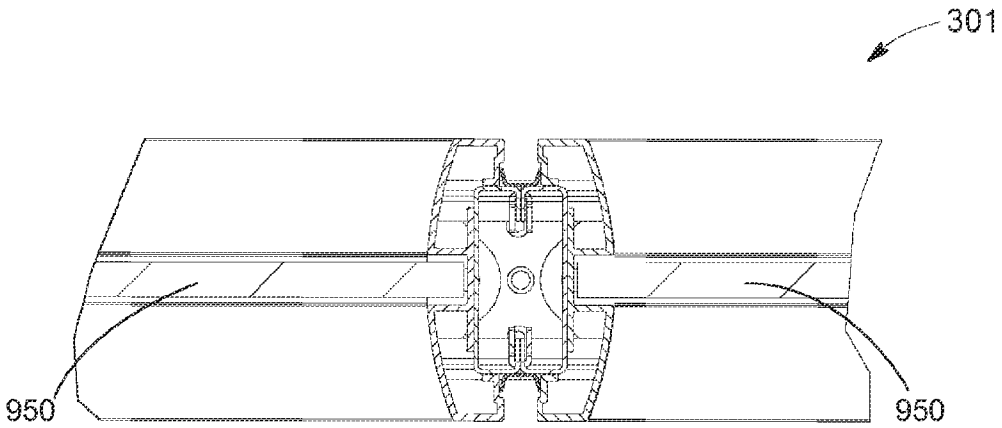
FIG. 106 is a cross-sectional view taken along a given segment of what is shown in FIG. 105.

FIG. 102 is a side elevational view of a pair of glass post panels 950 being assembled onto one another according to one embodiment. FIG. 103 is an enlarged view of a top portion and FIG. 104 is an enlarged view of the pair of glass post panels 950. FIG. 105 is a bottom plan view of a pair of glass post panels being assembled onto one another according to one embodiment. FIG. 105 further illustrates the connecting plate 337 and bottom floor channel 331. FIG. 106 is a cross-sectional view taken along a given segment of what is shown in FIG. 105.

Figure 109:
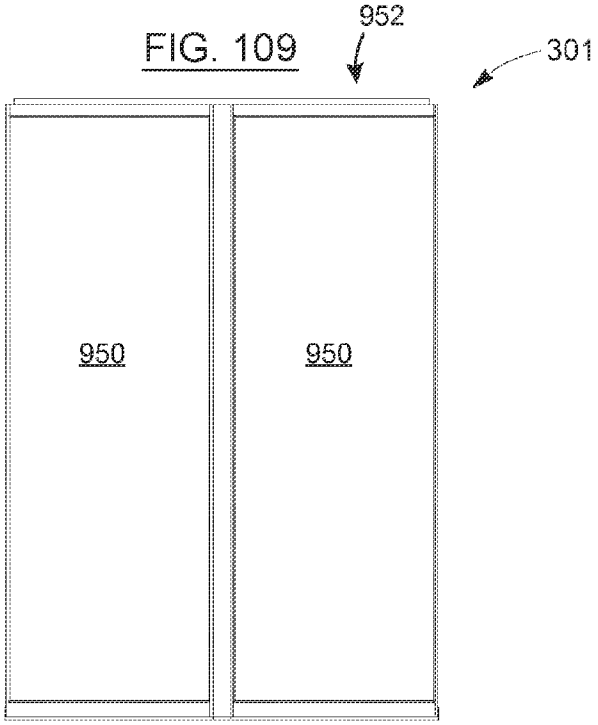
FIG. 109 is a side elevational view of a three-way glass post panel assembly according to one embodiment
Figure 110:
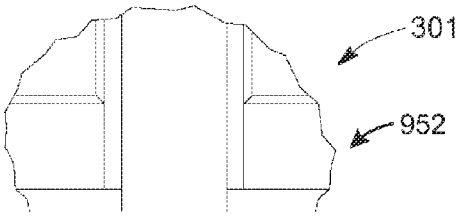
FIG. 110 is an enlarged view of a bottom portion of what is shown in FIG. 109.
Figure 107:
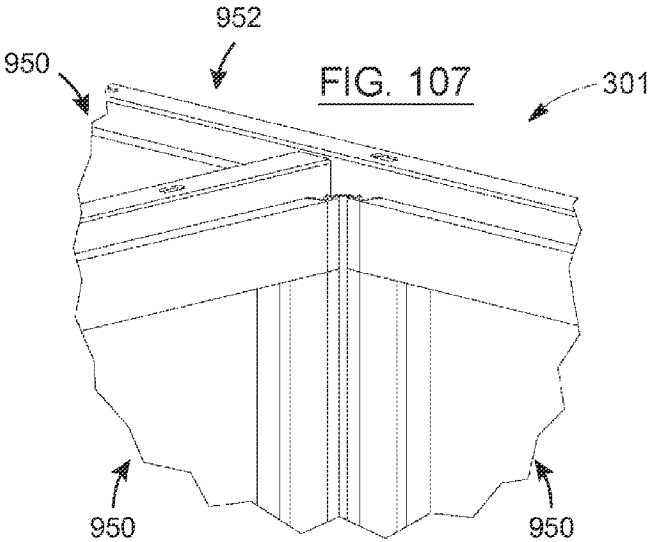
FIG. 107 is a partial top view of a three-way glass post panel assembly according to one embodiment.
Figure 108:
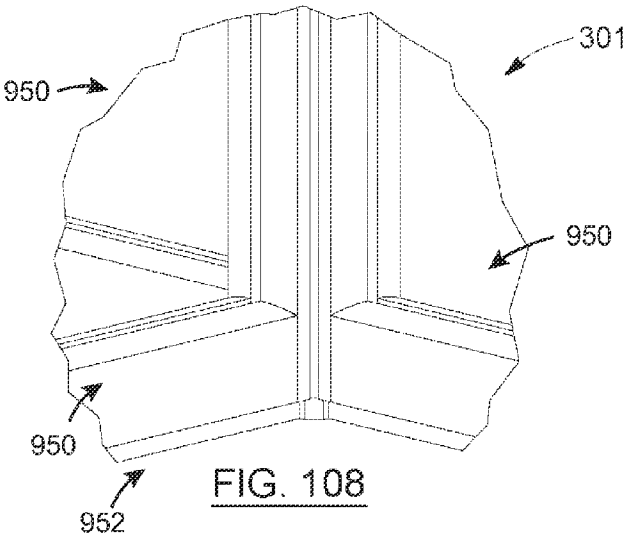
FIG. 108 is a partial bottom view of a three-way glass post panel assembly according to one embodiment.

FIG. 107 is a partial top view of a three-way glass post panel 952 assembly according to one embodiment. FIG. 108 is a partial bottom view of the three-way glass post panel assembly 952. FIG. 109 is a side elevational view of the three-way glass post panel assembly 952. FIG. 110 is an enlarged view of a bottom portion of the three-way glass post panel assembly 952.

Figure 112:
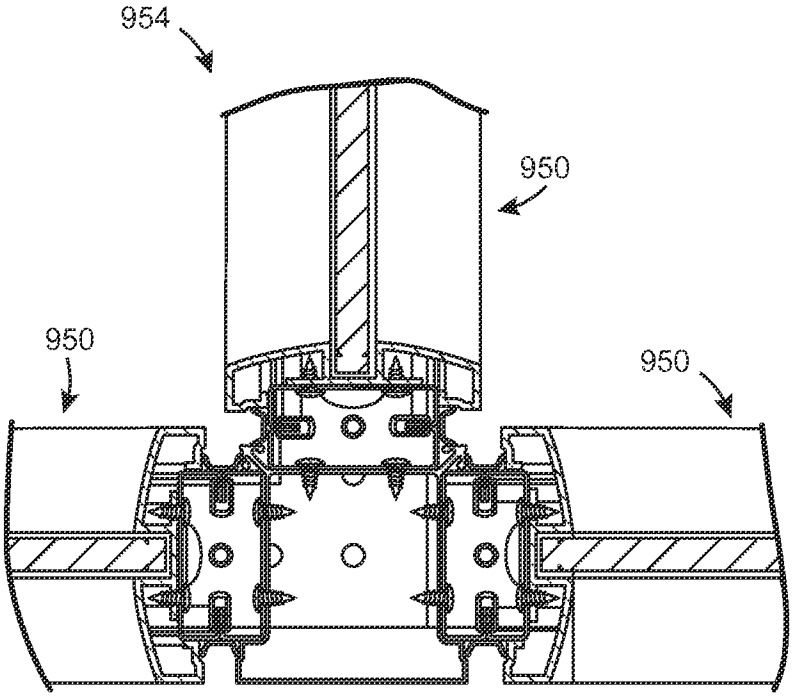
FIG. 112 is an enlarged view of a portion of what is shown in FIG. 111.
Figure 111:
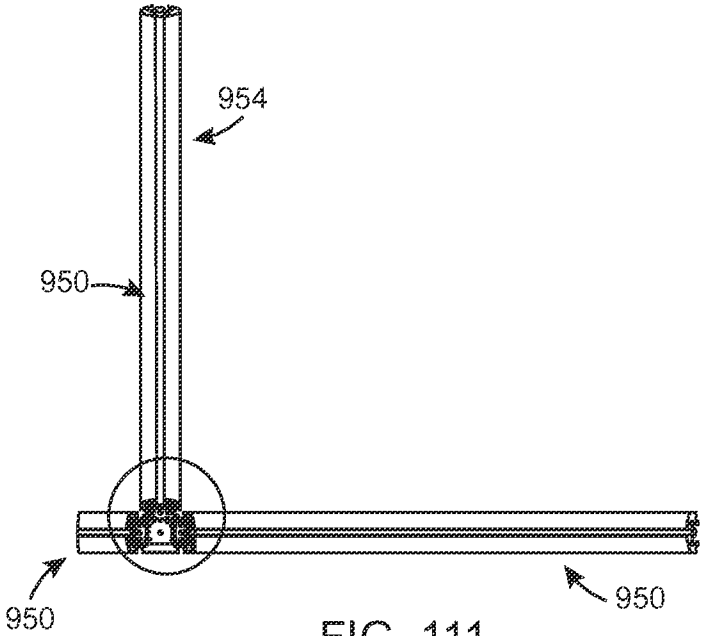
FIG. 111 is a cross-sectional view of a glass post panel three-way assembly according to one embodiment.

FIG. 111 is a cross-sectional view of a glass post panel three-way assembly 954. FIG. 112 is an enlarged view of a portion of the glass post three-way panel assembly 954.

Figure 116:
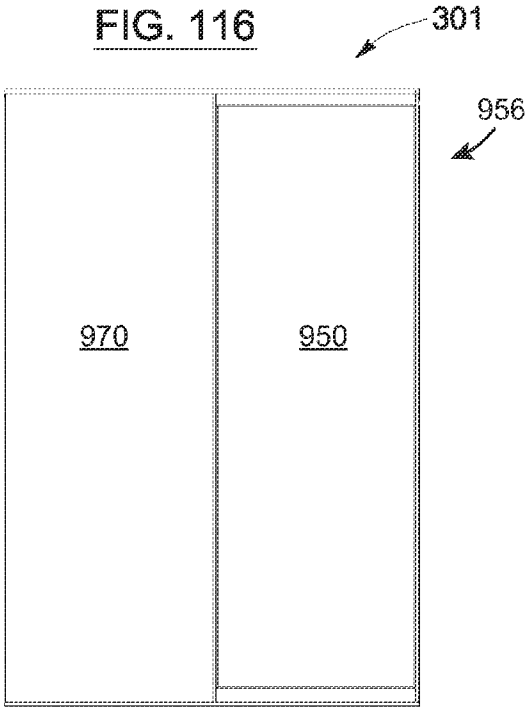
FIG. 116 is a side elevational view of what is shown in FIG. 113.
Figure 117:
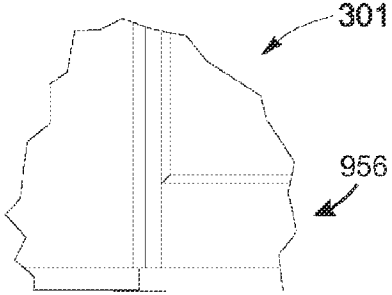
FIG. 117 is an enlarged view of a bottom portion of what is shown in FIG. 116.
Figure 114:
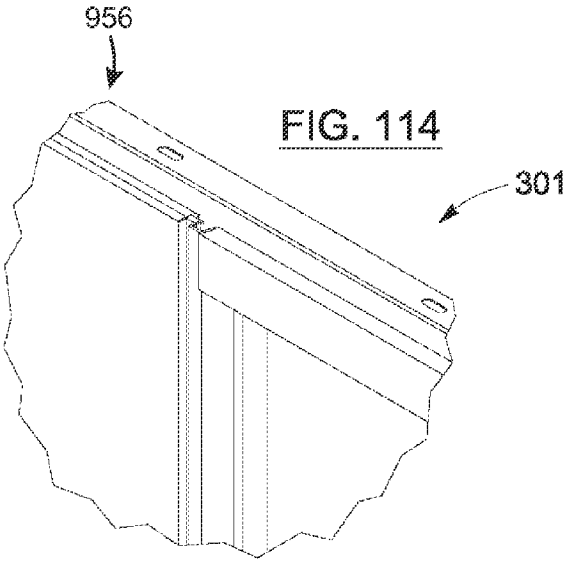
FIG. 114 is an enlarged view of a top portion of what is shown in FIG. 113.
Figure 115:
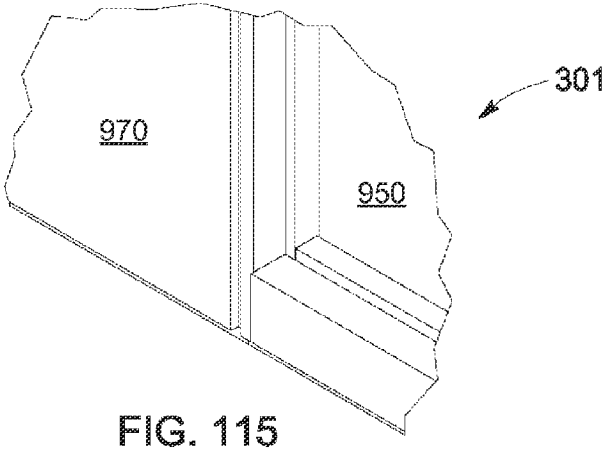
FIG. 115 is an enlarged view of a bottom portion of what is shown in FIG. 113.
Figure 113:
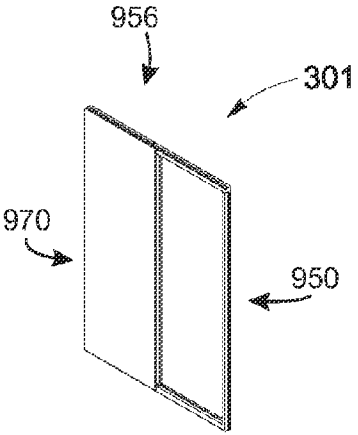
FIG. 113 is a perspective view of a wall panel assembly including a solid panel and a glass post panel assembled onto one another according to one embodiment.

FIG. 113 is a perspective view of a wall panel assembly 956 including a solid panel 970 and a glass post panel 950 assembled onto one another according to one embodiment. FIG. 114 is an enlarged view of a top portion of the wall panel assembly 956. FIG. 115 is an enlarged view of the wall panel assembly 956. FIG. 116 is a side elevational view of the wall panel assembly 956. FIG. 117 is an enlarged view of a bottom portion of the wall panel assembly 956.

According to various embodiments, each frameless wall panel (305,315) (or alternatively, framed or solid wall panel) of wall panel system (301) has substantially the same height and the same width, wherein the same height corresponds to a predetermined average height between the floor (307) and the ceiling (309), and each height adjustment assembly (333) being selectively adjusted to compensate for deviations between the floor (307) and the ceiling (309).

In view of the foregoing, some methods of pre-assembling wall panels (305) at a manufacturing site for installation between the floor of the room at the installation site, or job site and the ceiling rail (329) secured to the ceiling of the room, are described below. In some embodiments, pre-assembly includes securing a first one of the lower clamp assemblies (472), shown in FIG. 5, to the front and back of a frameless (or alternatively, framed) wall panel at the bottom portion of the frameless wall panel. In one alternative embodiment, a second lower clamp assembly (472) is secured to the bottom portion of the frameless wall panel, the first and second clamp assemblies (472) generally being located toward opposite sides of the frameless wall panel.

As illustrated, for example, in FIGS. 7 and 8, the bottom floor channel (331) is extended along the bottom of wall panel (305,315) in a lengthwise direction between the right and left sides. In this example, a first one of the height adjustment mechanisms (333) is secured to the first one of the lower clamp assemblies (472) and the bottom floor channel (331), the first adjustment mechanism (333) being configured to selectively modify the vertical position of the wall panel (305,315). A second one of the height adjustment mechanisms (333) is secured to the bottom floor channel (331), the second height adjustment mechanism (333) being configured to selectively modify a vertical position of the wall panel (305,315) independent of the first height adjustment mechanism (333). As illustrated, the first height adjustment mechanism (333) and the second height adjustment mechanism (333) can be disposed at opposing bottom corners of the wall panel (305,315). Thus, according to some embodiments, a user (not shown) is able to selectively and independently raise the left and right sides of the wall panel (315) (e.g., manually or using a power tool) during installation.

In some embodiments, the ceiling track (327), shown in FIG. 6, is extended along the top of wall panel (305,315) in a lengthwise direction between the right and left sides, the ceiling track (327) being configured to be removably inserted into the ceiling rail (329). In particular, one of the upper, or top clamp assemblies (326) is secured to the front and the back of the wall panel (305,315) at the wall panel's top portion, and the upper clamp assembly (326) is secured to the ceiling track (327), using, for example, a bolt fastener. In some embodiments, a second one of the upper clamp assemblies (326), illustrated in FIG. 4, is secured to the top portion of the wall panel (305,315), the first and second upper clamp assemblies (326) being generally located toward opposites sides of the panel (305,315). Following pre-assembly, one or more of the pre-assembled wall panels are delivered to the installation site. In some embodiments, a plurality of pre-assembled wall panels are provided as a shipping kit or kit of parts to the installation site with additional components of the wall panel system (301).

As shown in FIGS. 148 and 149, some methods of installing the wall panel system (301) between the floor of the room and the ceiling rail (329) include aligning the ceiling track (327) of the pre-assembled wall panel with the ceiling rail (329). The ceiling track (327) is removably inserted into the ceiling rail (329) by angling or tilting the top of the wall panel forward. The bottom of the wall panel is brought forward and the floor channel (331) is operatively rested against the floor with the ceiling track (327) received in the ceiling rail (329). A vertical position of the pre-assembled wall panel is then adjusted by actuating one more of the adjustment mechanisms (333) with the ceiling track (327) being constrained front to back by the ceiling rail (329) while also being free to slide up and down vertically as the vertical position of the pre-assembled wall panel is adjusted.

In some embodiments, height adjustment is accomplished manually (i.e., without the assistance of a powered tool, such as an electric drill). In other embodiments, the adjustment mechanisms are actuated using a power tool. In some embodiments, (e.g., as shown in FIGS. 19-22), actuating the adjustment mechanism includes driving a first end of a first leg and first end of a second leg toward one another, a second end of the first leg being pivotably connected relative to a second end of the second leg. In some embodiments (e.g., as shown in FIGS. 28-33), actuation of the adjustment mechanism (e.g., using a worm gear such as the worm gear 466) includes rotating the first, second, and third members (334, 336, 338) relative to one another to telescopically extend the third member (338) from the second member (336) and the second member (336) from the first member (334). As illustrated, a bottom cover (509) fits along the bottom.

As discussed above, in various embodiments, wall panel system (301) may include one or more frameless wall panels, one or more framed wall panels, one or more solid wall panels, or a combination of one or more frameless, framed, or solid wall panels. The assembling of wall panels (305,315,567) is via corresponding components, as exemplified in the accompanying drawings, and preferably, a pair of integrated and power-drivable height adjustment assemblies (333) is also associated with each wall panel and is insertable into (or comes pre-assembled with) a corresponding bottom floor channel (331) of the wall panel, each height adjustment assembly (333) comprising a support edge (335) for operatively supporting a lower portion of the wall panel, so as to selectively raise or lower the wall panel relating to the floor channel (569), thereby allowing a vertical height adjustment of the wall panel and a rotational angle adjustment thereof.

In one embodiment, the wall panel, such as the framed wall panel (567) comprises a dropdown cover (571), the dropdown cover (571) being nestable within the bottom distance channel (569) of the framed wall panel (567) and being operable between lowered and raised configurations so as to selectively have access to the height adjustment assemblies (333) associated with the framed wall panel (567), as can be easily understood when referring to FIGS. 144-147.

In one such embodiment, the dropdown cover (571) is spring loaded with a corresponding spring (573) disposed between the bottom distance channel (569) and the dropdown cover (571), so as to urge the dropdown cover (571) towards a lowered configuration, against the floor (307), as can be easily understood when referring to FIGS. 146 and 147.

Figure 118:
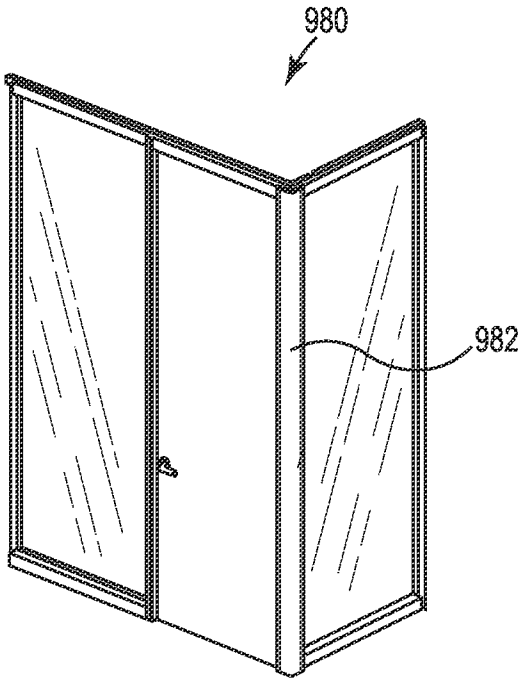
FIG. 118 is a perspective view of a wall panel assembly including a door post according to one embodiment.
Figure 119:
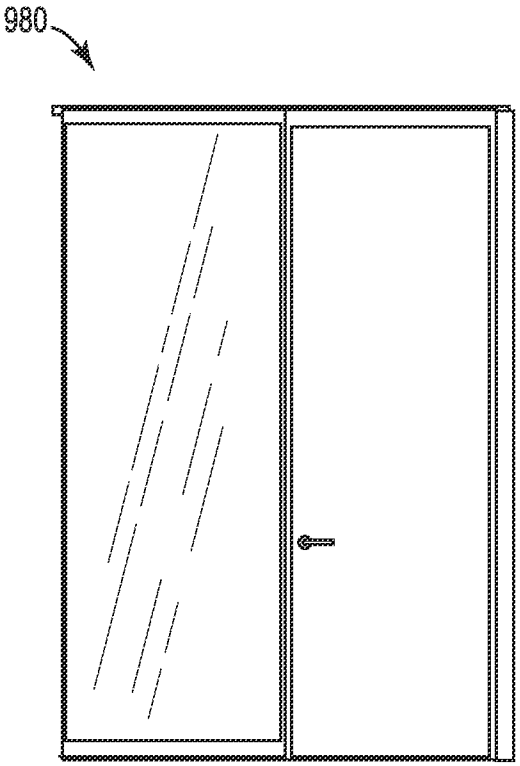
FIG. 119 is a side elevational view of what is shown in FIG. 118.
Figure 120:
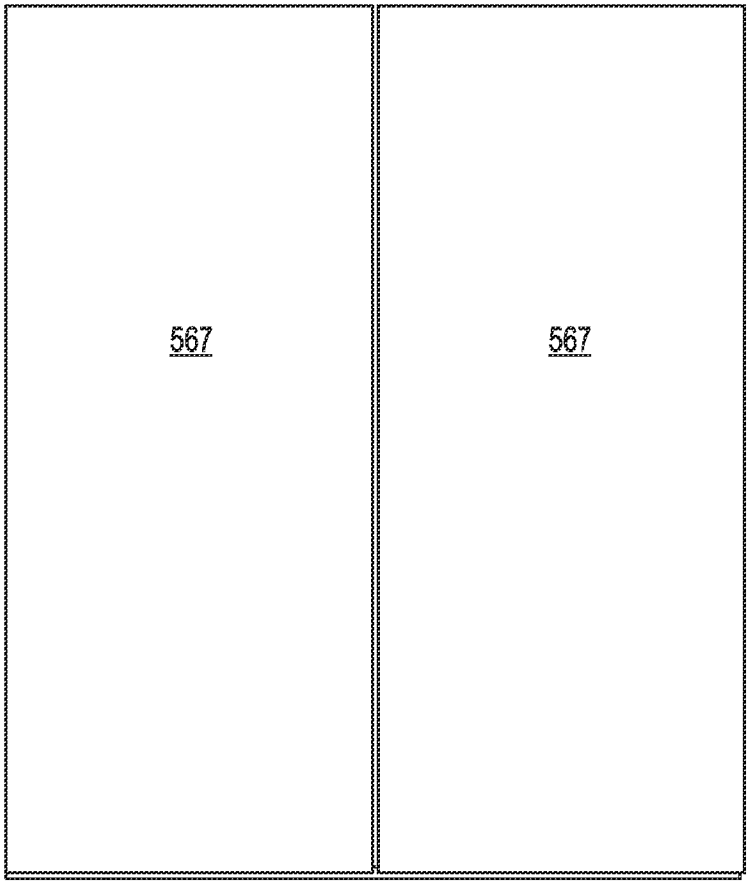
FIG. 120 is a side elevational view of a wall panel assembly comprising two solid panels assembled onto one another according to one embodiment.
Figure 122:
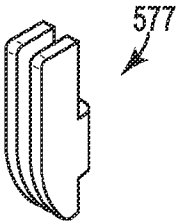
Figure 123:
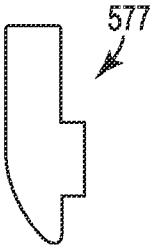
Figure 124:
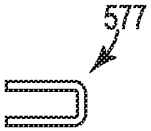
Figure 121:
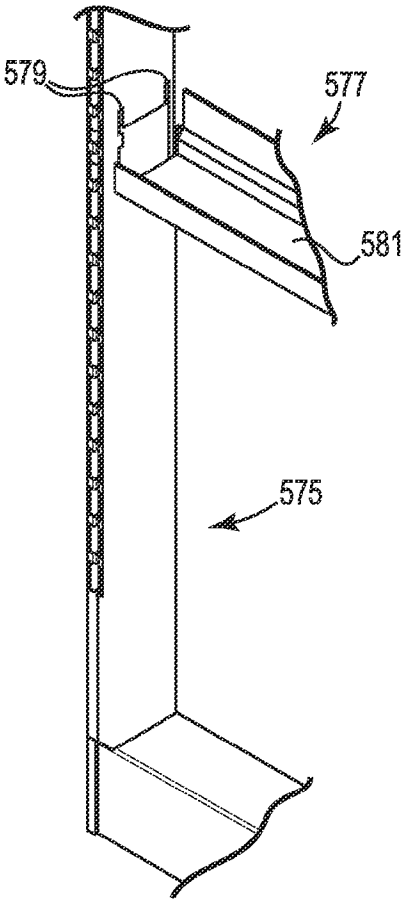
Figure 125:
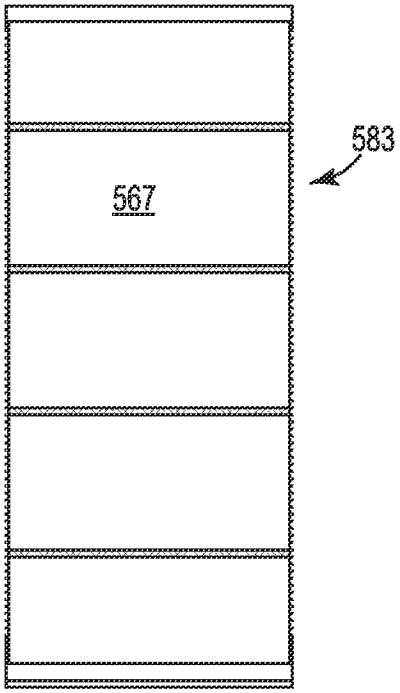
Figure 126:
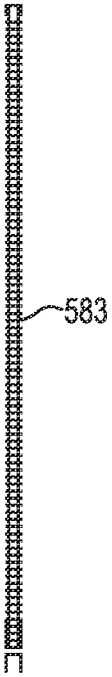
Figure 128:
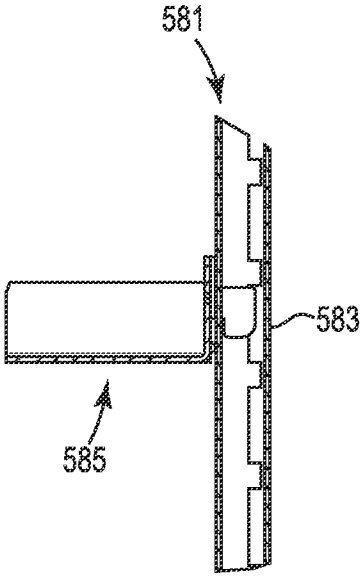
Figure 127:
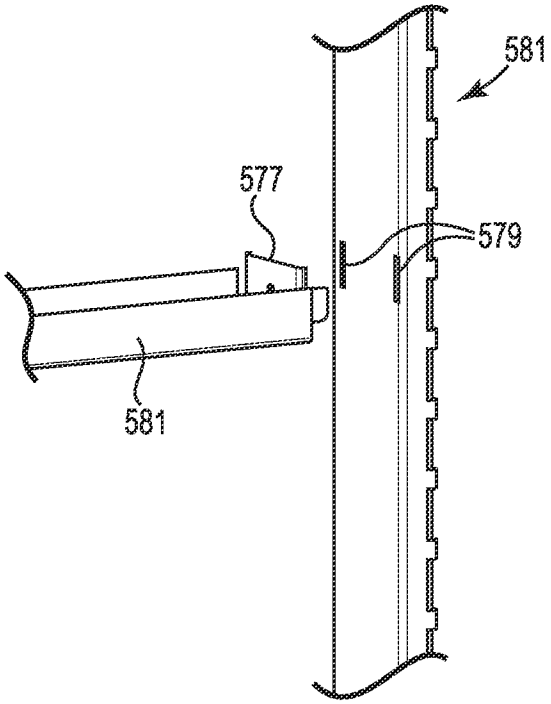
Figure 130:
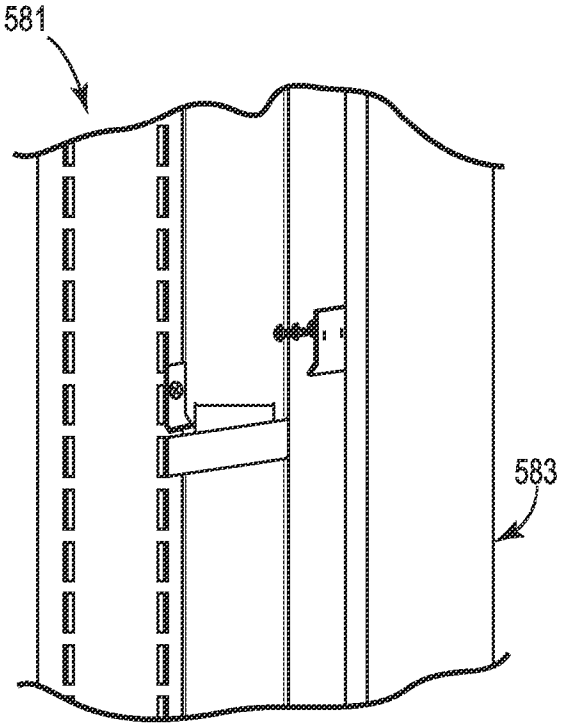
Figure 131:
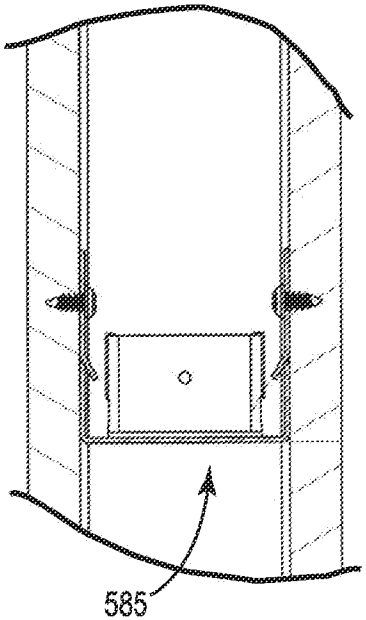
Figure 129:
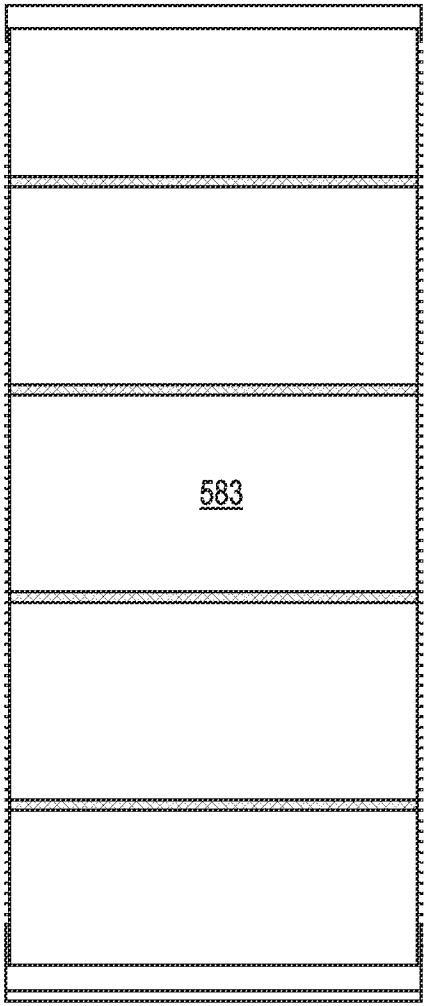
Figure 132:
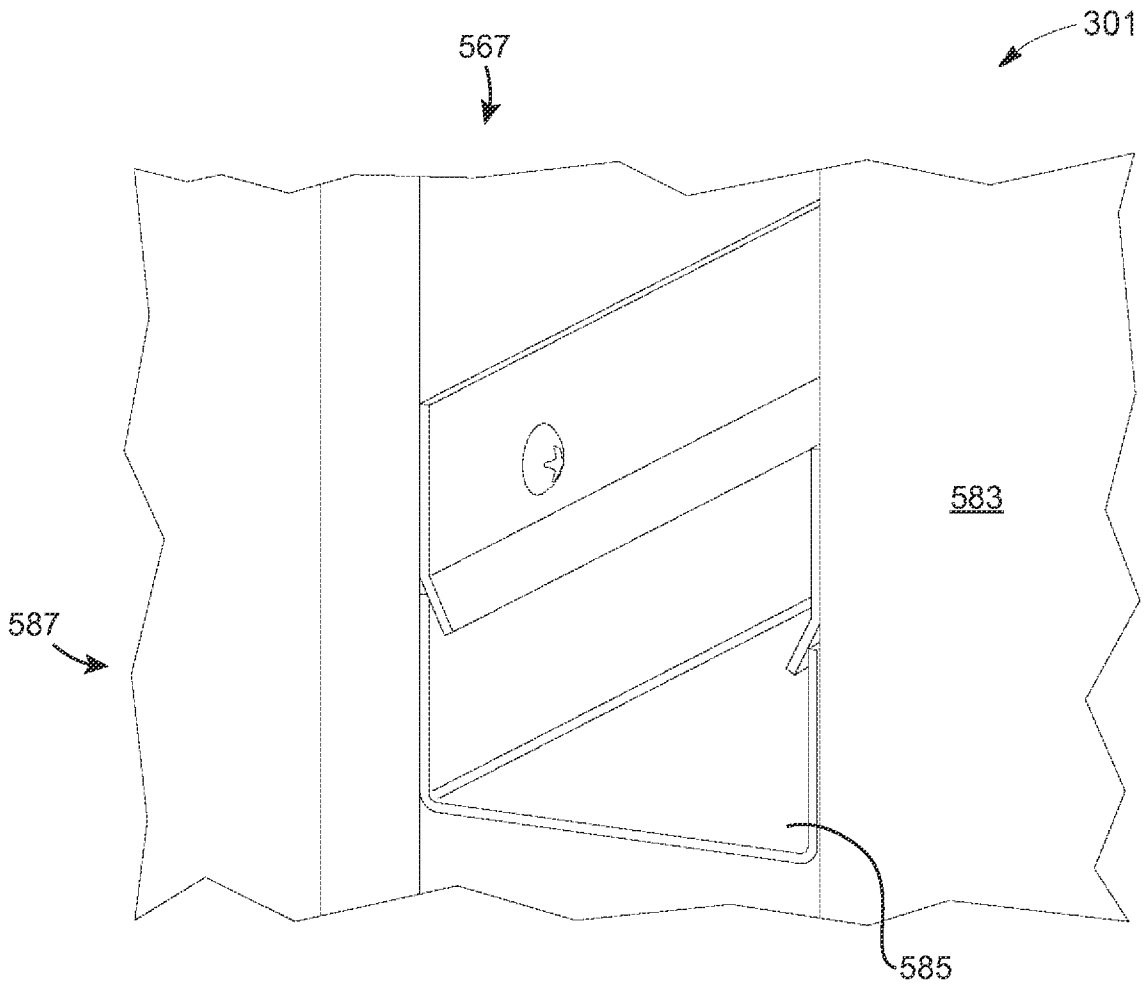

FIG. 118 is a perspective view of a wall panel assembly 980 including a door post 982 according to one embodiment. FIG. 119 is a side elevational view of the wall panel assembly 980.

Referring now to FIGS. 120-124, first and second neighboring framed wall panels (567) are connected to one another with at least one post connection clip (577) being removably insertable into a pair of slots (579) of adjacent vertical posts (575).

In one alternative embodiment, the framed wall panel (567) comprises an intermediate distance channel (581), and an outer covering (583) provided with an inner hanging component (585), the outer covering (583) being mounted onto the framed wall panel (567) by hanging the hanging component (585) thereof onto the intermediate distance channel (581), as can be easily understood when referring to FIGS. 125-132.

The outer covering (583) may be a metallic shell (583), in which case, the inner hanging component (585) thereof is also preferably a stiffening component (587) for providing structural rigidity to the metallic shell (583), as exemplified in FIGS. 133 and 134.

FIG. 135 is a cross-sectional view of a solid panel MDF/stackable and glass pole panel assembly 990 including a wall structure 1102 made of a first material according to one embodiment.

FIG. 136 is a cross-sectional view of a solid panel MDF/stackable and glass pole panel assembly 992 including a wall structure 1104 made of a second material and including a layer 1106 according to another embodiment.

According to yet another embodiment, and as better shown in FIGS. 137-140, the framed wall panel (567) may comprise a horizontal hooking channel (589) defined between a pair of one or more stacked components (591) of the framed wall panel (567), the hooking channel (589) being configured for receiving at least one hooking bracket.

In one embodiment, each hooking bracket (591) comprises a hooking portion (593) and hanging portion (595), the hooking portion (593) of the hooking bracket (591) being complementary in shape to that of the hooking channel (589), and the hooking channel (589) comprising a groove (597) being shaped concave upwardly, as exemplified in FIG. 139.

FIG. 141 is a side elevational view of a wall panel assembly 1002 disposed along a clear story configuration according to one embodiment. FIG. 142 is an enlarged cross-sectional view of a top portion of the wall panel assembly 1002. FIG. 143 is an enlarged view of a bottom portion of the wall panel assembly 1002.

FIG. 144 is a fragmentary perspective view of a framed glass panel 1004 being provided with a dropdown cover 1006 according to one embodiment. FIG. 145 is a bottom perspective of the framed glass panel 1004, the framed glass panel 1004 being now without a bottom cover 1008.

In one embodiment, the wall panel system (301) comprises at least one other complementary wall panel (599) selected from the group consisting of glass post panel, solid panel, door post, metallic frame panel, stackable panel and clear story panel, so as to enable a variety of assemblies of different wall panels, as exemplified in the accompanying drawings.

As may now be better appreciated, the wall panel system (301) is a substantial improvement over conventional wall panel systems, as can be easily understood by a person skilled in the art when referring to the accompanying drawings, and the present description.

For example, a "butt-glazed panel" embodiment, it may have one or more of the following components, features, dispositions, interrelations, variants and/or resulting advantages, namely: a) modular panels with a continuous base cover and ceiling cover; b) continuous cover and ceiling cover will be assembled on the job side; c) ⅜" tempered glass with a ⅛" chamber on vertical edge for perfect butt joint in 2-way, 3-way or 4-way installation; d) the height of base cover stays constant; e) height adjustment of about +/−1", components travel inside the floor channel and base cover; f) height adjustment will be mechanical operating via power tools or manual (option 1—gear box and counter threaded rod; option 2—rotating, radial connected tubular gears; and option 3—double shaft and gear box); g) adjustment will be accessible from both sides of the panel; h) carpet gripper/seismic floor plate assures consistent and accurate distance/spacing between adjacent panels; i) carpet gripper/seismic floor plate allows panel to be placed in any angle; and j) vertical butt glazed filler/connector assures rigidity and exclusive design look.

Additionally, for example, a "carpet gripper/seismic floor attachment" embodiment, it may have one or more of the following components, features, dispositions, interrelations, variants and/or resulting advantages, namely: a) all panels are secured to the floor channel with the threaded carpet gripper; b) holds dimension, keeps system from growing on the job side; and c) set screws are used as carpet grippers, but also to hold the floor channel in place (in seismic areas, the floor channel is fixed with a nut on the set screw and the plate will be bolted to the floor).

Moreover, for example, a "glass post panel" embodiment, it may have one or more of the following components, features, dispositions, interrelations, variants and/or resulting advantages, namely: a) glass panels are modular unitized panels with a recessed base; b) glass panels accept ¼" and ⅜" glass; c) glass panel frame consists of an aluminum or steel slotted post cladded with aluminum extrusions; d) panel to panel connection is achieved by hooking clips inserted into slotted standard punched along the vertical edges of the post; e) there will be a approx ⅜" reveal between panels; f) top distance channel 2.5" bottom distance channel 3"; g) height adjustment of about +/−1", travelling inside the floor channel—glass is preferably held in place by a clamp secured to the frame; h) recessed base with incorporate spring-loaded dropdown cover concealing the height adjustment mechanism; i) spring-loaded dropdown cover pre-assembled in factory; and j) post and distance channels designed with a radius of about 4".

Further, a "solid panel" embodiment, it may have one or more of the following the following components, features, dispositions, interrelations, variants and/or resulting advantages, namely: a) solid panels are modular unitized panels with a recessed base; b) solid panels are stackable; c) solid panel frame is steel, with vertical slotting in the post; d) panel to panel connection by clip in steel slotting post; e) slotting in the post will also provide way of hanging of different kinds of accessories (i.e. overheads, work surfaces, furniture, shelving, etc.)—also, this could be achieved horizontally via horizontal track channel; f) shells are clipped or hung with the stiffeners to the frame into steel/spring steel clips which are fastened to the inside of the frame or hung horizontally; g) recessed base with incorporated spring-loaded dropdown cover; h) height adjustment of about +/−1", traveling inside the floor channel, clamp is screwed to the frame; i) height will be adjusted with a power tool from the side of the panel; j) optional continues horizontal hooking channel incorporated in the frame; k) optional continuous horizontal hooking channel with stackable panels; and l) total width of hooking channel is ⅜", slot is shaped round to accept a same shape bracket, designed to prevent bracket from falling out.

Finally, for example, a "height adjustment assembly" embodiment, it may have one or more of the following components, features, dispositions, interrelations, variants and/or resulting advantages, namely: a) height adjustment of about +/−1", traveling inside the floor channel, clamp is screwed to the frame or is clamping ⅜" or ½" glass; b) height will be adjusted with a power tool from the side of the panel; c) a gear box assembly operates the counter-threaded rod which in turn operates the steel, cross-attached arms which are secured to the glass holding clamps; and d) the height adjustment is accessible from both sides.

It should be appreciated that the wall panel system and corresponding parts are made of substantially rigid materials, such as metallic materials (aluminum, stainless steel, etc.), hardened polymers, composite materials, and/or the like, whereas other components thereof, in order to achieve the resulting advantages briefly discussed herein, may preferably be made of a suitably malleable and resilient material, such as a polymeric material (plastic, rubber, etc.), and/or the like, depending on the particular applications for which the wall panel system and resulting working space are intended for and the different parameters in cause, as apparent to a person skilled in the art.

As may now also be further appreciated, the above-discussed wall panel systems provide for a moveable non-progressive mountable and demountable wall panel system, particularly well suited for mounting solid wall panels, framed wall panels, and installing frameless wall panels in a very fast, easy, convenient, proper, systematic and cost-effective manner, thereby avoiding the corresponding drawbacks of the "stick-built" approach of conventional wall panel systems.

Of course, numerous modifications can be made to the above-described embodiments without departing from their scope as defined in the appended claims. For example, FIGS. 150-177 show features of a wall panel system 301, according to some embodiments.

FIGS. 150-152 show components of a pre-assembled frameless wall panel, according to some embodiments. As shown, the frameless wall panel includes various components similar to those previously described. In some embodiments, the pre-assembled frameless wall panel includes a pair of spaced apart, top clamp assemblies (326) (shown in greater detail in FIG. 151), a pair of ceiling tracks (327), each of which is configured to be secured to a corresponding one of the top clamp assemblies (326). The pre-assembled frameless wall panel also includes a wall panel (315), a pair of height adjustment assemblies (333) (shown in greater detail in FIG. 152), and a bottom floor channel (331). While various components are shown provided in pairs, greater or fewer than two components are contemplated.

FIGS. 153-155 show a sliding door frame (800) for use with the wall panel system (301). Generally, a sliding door assembly (e.g., such as the sliding door assembly (541)) is operatively secured to the sliding door frame (800). As shown, the sliding door frame (800) includes a first jamb (802), a second jamb (804), and a header (806) extending between the first and second jambs (802, 804).

According to some embodiments, the first and second jambs (802, 804) are mirror images of one another and thus, features of both jambs (802, 804) are described in associate with the first jamb (802). FIG. 154 is partial view of the door frame (800) in area 154-154 designated in FIG. 153 and FIG. 155 is a top view of FIG. 154, according to some embodiments. As shown in FIG. 155, the first jamb (802) includes a clamp assembly (810) for clamping an adjacent frameless panel (not shown) of the wall panel system (301) and an inner cover assembly (812) for presenting an aesthetically pleasing surface to a user of the wall panel system (301).

In some embodiments, the clamp assembly (810) defines a receiving channel (813) for clamping onto a vertical edge of an adjacent, frameless wall panel (not shown), the clamp assembly (810) including a first portion (820) and a second portion (822), the first and second portions (820, 822) being configured to form a complementary fit to define the receiving channel (813). As shown, the clamp assembly (810) also includes retention members (824, 826) configured to be secured in an opposing manner to the first and second portions (820, 822), respectively.

The cover assembly (812) optionally includes securing means for securing the cover assembly (812) to the clamp assembly (810). In some embodiments, the securing means is a gasket (830) received by the cover assembly (812) and the clamp assembly (810) for frictionally retaining the cover assembly (812) to the clamp assembly (810) as shown in FIG. 155.

In some embodiments, assembly of the wall panel system (301) includes securing the first and second portions (820, 822) on opposing sides of a vertical edge of an adjacent, frameless wall panel (not shown) and securing the portions (820, 822) together using one or more fasteners (832) to secure the frameless panel and associated portions of the wall panel system (301) to the first jamb (802). The second jamb (804) is optionally secured to another frameless wall panel (not shown) of the wall panel system (301) and the header (806) is secured between the first and second jambs (802, 804). In some embodiments, a sliding door assembly (e.g., such as the sliding door assembly (541)) is operatively secured to header (806).

FIGS. 156-161 show additional features of the wall panel system (301) for further enhancing resistance of the wall panel system (301) against unwanted movement, such as that associated with seismic activity, for example. FIGS. 156 and 157 show an upper bracket (900) secured to adjacent ceiling tracks (327A, 327B) (e.g., similar to the ceiling track (327)) and the ceiling rail (329), the upper bracket (900) reinforcing or otherwise enhancing resistance of the wall panel system (301) to unwanted movement. As shown in FIGS. 158 and 159, the upper bracket (900) includes a first vertical leg (902) and a second vertical leg (904), the first vertical leg (902) being positioned above, and offset rearwardly from, the second vertical leg (904). The first vertical leg (902) is also substantially narrower than the second vertical leg (904), according to some embodiments. As shown, the first and second vertical legs (902, 904) include a plurality of apertures (906) for receiving fasteners, such as self-tapping screws (908) (FIGS. 156 and 157).

As shown in FIGS. 156 and 157, the upper bracket (900), also described as an upper interconnector, is centrally positioned between the adjacent ceiling tracks (327A, 327B), the first vertical leg (902) is secured to the ceiling rail (329), and the second vertical leg (904) is secured to the adjacent ceiling tracks (327A, 327B) using the self-tapping screws (908). In at least this manner, the adjacent ceiling tracks (327A, 327B) of the wall panel system (301) are secured together and are also secured to the ceiling rail (329) to provide additional resistance to unwanted movement of the wall panel system (301).

FIGS. 160-162 show a lower bracket (930) that is adapted to be received within adjacent bottom floor channels (331A, 331B) and secured to a floor to enhance resistance of the wall panel system (301) against unwanted movement. As shown in FIGS. 160 and 162, the lower bracket (930) is formed as an elongate piece of U-channel with relatively short sidewalls, the lower bracket (930) including two centrally located apertures (932).

In use the lower bracket (930), also described as a lower interconnector, is received within the adjacent, bottom floor channels (331A, 331B) and a fastener (not shown) such as a cement nail, is driven through the apertures (932) into the floor to help fasten the bottom floor channels (331A, 331B) to the floor.

FIGS. 163-167 show another height adjustment assembly (333), according to some embodiments. As shown, the height adjustment assembly (333) includes a scissors-type height adjustment mechanism including a base (339), opposite first and second end caps (441,443) projecting from the base (339), and a height adjusting rod (445) being rotatively mounted about the end caps (441,443). The height adjusting rod (445) has first and second threaded segments (447,449) each being oppositely threaded with respect to one another. The height adjustment assembly (333) also includes first and second adjustment legs (451,453), the first adjustment leg (451) having an extremity pivotably mounted onto a runner component (455) threadedly engaged onto the first threaded segment (447) of the height adjusting rod (445) and a second extremity pivotably mounted onto a support edge (335). As shown, the second adjustment leg (453) has an extremity pivotably mounted onto a runner component (457) threadedly engaged onto the second threaded segment (449) of the height adjusting rod (445) and a second extremity pivotably mounted onto the support edge (335), such that a rotation of the common height adjusting rod (445) along a first direction causes a raising of the support edge (335), and a rotation of the common height adjusting rod (445) along a second and opposite direction causes a lowering of the support edge (335).

Figure 165:
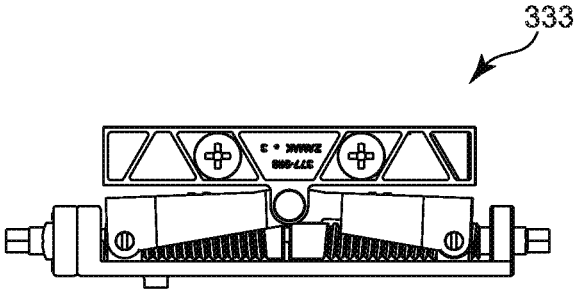
Figure 166:
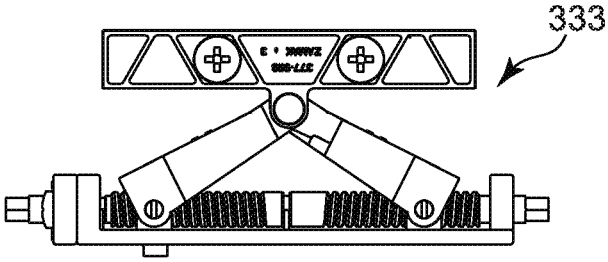
Figure 167:
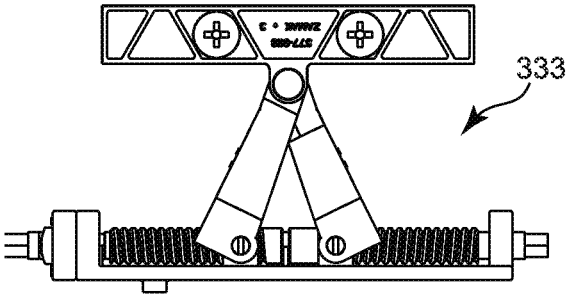

In some embodiments, the second extremities of the first and second adjustment legs (451,453) are pivotably mounted onto a bottom portion of the support edge (335) about a common pivot axis (459), as better shown in FIGS. 17, 18, 21 and 22. The adjustment legs (451,453) optionally include recessed portions (451A, 453A) for avoiding, or receiving, a portion of the height adjusting rod (445) when the adjustment legs (451,453) are drawn down into a lowered configuration. FIGS. 165-167 demonstrate movement of the height adjustment assembly (333) between a retracted or collapsed state (FIG. 165), an intermediate state (FIG. 166) and an extended, or expanded state (FIG. 167).

FIGS. 168-177 show various features and components of a wall panel system (301) including a plurality of pre-assembled wall panels (305*a,b,c*), each preassembly wall panel being similar to the pre-assembled wall panel (305) shown in FIG. 150. FIG. 168 shows a front, perspective view of the wall panel system (301) including a plurality of adjacent pre-assembled wall panels (305A,305B,305C), the plurality of wall panels (305*a,b,c*) including a first pre-assembled wall panel (305A), a second preassembled wall panel (305B), and a third pre-assembled wall panel (305C). As illustrated in FIG. 168, each of the preassembled wall panels (305A,305B,305C) include through holes (513) that are configured for use with a rail and tile system (950).

In some embodiments, the rail and tile system (950) includes a plurality of rails (952) forming a support framework and a plurality of tiles (954) supported by the framework. The tiles (954) are optionally secured to the rails (952) by fasteners, clips, brackets, adhesives or other securing means as desired. A variety of rail and tile system configurations are contemplated, where FIG. 169 shows rails (952) for supporting a tile (954) or tiles (954) formed of one or more pieces of fabric, FIG. 170 shows rails (952) for supporting a tile (954) or tiles (954) formed of a veneer or laminate material, and FIG. 171 shows rails (952) for supporting a tile (954) or tiles (954) formed of laminated glass that can be used as a marker board, for example.

FIG. 172 shows a back, perspective view of the wall panel system (301) with a second rail and tile system (950B) mounted to the back side of the wall panel system (301). The rail and tile system (950B) is shown in FIG. 172 with the tiles removed to show apertures (956B) in the rails (952B) for securing the rails to the wall panels (305A, 305B, 305C) using the through holes (513). For example, fasteners such as bolts and washers (FIG. 174) are threaded through the holes (513) to secure the rail and tile systems (950, 950B) in place on opposite sides of the wall panels (305A, 305B, 305C).

As shown in FIG. 168, wall panel accessories such as a shelf (960) or a table extension (962) are optionally secured (e.g., cantilevered) into the rails (952) or features (not shown) included in the tiles (954). FIG. 173 is an enlarged, cross-sectional view along line 173-173 in FIG. 172 with the second rail and tile system (950B) removed for ease of illustration. As shown, the shelf (960) is inserted into an opening in the rail (952) such that the shelf (960) is cantilevered to the rail (952). As shown in FIG. 168, one or more of the tiles (954) includes an opening or other features for receiving an electrical outlet assembly (964). The electrical outlet assembly (964) includes any of a variety of low, standard, or high voltage outlet means, such as a 110V electrical outlet, a LAN receptacle, an RF cable receptacle, or others. FIG. 172 shows the electrical outlet assembly (964) from a rear view (as viewed through the glass of the wall panel (305B)), where FIG. 175 is an enlarged view of area 175-175 of FIG. 172. As shown in FIG. 175, the electrical outlet assembly (964) includes a bracket (966) that is secured to the tile (954) using fastening means, such as screws, for example. The electrical outlet assembly (964) is optionally secured to a conduit feed assembly (FIG. 176) which is connected to an electrical source (e.g., 110V power source, a LAN connection, cable t.v., or other). If desired, the conduit feed assembly can be run down to the bottom cover (509) (FIG. 168) and through the bottom cover (509) to the electrical source. The electrical outlet assembly (964) thereby provides an effective and readily assembled solution for deploying outlets with the wall panel system 301.

FIGS. 176 and 177 show components of another electrical outlet assembly (970) that is configured to be mounted at the bottom of the wall panel system (301) adjacent the bottom floor channels (331). As shown, the electrical outlet assembly (970) includes a first outlet (972), a second outlet (974), an electrical interconnect (976), a first mounting bracket (978), a second mounting bracket (980), a conduit feed assembly (982), and a modified bottom cover (984) that works similarly to bottom cover (509).

The first and second outlets (972, 974) are optionally electrically connected by electrical interconnect (976). As shown, the first and second outlets (972, 974) are configured as U.S. standard 110V outlets, although as mentioned with the electrical outlet assembly (964) any of a variety of outlet configurations are contemplated. In some embodiments, the first bracket (978) is configured to clip onto the first outlet (972) and the second bracket (980) is similarly configured to clip onto the second outlet (974).

In some embodiments, the modified bottom cover (984) includes a first opening (990) for operatively exposing the first outlet (972) for a user and a second opening (992) for operatively exposing the second outlet (974) for the user. The cover (984) also includes a first slot (996) for receiving a portion of the first bracket (978) in a snap fit relationship and a second slot (998) for receiving a portion of the second bracket (980) in a snap fit relationship and defines an upper channel (999) configured to receive the first and second outlets (972, 974), the electrical interconnect (976), the first and second mounting brackets (978, 980), and the conduit feed assembly (982).

FIG. 177 is an end view showing the snap-fit, or clipped together relationship of the second bracket (980) and the bottom cover (984) with other portions of the assembly (970) removed for ease of illustration. As shown, the second bracket (980) is snapped into the bottom cover (984) with a lower portion (1000) of the second bracket (980) protruding through the second slot (998) (hidden in FIG. 177). With the components fully or partially assembled together, the bottom cover (984) is secured to one or more of the bottom channels (331) and the conduit feed assembly (982) is connected to an electrical source (e.g., 110V power source, a LAN connection, cable t.v., or others). The electrical outlet assembly (970) thereby provides an effective and readily assembled solution for deploying low and/or high voltage outlets with the system (FIG. 178*a*).

As discussed above, the innovative wall panel system disclosed herein comprises any of a frameless wall panel, a framed wall panel, or a solid wall panel. Accordingly, it should be appreciated that many of the above discussed configurations, installations, techniques features, components, etc. apply to each of a frameless wall panel system, a framed wall panel system, a solid wall panel system, or any wall panel system including an combination of frameless, framed, or solid wall panels. Similarly, the embodiments, below, although discussed with regard to both framed and solid wall panels, and solid and framed wall panel systems, the embodiments below may apply to each of a frameless wall panel system, a framed wall panel system, a solid wall panel system, or any wall panel system including an combination of frameless, framed, or solid wall panels.

As illustrated in FIGS. 178A and 178B, framed wall panel (2000) includes a top portion (2002), a bottom portion (2004), side portions (2006), and a framed portion (2008). Bottom portion (2004) of framed wall panel (2000) is insertable into a floor channel (2100). In one embodiment, the floor channel (2100) extends in a in a lengthwise direction between the right side and the left side of the framed wall panel (2000).

FIG. 178C is a side view of what is illustrated in FIG. 178B. FIGS. 179A and 179B are detailed views of the top portion (2002) and the bottom portion (2004), respectively, of framed wall panel (2000) as shown in FIG. 178C.

As illustrated in FIGS. 180A and 180B, solid wall panel (2500) includes a top portion (2502), a bottom portion (2504), and side portions (2506). In one embodiment, solid wall panel (2500) additionally includes one or more intermediate frame members (2508), as illustrated in FIGS. 180A and 180B. In one embodiment, bottom portion (2504) of framed wall panel (2500) is insertable into the floor channel (2100).

FIG. 180C is a side view of what is illustrated in FIG. 180B. FIGS. 181A and 181B are detailed views of the top portion (2502) and the bottom portion (2504), respectively, of framed wall panel (2500) as shown in FIG. 180C.

FIG. 182 illustrates a wall panel assembly configuration (3001) including a lower portion (3501). In one embodiment, solid wall panel (2500) is installed between a ceiling (4000) and a floor (4100) of a room according to one or more of the above-discussed embodiments. In one embodiment, a top portion (2502) of the wall panel (2500) includes a ceiling track (2510), where in the ceiling track (2510) is removably insertable into a ceiling rail (2600). Additionally, in various embodiments, the lower portion (3501) of the wall panel assembly configuration (3001) includes a lower trim panel assembly (2800), a solid wall lower support structure (2520), a height adjustment assembly (2540) (such as the height adjustment assembly (333), discussed above), a riser support structure (2560) and a floor channel (2100). In one embodiment, the lower support structure (2520) of solid wall panel (2500) is mounted to both the solid wall panel (2500) and the height adjustment assembly (2540), such that operation of the height adjustment assembly (2540) effectuates a change in a vertical position of the solid wall lower support structure (2520) and the solid wall panel (2500), as disclosed herein.

In one embodiment, height adjustment assembly (2540) is mounted to a top portion of the riser support structure (2560). For example, as illustrated in FIGS. 183A and 183B, Height adjustment assembly is mounted to a top portion 2560*a* of the riser support structure (2560). In one embodiment, the riser support structure includes one or more reliefs (2560*b*). In various embodiments, one or more of the reliefs (2560*b*) extend in a lengthwise direction between a left side (2560*x*) and a right side (2560*y*) of the riser support structure (2560). In various embodiments, one or more of the reliefs (2560*b*) create a void or channel between an upper portion (2560*c*) and a lower portion (2560*d*) of the riser support structure (2560), the created void or channel (or alternatively, the reliefs 2560*b*) operable to receive one or more components or features of the wall panel system, as discussed in greater detail below.

It should be appreciated that, by mounting height adjustment assembly (2540) to top portion 2560*a* of the riser support structure (2560), and by mounting the riser support structure (2560) to the floor channel (2100), the configuration provides for a channel or void in lower portion (3501) of wall panel system (3001). For example, as illustrated in FIG. 182, the above discussed configuration of lower portion (3501) of wall panel system (3001) creates a channel or void (3501*a*). It should be appreciated that additional components, such as the conduit feed assembly (982), discussed above, can be routed through channel 3501*a* without disrupting the operational capabilities of the wall panel system (3001). Such a configuration provides means for concealing various equipment such as cabling and other components within the wall panel system (3001).

In one embodiment, the solid wall panel (2500) is configured to receive one or more solid wall panels or tiles. In one such embodiment, the solid wall panels or tiles are fastened to the solid wall panel (2500) as discussed in greater detail above. In one alternative embodiment, the solid wall panels or tiles clip onto solid wall (2500) such that they are removably connected thereto. For example, the solid wall panels or tiles clip onto solid wall (2500) via one or more retaining features, such as retaining feature 2524, illustrated in FIG. 184. Additionally, or alternatively, the solid wall panels or tiles clip onto solid wall (2500) via one or more of the intermediate frame members (2508) of solid wall (2500). It should be appreciated that the one or more solid wall panels or tiles may include wall panels or tiles of varying sizes and shapes. It should also be appreciated that a combination of varying sized and shaped wall panels can be arranged upon solid wall panel (2500). In one embodiment, the solid wall panels are opaque. In another embodiment, the solid wall panels are transparent. In any event, it should be appreciated that any suitable style of wall panel is envisioned (for each of the frameless, framed, and solid wall embodiments), and those listed herein are for illustration purposes only.

Referring again to FIG. 182, the wall panel assembly (3001) includes one or more lower trim assemblies (2800). As illustrated in FIG. 184, a lower trim assembly (2800) includes a hinged trim panel (2802), a lower trim panel (2804), a hinged trim panel retaining member (2806), and a lower trim assembly retaining member (2808).

In one embodiment, the lower trim panel assembly (2800) is configured to operate with (or to otherwise interface with) the floor channel (2100). Specifically, the hinged trim panel (2802) of the lower trim panel assembly (2800) is configured to interface with the floor channel (2100). For example, as seen in FIG. 186, the floor channel (2100) includes a plurality of interface surfaces (2100*a*, 2100*b*) and a retaining feature (2100*c*). In one such embodiment, retaining feature 2100*c* is a channel or groove having a generally circular cross-section and extending in the lengthwise direction of the floor channel (2100), such that an axis of rotation is defined along the lengthwise direction of the floor channel (2100) at the center of the circular cross-section of retaining feature 2100*c*.

Additionally, the hinged trim panel (2802) includes a plurality of interface surfaces (2802*a*, 2802*b*), a retaining feature (2802*c*), and an upper retaining portion (2802*y*). In one embodiment, retaining feature 2802*c* is cylindrical and sized such that it can be received by retaining feature 2100*c* of the floor channel (2100). Once retaining feature 2802*c* of the hinged trim panel (2802) is retained within retaining feature 2100*c* of the floor channel (2100), the hinged trim panel (2802) is operable to pivot about the axis of rotation defined by retaining feature 2100*c*. In one embodiment, once retaining feature 2802*c* of the hinged trim panel (2802) is retained within retaining feature 2100*c* of the floor channel (2100), retaining feature 2100*c* of the floor channel (2100) constrains the hinged trim panel (2802) from vertical movement relative to the floor. Put differently, in one embodiment, while the hinged trim panel (2800) is free to pivot about the axis of rotation defined by retaining feature 2100*c*, the hinged trim panel is prevented from translating vertically relative to the floor of the room. In one such embodiment, the hinged trim panel (2800) is free to pivot a designated number of degrees. In one embodiment, as discussed in greater detail below, the designated number of degrees through which the hinged trim panel is free to pivot is constrained by interactions between the lower trim assembly (2800) and the framed wall panel (2500), as well as between the lower trim assembly (2800) and the floor of the room (3100).

In various embodiments, the hinged trim panel (2802) extends along the lengthwise direction of the floor channel. In one such embodiment, the hinged trim panel (2802) is generally the same length as the floor channel. In another such embodiment, the hinged trim panel (2802) is a different length than the floor channel (2100) (such as longer or shorter).

In one embodiment, hinged trim panel retaining feature 2802*c* of the hinged trim panel (2802) is initially inserted into retaining feature 2100*c* of the floor channel (2100) beginning at the rightmost side (or alternatively the leftmost side), whereinafter a lengthwise position of the hinged trim panel (2802) is adjusted by shifting the hinged trim panel (2802) along the length of the floor channel in a right to left direction until the hinged trim panel (2802) is properly positioned relative to the floor channel (2100). In another embodiment, retaining feature 2100*c* and retaining feature 2802*c* are appropriately sized to accommodate retaining feature 2802*c* being snapped into retaining feature 2100*c*. It should be appreciated that the above-discussed configuration provides that the hinged trim panel (2802) is vertically constrained by the floor channel (2100) such that a vertical position of the hinged trim panel (2802) cannot change relative to the floor channel (2100).

As is further illustrated in FIG. 186, the lower trim panel (2804) includes a plurality of interface surfaces (2804*a*, 2804*b*, 2804*c*), a retaining feature (2804*d*), and a retaining portion (2804*y*), and extends in a lengthwise direction between a left side and a right side of the solid wall panel (2500). In one embodiment, the lower trim panel (2804) is generally the same length as the solid wall panel (2500). In another such embodiment, the lower trim panel (2804) is a different length than the solid wall panel (2500) (such as longer or shorter).

Additionally, as illustrated in FIG. 186, the hinged trim panel retaining member (2806) includes an interface surface (2806*b*), an alignment feature (2806*c*), and a retaining feature (2806*d*), and extends in a lengthwise direction between a left side and a right side of the lower trim panel (2804). In one embodiment, the hinged trim panel retaining member (2806) is generally the same length as the lower trim panel (2804). In another such embodiment, the hinged trim panel retaining member (2806) is a different length than the lower trim panel (2803) (such as longer or shorter).

In one embodiment, retaining feature 2806*d* of the hinged trim panel retaining member (2806) is insertable into retaining feature 2804*d* of the lower trim panel (2804). After inserting retaining feature 2806*d* of the hinged trim panel retaining member (2806) into retaining feature 2804*d* of the lower trim panel (2804), interface surface 2804*a* of the lower trim panel (2804) is in contact with interface surface 2806*b* of the hinged trim panel retaining member (2806). In one embodiment, as illustrated in FIG. 186, retaining feature 2804*d* of the lower trim panel (2804) is a channel or groove generally having a C-shape cross-section and extending along the length of the lower trim panel (2804). Generally, retaining feature 2806*d* of the hinged trim panel retaining member (2806) comprises a cross-sectional shape conducive for properly interfacing with retaining feature 2804*d*, and extends along the length of the lower trim panel (2804). For example, as illustrated in FIG. 186, retaining feature 2806*d* of the hinged trim panel retaining member (2806) is inserted and retained within retaining feature 2804*d* of the lower trim panel (2804).

In one embodiment, the hinged trim panel retaining member (2806) is generally the same length as the lower trim panel (2804). In another embodiment, the hinged trim panel retaining member (2806) is a different length than the lower trim panel (2804) (such as longer or shorter). In one such embodiment, wherein the hinged trim panel retaining member (2806) is shorter than the length of the lower trim panel (2804), a plurality of hinged trim panel retaining members (2806) are inserted at designated positions along the length of the lower trim panel (2804). In one embodiment, the designated positions are equally spaced along the length of the lower trim panel (2804). In another embodiment, the designated positions are not equally spaced along the length of the lower trim panel (2804). In yet another embodiment, the designated positions are randomly located along the length of the lower trim panel (2804).

It should also be appreciated that, the hinged trim panel retaining member (2806) has a fixed vertical position relative to the lower trim panel (2804). Accordingly, as the height adjustment assembly (2540) is operated to change the vertical position of the framed wall panel (2500) (or the lower trim panel (2804) is repositioned by any other suitable fashion, such as by hand), the vertical position of the hinged trim panel retaining member (2806) also changes.

As discussed above, in various embodiments, retaining feature 2806*d* is configured to be retained within retaining feature 2804*d*. In one such embodiment, retaining feature 2806*d* is retained such that the hinged trim panel retaining member (2806) maintains its position relative to lower trim panel (2804) while allowing interface surface 2806*b* to be deflected away from interface surface 2804*a*. In this embodiment, as interface surface 2806*b* is deflected away from interface surface 2804*a*, a void is created between interface surface 2806*b* and interface surface 2804*a*, the created void operable to receive and retain the hinged trim panel (2802), as discussed further below and as illustrated in FIGS. 187A and 187B.

As discussed above, lower trim panel (2804) and the hinged trim panel retaining member (2806) are configured to operate to retain the hinged trim panel (2802). Specifically, when assembling the lower trim assembly (2800), the alignment feature (2806*c*) of the hinged trim panel retaining member (2806) directs the hinged trim panel (2802) between interface surface 2804*a* of the lower trim panel (2804) and interface surface 2806*b* of the hinged trim panel retaining member (2806). Accordingly, interface surface 2802*a* of the hinged trim panel (2802) comes into contact with interface surface 2804*a* of the lower trim panel (2804) and interface surface 2802*b* of the hinged trim panel (2802) comes into contact with the interface surface 2806*b* of the hinged trim panel retaining member (2806). As interface surface 2802*b* of the hinged trim panel (2802) comes into contact with the interface surface 2806*b* of the hinged trim panel retaining member (2806), interface surface 2802*b* of the hinged trim panel causes interface surface 2806*b* of the hinged trim panel retaining member (2806) to be deflected away from interface surface 2804*a* of the lower trim panel (2804) such that a void is created therebetween, the void being operable to receive and maintain upper retaining portion 2802*y* of the hinged trim panel (2802). For example, FIG. 187A illustrates upper retaining portion 2802*y* of the hinged trim panel (2802) being retained between the lower trim panel (2804) and the hinged trim panel retaining member (2806).

In one embodiment, the upper retaining portion 2802*y* of the hinged trim panel (2802) is frictionally retained between interface surfaces 2804*a* and 2806*b* of the lower trim panel (2804) and the hinged trim panel retaining member (2806), respectively. In one such embodiment, although frictionally retained, a first portion of the lower trim assembly (2800) (which includes at least the lower trim panel (2804) and the hinged trim panel retaining member (2806)) is free to change position relative to a second portion of the lower trim assembly (2800) (which includes at least the hinged trim panel (2802)). In this embodiment, upper retaining portion 2802*y* slideably interacts (or interfaces) with interface surfaces 2804*a* and 2806*b* of the lower trim panel (2804) and the hinged trim panel retaining member (2806), respectively. Put differently, interface surface 2802*a* of the hinged trim panel (2802) is free to slide against interface surface 2804*a* of the lower trim panel (2804), and interface surface 2802*b* of the hinged trim panel (2802) is free to slide against interface surface 2806*b* of the hinged trim panel retaining member (2806).

It should be appreciated that, even when the lower trim assembly (2800) is removably connected to the framed wall panel (2500) (as discussed below) and pivotably connected to the floor channel (2100), by frictionally (such as slideably) retaining upper portion 2802*y* of the hinged trim panel (2802), the relative vertical position of the first portion of the lower trim assembly (2800) (which includes at least the lower trim panel (2804) and the hinged trim panel retaining member (2806)) is free to change relative to the second portion of the lower trim assembly (2800) (which includes at least the hinged trim panel (2802)). Moreover, although the first portion of the lower trim assembly (2800) is free to change position relative to the second portion of the lower trim assembly (2800) contact therebetween is maintained (such as between surfaces 2804*a* and 2802*a*, and 2806*b* and 2802*b*). In one such embodiment, as the height adjustment assembly (2540) is operated to change the vertical position of the framed wall panel (2500), the vertical position of the lower trim panel (2804) (which is free to move vertically relative to the floor channel (2100)) changes relative to the hinged trim panel (2802) (which is constrained from vertical movement by the floor channel (2100)).

A further example of the relationship between the hinged trim panel (2802), the lower trim panel (2804), and the hinged trim panel retaining member (2806) is illustrated in FIGS. 187A and 187B. Specifically, as illustrated in FIG. 187A, the lower trim panel (2804) and the hinged trim panel retaining member (2806) are located at a first position (2800*a*) relative to the hinged trim panel (2802). As illustrated, the hinged trim panel (2802) is in contract with both the lower trim panel (2804) and the hinged trim panel retaining member (2806). On the other hand, as illustrated in FIG. 187B, the lower trim panel (2804) and the hinged trim panel retaining member (2806) are located at a second different position (2800*b*) relative to the hinged trim panel (2802). As illustrated, although the relative position of the lower trim panel (2804) and the hinged trim panel retaining member (2806) has changed relative to the hinged trim panel (2802), the hinged trim panel (2802) remains in contract with both the lower trim panel (2804) and the hinged trim panel retaining member (2806). In one embodiment, the hinged trim panel (2802) is slideably connected to both the lower trim panel (2804) and the hinged trim panel retaining member (2806) such that the upper retaining portion 2802*y* of the hinged trim panel (2802) is free to slide between interface surfaces 2804*a* and 2806*b* of the lower trim panel (2804) and the hinged trim panel retaining member (2806).

It should be appreciated that, while the hinged trim panel (2802) is retained by the lower trim assembly (2804) and the hinged trim panel retaining member (2806), the hinged trim panel (2802) is removable from the lower trim assembly (2804) and the hinged trim panel retaining member (2806). Put differently, the first portion of the lower trim assembly (2800), discussed above, is removable (or is otherwise separable) from the second portion of the lower trim assembly (2800). For example, if the upper retaining portion 2802*y* of the hinged trim panel (2802) is removed from (or otherwise slid out of) the void between interface surfaces 2802*a* and 2806*b* of the lower trim panel (2802) and the hinged trim panel retaining member (2806), respectively, then the lower trim panel (2802) and the hinged trim panel retaining member (2806) can be separated (or otherwise disconnected) from the hinged trim panel (2802).

In addition to interfacing with the floor channel (2100), in various embodiments, the lower trim assembly (2800) also interfaces with the solid wall lower support structure (2520) (or alternatively framed wall lower support structure (2520'), as illustrated in FIG. 185). In one embodiment, the lower trim assembly (2800) includes a lower trim assembly retaining member (2808). As illustrated in FIG. 186, the lower trim assembly retaining member (2808) includes a plurality of interface surfaces (2808*b*, 2808*c*) and a retaining portion (2808*a*). In one embodiment, retaining portion 2808*a* includes a plurality of deflectable protrusions, such as the plurality of protrusions (2808*d*), illustrated in FIG. 186.

In one embodiment, the lower trim assembly retaining member (2808) is configured to be frictionally retained upon the lower trim panel (2804). For example, as illustrated in FIG. 186, surfaces 2808*b* and 2808*c* of the lower trim assembly retaining member (2808) interface with surfaces 2804*b* and 2804*c* of lower trim panel (2804), respectively, such that the lower trim assembly retaining member (2808) is retained upon retaining portion 2804*y* of the lower trim panel (2804). In one embodiment, the lower trim assembly retaining member (2808) is frictionally retained (or additionally slideably retained) upon retaining portion 2804*y* of the lower trim panel (2804). In various embodiments, a plurality of lower trim assembly retaining members (2808) are frictionally retained along and upon retaining portion 2804*y* of the lower trim panel (2804). For example, a plurality of lower trim assembly retaining members (2808) are positioned along and upon retaining portion 2804*y* of the lower trim panel (2804) at designated positions. In one embodiment, the designated positions are equally spaced along the lengthwise direction of the lower trim panel (2804). In another embodiment, the designated positions are not equally spaced along the lengthwise direction of the lower trim panel (2804). In yet another embodiment, the designated positions are randomly located along the lengthwise direction of the lower trim panel (2804). It should be appreciated that any suitable method for retaining lower trim assembly retaining member (2808) upon lower trim panel (2804) is envisioned.

Referring now to FIGS. 187A and 187B, the solid wall lower support structure (2520) includes one or more voids (2522). In one embodiment, each void 2522 of the solid wall lower support structure (2520) extends in a lengthwise direction between a left side and a right side of the solid wall lower support structure (2520). In one embodiment, one or more void 2522 of the solid wall lower support structure (2520) extend continuously between the left side to the right side of the solid wall lower support structure (2520). In one embodiment, a void 2522 includes a retaining feature (2522*a*) and one or more interface surfaces (2522*b*), and is configured to receive one or more lower trim assembly retaining members (2808).

In one embodiment, retaining feature 2522*a* is a protrusion extending away from one of the inner surfaces 2522*b*. In one embodiment, such a protrusion (of 2522*a*) is curved such that a smooth transition is created to cause the protrusions 2808*d* of retaining portion 2808*a* of the lower trim assembly retaining member (2808) to deflect, thereby allowing the lower trim assembly retaining member (2808) to be operatively inserted into and retained within void 2522. In one embodiment, retaining feature 2522*a* extends continuously along the length of void 2522. Additionally, in one alternative embodiment, void 2522 is not continuous between the left and right sides of the lower support structure (2520). In one such embodiment, a plurality of independent voids 2522 are located at designated positions between the left side and the right side of the solid wall lower support structure (2520), each of the plurality of voids 2522 configured to receive a lower trim assembly retaining member (2808). It should be appreciated that retaining feature 2522*a* may assume any suitable shape or size without departing from the spirit or scope of the disclosed subject matter.

In one embodiment, as discussed above, retaining feature 2522*a* interacts with one or more of the protrusions 2808*d* of retaining portion 2808*a* of lower trim assembly retaining member (2808), thereby retaining the lower trim assembly retaining member (2808) within void 2522 of the solid wall lower support structure (2520). In one embodiment, by retaining the lower trim assembly retaining member (2808), the lower trim assembly (2800) assumes a closed position

5000*a*, as illustrated in FIG. 187A. It should also be appreciated that, because the lower trim assembly retaining member (2808) is retained upon retaining portion 2804*y* of the lower trim panel (2804), and because the lower trim assembly retaining member (2808) is retained within void 2522 of the solid wall lower support structure (2520), the lower trim panel (2804) is constrained to move vertically in lock step with the solid wall lower support structure (2520).

In various embodiments, the lower trim assembly (2800) can be operably transitioned between a closed state (5000*a*) and an open state (5000*b*), as illustrated in FIGS. 187A and 187B. In one embodiment, the lower trim assembly (2800) pivots between the closed state (5000*a*) and the open state (5000*b*). It should be appreciated that, when pivoting, the lower trim assembly (2800) pivots a number of degrees (α), as discussed below. It should also be appreciated that lower trim assembly is pivotable through any suitable number of degrees (as constrained by the solid wall panel (2500) and the floor of the room (3100)) and may be pivoted continuously through such a suitable number of degrees. Accordingly, trim assembly can be pivoted to virtually any degree between the closed state (5000*a*) and the open state (5000*b*). Put differently, trim assembly is not constrained to be pivotable to only discrete positions between the closed state (5000*a*) and the open state (5000*b*).

In one embodiment, as mentioned above, when positioned in a closed state (5000*a*) the lower trim assembly (2800) is both removably connected to the wall panel system (3001) and pivotably connected to the floor channel (2100). Specifically, when positioned in closed state (5000*a*), the lower trim assembly retaining member (2808) of the lower trim assembly (2800) is removably connected to the solid wall lower support structure (2520). That is, when positioned in closed state (5000*a*), retaining feature 2522*a* of the solid wall lower support structure (2520) interacts with one or more of the protrusions 2808*d* of retaining portion 2808*c* of lower trim assembly retaining member (2808), and thereby removably retains the lower trim assembly retaining member (2808), as discussed above. In such a configuration, when the lower trim assembly retaining member (2808) is removed from void 2522 of the solid wall lower support structure (2520), protrusions 2808*b* of the lower trim assembly retaining member (2808) are again deflected by retaining feature 2522*a*. In one embodiment, when positioned in a closed state (5000*a*), the hinged trim panel (2802) is retained within the lower floor channel (2100). Specifically, when positioned in a closed state (5000*a*), retaining member 2802*c* of the hinged trim panel (2802) is retained by retaining feature 2100*c* of the floor channel (2100), as discussed above.

On the other hand, when positioned in an open state (5000*b*) (such as after retaining member 2802*c* is removed from void 2522 of the solid wall lower support structure (2520), while the lower trim assembly (2800) remains pivotably connected to the floor channel (2100), the lower trim assembly (2800) is no longer connected to the wall panel system (3001). That is, lower trim assembly retaining member (2808) is no longer retained within void 2522 of the solid wall lower support structure (2520). Accordingly, by disconnecting the lower trim panel (2800) from the wall panel system (3001) such that lower trim assembly (2800) remains pivotably connected to the floor channel (2100), lower trim assembly (2800) is free to pivot about the axis of rotation defined by retaining feature 2100*c* of the floor channel (2100), as discussed above. In one embodiment, the lower trim assembly is free to pivot a designated number of degrees (α) relative to a generally vertical orientation assumed by the lower trim assembly (2800) when positioned in a closed state (5000*a*). In one such embodiment, the designated number of degrees is between 0 to 90 degrees. In another embodiment, the designated number of degrees is between 0 and less than 90 degrees. In yet another embodiment, the designated number of degrees is between 0 and greater than 90 degrees.

While certain of the above discussed embodiments illustrate the lower trim panel (2800) being removably connected to the solid wall panel (2500) through interactions with the solid wall lower support structure (2520), it should be appreciated that the lower trim panel (2800) may additionally, or alternatively, be removably connected to other components of the solid wall panel (2500), such as: one or more frames, one or more height adjustment assemblies, one or more clamps, one or more panels or tiles, one or more riser structures, or any other suitable component of the wall panel system (3001).

As discussed above, the lower trim assembly (2800) can be positioned in both an open state 5000*a* and a closed state 5000*b*. In one embodiment, when positioned in a closed state (5000*a*), the lower trim assembly (2800) conceals (or otherwise renders inaccessible and not visible) the lower portion (3501) of the wall panel system (3001), as illustrated in FIG. 183. In other words, under this embodiment, when positioned in a closed state (5000*a*), the lower trim assembly (2800) conceals (or otherwise renders inaccessible and not visible) each of: the height adjustment assembly (2540), the riser support structure (2560), and the channel (3501*a*) created by the riser support structure (2560). On the other hand, positioning the lower trim assembly (2800) in an open state (5000*b*) reveals and provides accessibility and visibility to each of: the height adjustment assembly (2540), the riser support structure (2560), and the channel (3501*a*) created by the riser support structure (2560). It should be appreciated that, under the above-discussed configuration, the height adjustment assembly (2540) can be operated without completely removing the lower trim assembly (2800). Such a configuration provides for efficient vertical adjustment of the wall panel assembly. Moreover, because the lower trim panel assembly (2800) can be easily and efficiently adjusted (such as by changing the position of the hinged trim panel (2802) relative to the position of the lower trim panel (2804)) to accommodate a plurality of different vertical positions of the solid wall panel (2500), modifying a vertical position of a wall panel is easy and efficient. Accordingly, installation of such a wall panel system is easy and efficient.

Although various features of modular wall systems and associated methods have been described, it should be understood a variety of different features and combinations thereof are contemplated without departing from the scope of the present subject matter and without diminishing its intended advantages. For example, while the embodiments described above refer to the particular features, the scope of the present subject matter also includes embodiments having different combinations of features and embodiments that do not include all of the described features. Accordingly, the scope of the present subject matter is intended to embrace all such alternatives, modifications, and variations as fall within the claims, together with all equivalents thereof.

We claim:

1. A moveable and demountable wall panel system secured between a floor of a room and a ceiling rail secured to a ceiling of the room, the wall panel system comprising:

a wall panel having a top, a bottom, a left side, a right side, a front and a back, the wall panel having a variable vertical position relative to the floor of the room;

a floor channel extending in a lengthwise direction between the right side and the left side of the wall panel;

a lower portion comprising a height adjustment mechanism operatively coupled to the wall panel and configured to transition between a collapsed state and an expanded state to modify the variable vertical position of the wall panel relative to the floor of the room; and a bottom cover including a first portion and a second portion, the first portion being removably connected to the wall panel and having a variable vertical position relative to the floor of the room, the second portion being pivotably connected to the floor channel, the first portion retaining the second portion such that when the second portion is pivoted about the floor channel the first portion disconnects from the wall panel and a position of the first portion relative to the second portion is maintained as the second portion pivots about the floor channel.

2. The moveable and demountable wall panel system of claim 1, wherein the second portion is pivotable from a first position to a second, different position, the first position defining a closed state of the bottom cover, and the second position defining an open state of the bottom cover.

3. The moveable and demountable wall panel system of claim 2, wherein when the bottom cover is in the closed state, the first portion is removably connected to the wall panel such that the second portion is restrained from pivoting, and wherein when the bottom cover is in the open state, the first portion is disconnected from the wall panel such that the second portion is free to pivot.

4. The moveable and demountable wall panel system of claim 2, wherein when the bottom cover is in the closed state, the lower portion of the wall panel system is concealed and inaccessible, and wherein when the bottom cover is in the open state, the lower portion of the wall panel system is revealed and accessible.

5. The moveable and demountable wall panel system of claim 2, wherein the second portion is pivotable to any position defined between the first position and the second position.

6. The moveable and demountable wall panel system of claim 1, wherein the second portion pivots about an axis defined by an interface feature of the floor channel.

7. The moveable and demountable wall panel system of claim 1, wherein the first portion of the bottom cover frictionally retains the second portion of the bottom cover.

8. The moveable and demountable wall panel system of claim 7, wherein the first portion of the bottom cover slideably retains the second portion such that as a position of the first portion changes relative to a position of the second portion, a surface of the first portion slides against and remains in contact with a surface of the second portion.

9. The moveable and demountable wall panel system of claim 1, wherein the second portion of the bottom cover includes an interface feature, the interface feature having an interface length such that the first portion of the bottom cover can be positioned at any location along the interface length of the interface feature of the second portion of the bottom cover.

10. The moveable and demountable wall panel system of claim 9, wherein the first portion can be continuously repositioned along the interface length of the interface feature of the second portion of the bottom cover.

11. The moveable and demountable wall panel system of claim 1, wherein the first portion of the bottom cover is removable from the second portion.

12. The moveable and demountable wall panel system of claim 1, wherein the lower portion further comprises a riser, the riser being coupled to the height adjustment mechanism, the riser creating a hollow channel, the hollow channel extending in a lengthwise directing between the right side and the left side of the wall panel.

13. A moveable and demountable wall panel system secured between a floor of a room and a ceiling rail secured to a ceiling of the room, the wall panel system comprising:

a wall panel having a top, a bottom, a left side, a right side, a front and a back, the wall panel having a variable vertical position relative to the floor of the room;

a floor channel extending in a lengthwise direction between the right side and the left side of the wall panel;

a lower portion, the lower portion comprising:

a riser mounted to the floor channel, the riser creating a hollow channel, the hollow channel extending in a lengthwise directing between the right side and the left side of the wall panel; and a height adjustment mechanism mounted to the riser and operatively coupled to the wall panel, the height adjustment mechanism configured to transition between a collapsed state and an expanded state to modify a vertical position of the wall panel; and a bottom cover including a first portion and a second portion, the first portion being removably connected to the wall panel and the second portion being pivotably connected to the floor channel, the first portion retaining the second portion such that when the second portion is pivoted about the floor channel the first portion disconnects from the wall panel and a position of the first portion relative to the second portion is maintained as the second portion pivots about the floor channel.

14. The moveable and demountable wall panel system of claim 13, wherein second portion is pivotable from a first position to a second, different position, the first position defining a closed state of the bottom cover, and the second position defining an open state of the bottom cover.

15. The moveable and demountable wall panel system of claim 14, wherein when the bottom cover is in the closed state, the first portion is removably connected to the wall panel such that the second portion is restrained from pivoting, and wherein when the bottom cover is in the open state, the first portion is disconnected from the wall panel such that the second portion is free to pivot.

16. The moveable and demountable wall panel system of claim 14, wherein when the bottom cover is in the closed state, the lower portion of the wall panel system is concealed and inaccessible, and wherein when the bottom cover is in the open state, the lower portion of the wall panel system is revealed and accessible.

17. A method of installing a moveable and demountable wall panel system between a floor of a room and a ceiling rail secured to a ceiling of the room, the method comprising:

inserting a ceiling track of a pre-assembled wall panel into the ceiling rail, the pre-assembled wall panel having a variable vertical position relative to the floor of the room and having:

an upper portion including a panel having a top, a bottom, a left side, a right side, a front, and a back; and a lower portion including a height adjustment mechanism operatively coupled to the panel and configured to transition between a collapsed state and an expanded state to modify the variable vertical position of the pre-assembled wall panel relative to the floor of the room;

inserting the bottom of the pre-assembled wall panel into a floor channel;

installing a bottom cover including a first portion and a second portion, the first portion being removably connected to the pre-assembled wall panel and having a variable vertical position relative to the floor of the room, the second portion being pivotably connected to the floor the first portion retaining the second portion such that when the second portion is pivoted about the floor channel the first portion disconnects from the wall panel and a position of the first portion relative to the second portion is maintained as the second portion pivots about the floor channel; and adjusting the vertical position of the pre-assembled wall panel by actuating the height adjustment mechanism, the second portion of the bottom cover being constrained from vertical movement relative to the floor of the room while the first portion is free to change vertical position relative to the floor of the room as the vertical position of the pre-assembled wall panel is adjusted.

18. The method of installing a moveable and demountable wall panel system of claim 17, wherein the second portion is pivotable from a first position to a second, different position, the first position defining a closed state of the bottom cover, and the second position defining an open state of the bottom cover.

19. The method of installing a moveable and demountable wall panel system of claim 18, wherein when the bottom cover is in the closed state, the first portion is removably connected to the pre-assembled wall panel such that the second portion is restrained from pivoting, and wherein when the bottom cover is in the open state, the first portion is disconnected from the pre-assembled wall panel such that the second portion is free to pivot.

20. The method of installing a moveable and demountable wall panel system of claim 18, wherein when the bottom cover is in the closed state, the lower portion of the wall panel system is concealed and inaccessible, and wherein when the bottom cover is in the open state, the lower portion of the wall panel system is revealed and accessible.

* * * * *